US005619221A

United States Patent [19]

Hirai et al.

[11] Patent Number: 5,619,221

[45] Date of Patent: Apr. 8, 1997

[54] LIQUID CRYSTAL DISPLAY DEVICE

[75] Inventors: Hoko Hirai; Susumu Kondo, both of Yokohama, Japan

[73] Assignee: Kabushiki Kaisha Toshiba, Kanagawa-ken, Japan

[21] Appl. No.: 352,158

[22] Filed: Dec. 1, 1994

Related U.S. Application Data

[62] Division of Ser. No. 60,554, May 13, 1993, Pat. No. 5,434, 599.

[30] Foreign Application Priority Data

| | | | |
|---|---|---|---|
| May 21, 1992 | [JP] | Japan | 4-128554 |
| May 14, 1992 | [JP] | Japan | 4-121574 |
| Oct. 12, 1992 | [JP] | Japan | 4-272733 |

[51] Int. Cl.[6] ..... G09G 3/36

[52] U.S. Cl. ..... 345/58; 345/94; 345/100

[58] Field of Search ..... 345/98–100, 58, 345/94, 95, 96, 101; 359/54, 55

[56] References Cited

U.S. PATENT DOCUMENTS 5,008,657 4/1991 Hanson et al. ..... 340/766

FOREIGN PATENT DOCUMENTS

| | | |
|---|---|---|
| 0397260 | 11/1990 | European Pat. Off. . |
| 0428250A2 | 5/1991 | European Pat. Off. . |
| 0466506A2 | 1/1992 | European Pat. Off. . |
| 0542307A2 | 5/1993 | European Pat. Off. . |
| 2171718 | 7/1990 | Japan . |
| 4022923 | 1/1992 | Japan . |

OTHER PUBLICATIONS

P. Maltese, "Cross–Modulation and Nonuniformity Reduction in the Addressing of Matrix Displays", Proceedings of the Society for Information Display, vol. 26, No. 2, pp. 125–132 (1985).

John D. Lenk, "Handbook for Transistors", 1976, pp. 104–105.

Paolo Maltese, "Cross–Modulation and Disuniformity Reduction in the Addressing of Passive Matrix Displays", Euro Dusplay '84, pp. 15–20.

"A New Driving Method for Crosstalk Reduction in Simple–matrix LCDs", Hirai et al., Technical Report of IEICE, EID92–83, pp. 41–45, Dec. 18, 1992.

Liquid Display Seminar Textbook, Hatoh, H., pp. 1–14, Apr. 21, 1993.

"Crosstalk–Free Driving Methods for STN–LCDs", Yoshiya Kaneko et al. SID '90 Digest, pp. 412–415, May 15–17, 1990.

"Active Addressing Method for High–Contrast Video–Rate STN Displays", T. J. Scheffer et al., SID '92 Digest, pp. 228–231, May 17–22, 1992.

"A Color STN–LCD with Improved Contrast, Uniformity, and Response Times", S. Ihara et al., SID '92 Digest, pp. 232–235, May 17–22, 1992.

"A New Driving Method for Crosstalk Compensation in Simple–Matrix LCDs", H. Hirai et al., Japan Display '92 Digest, pp. 499–502, Oct. 12–14, 1992.

*Primary Examiner*—Steven Saras

*Attorney, Agent, or Firm*—Finnegan, Henderson, Farabow, Garrett & Dunner, L.L.P.

[57] ABSTRACT

A wiring 19 of a device directly detects a voltage from a plurality of scanning electrodes 1, a voltage detecting electrode 701 detects a voltage from a plurality of the scanning electrodes 1. A voltage variation component such as voltage distortion of the detected voltage which adversely affects on an image display is taken out, inverted, and negative fed back to the scanning electrode 1. A negative feedback loop provides the negative feedback of the voltage detected from and fed back to the scanning electrode 1, this therefore suppresses the disadvantageous voltage variation such as a distortion voltage which tends to arise in the scanning electrode 1.

4 Claims, 42 Drawing Sheets

SCANNING SIGNAL WAVEFORM

DATA SIGNAL WAVEFORM

LIQUID CRYSTAL APPLYING VOLTAGE WAVEFORM

SCANNING SIGNAL POTENTIAL CONTROL TERMINAL

DATA SIGNAL WAVEFORM

LIQUID CRYSTAL APPLYING VOLTAGE WAVEFORM

SCANNING SIGNAL WAVEFORM

DATA SIGNAL WAVEFORM

LIQUID CRYSTAL APPLYING VOLTAGE WAVEFORM

SCANNING SIGNAL WAVEFORM

DATA SIGNAL WAVEFORM

LIQUID CRYSTAL APPLYING VOLTAGE

SCANNING WAVEFORM

SIGNAL WAVEFORM

LIQUID CRYSTAL APPLYING VOLTAGE WAVEFORM

FIG. 39 (a) (PRIOR ART)
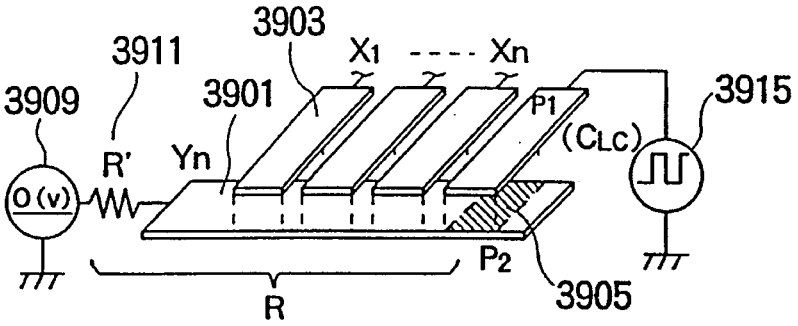
FIG. 39 (b) (PRIOR ART)
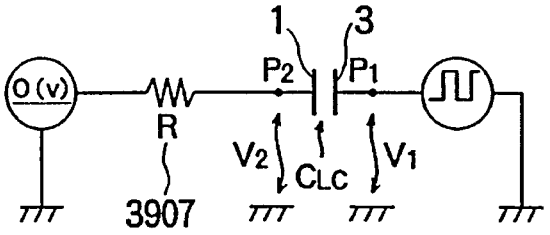
FIG. 39 (c) (PRIOR ART)
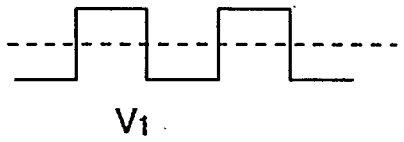
FIG. 39 (d) (PRIOR ART)
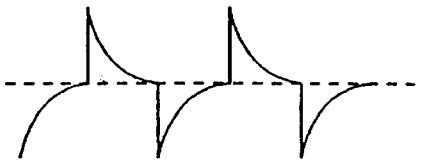
FIG. 39 (e) (PRIOR ART)
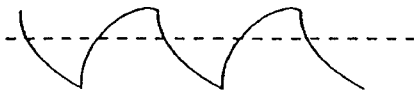

W B W B W B W
DATA SIGNAL
V0
V1
V2
SCANNING SIGNAL
V1
EFFECTIVE VALUE

W
WAVWFORM OF SCANNING NON-SELECTED PERIOD IN HORIZONTAL STRIP SHAPED DISPLAY PATTERN
(W : WHITE DISPLAY DATA,B : BLOCK DISPLAY DATA,
V0 : SELECTED SIGNAL POTENTIAL,
V1 : NON-SELECTED SCANNING POTENTIAL,
V2 : NON-SELECTED SIGNAL POTENTIAL)

WAVEFORM OF SCANNING SELECTED PULSE IN BLOCK SHAPED DISPLAY PATTERN
(W : WHITE DISPLAYDATA,B : BLACK DISPLAY DATA,
V0 : SELECTED SCANNING POTENTIAL,
V4 : NON-SELECTED SCANNING POTENTIAL,
V3 : NON-SELECTED SIGNAL POTENTIAL,
V5 : SELECTED SIGNAL POTENTIAL)

B
W
B
W
V3
V5
V0
V4
DATA SIGNAL
SCANNING SIGNAL
WAVEFORM OF SCANNING SELECTED PULSE
IN BLOCK SHAPED DISPLAY PATTERN
(W : WHITE DISPLAYDATA,B : BLACK DISPLAY DATA,
V0 : SELECTED SCANNING POTENTIAL,
V4 : NON-SELECTED SCANNING POTENTIAL,
V3 : NON-SELECTED SIGNAL POTENTIAL,
V5 : SELECTED SIGNAL POTENTIAL)

LIQUID CRYSTAL DISPLAY DEVICE

This is a division of application Ser. No. 08/060,554, filed May 13, 1993 now U.S. Pat. No. 5,434,599.

BACKGROUND OF THE INVENTION

1. Field of the Invention

The invention relates to a liquid crystal display device.

2. Description of the Related Art

A liquid crystal display device is widely utilized for information processing devices such as word processors, and personal computers or display devices such as small type televisions and projecting type televisions due to its features of thinner construction and lower power consumption and the like. The liquid crystal display devices in such utilizations are largely classified into two systems, a simple-matrix system and a active-matrix system.

The liquid crystal display devices of the simple-matrix systems are now used in various fields due to its simple construction, lower production cost, and easier production process for large scale of such devices with respect to liquid crystal display panel.

The active-matrix type liquid crystal display device is used, for example, for a high fine display device admitted as compatible to VGA (Video Graphic Array) or the like, and particularly utilized for its feature of clear image display with a high contrast and fine accuracy.

However, in such liquid crystal display devices, a problem arises particularly for a simple-matrix drive LCD in deteriorations of a contrast ratio and deterioration of display uniformity in accordance with an operational principle.

The problem of such degrade of display uniformity comes also in the active-matrix drive LCD, but not so large as in the simple-matrix LCD.

A typical example of display uniformity degradation is described for STN (Super Twisted Nematic) type liquid crystal display device.

When images are allowed to display on a display surface of the liquid crystal display device, a thin display viewed as drawing shades is sometimes seen on upper and lower or left and right portions other than intrinsic display images. This is called as a crosstalk, which is the biggest problem in deterioration of display uniformity. Particularly, in gradation representation by the liquid crystal display device, a contrast of an intrinsic gradation is hidden in the crosstalk and a quality of display image is disadvantageously more lowered, Such problem of crosstalk is described in detail.

FIGS. 35 to 37 show a typical example of crosstalk generation in a monochrome STN type liquid crystal display device in displaying at a normally black mode. "Normally black mode" means a mode that a black display is provided when voltage is not applied to liquid crystal and white display is provided when voltage is applied to the liquid crystal.

In FIG. 35, a crosstalk is generated on upper and lower in a display pattern 3501 in a horizontal line stripe shape. A region (a) 3503 is darker than a peripheral region (b) 3505. This designates a dark crosstalk.

A crosstalk in the vertical direction is generated also in a vertical line shaped display pattern 3507 in FIG. 36. A region (c) 3509 is brighter than a peripheral region (d) 3511. This designates a bright crosstalk.

In a display pattern 3515 in a block shape in FIG. 37, a dark crosstalk observed as a dark region (h) and region (f) on upper and lower portions of the display pattern 3513 in a block shape in FIG. 37 is generated, and in addition, crosstalks corresponding to two scanning lines are generated in the horizontal direction as in a region (e) 3515 and region (g) 3517 along boundaries (respective edges on upper and lower) of upper and lower of the display pattern 3513, where the region (e) 3515 is a darker crosstalk than the peripheral region (f) 3519, the region (g) 3517 is a brighter crosstalk than the peripheral region (f) 3519.

These crosstalks are generated due to distortion of a driving voltage waveform applied to the liquid crystal display element (so called as "a liquid crystal display panel").

FIG. 38 shows a typical example of the general conventional liquid crystal display device. The liquid crystal display element 3801 is arranged for opposing a scanning electrode 3803 and a signal electrode 3805 each other, a liquid crystal 3807 is embraced therebetween. The scanning electrode 3803 is connected with a scanning driver circuit 3809, and the signal electrode 3805 is connected with a data driver circuit 3809. Generally, each pixel of the liquid crystal display element is equivalently expressed as a capacitor (static capacitor), thus the liquid crystal display element is considered by replacing it with an equivalent circuit in FIG. 38. Output impedances exist in both the data driver circuit 3809 for generating a data signal to apply to the signal electrode and to drive the liquid crystal display element and the scanning driver circuit 3811 for generating the scanning signal to apply to the scanning electrode, moreover impedances exist both in the scanning electrode 3803 and the signal electrode 3805 of the liquid crystal display element 3801, and in connection portions between the data driver circuit 3809 or scanning driver circuit 3811 and the scanning electrode 3803 or signal electrode 3805 respectively. These impedances are expressed as an electric resistance and, needless to say, as in an equivalent circuit, for example, a voltage waveform of the scanning electrode 3803 produces distortion by receiving induction from a data signal waveform of the signal electrode 3805, or dull waveform is generated due to a distributed constant circuit formed by the electric resistors and capacitors, which are described in detail referring to one example.

FIGS. 39(*a*) and 39(*b*) are an equivalent representations showing one scanning electrode partially extracted from the conventional XY simple-matrix type liquid crystal display device, A scanning electrode ($Y_n$) 3901 and a signal electrode ($X_n$) 3903 are arranged as intersected and opposed with each other, and a liquid crystal layer 3905 is held between the counter electrodes 3901 and 3903. An electrode resistance (R) 3907 in FIG. 39(*b*) is a total sum of electric resistances of entire drive circuit systems; namely, an internal output resistance (R') 3911 of the scanning electrode driver circuit 3909 connected to the scanning electrode 3901 and for applying voltage thereto; a connection resistance between the scanning electrode driver circuit 3909 and the scanning electrode 3901; and a electrode resistance which the scanning electrode 3901 itself has. $C_{LC}$ is a static capacitance of the liquid crystal layer 3905.

A power supply (V0) 3913 for generating voltage (scanning signal) applied to the scanning electrode 3901 is connected to the scanning electrode 3901, a power supply (V1) for generating voltage (data signal) applied to the signal electrode 3903 is connected to the signal electrode 3903 at a connecting point P1 through a switching means. A scanning signal V0 is named as 0 V for simplifying the explanation.

The liquid crystal display element is normally promoted of its deterioration when applied direct-current component voltage, thus it is driven by a square wave voltage similar to an alternating-current. For this reason, the data signal V1 is assumed to output voltage V1 with polarization inverted as centered on 0 V in FIG. 39(C). In consideration that such square waveform data signal V1 is applied to the signal electrode from the signal electrode driver 3915 side, a spike voltage distortion V2 due to a time constant $C_{LC}$•R is generated at a connecting point P2 across $C_{LC}$ formed by the liquid crystal layer 3905 and an electric resistance R of the driving circuit system. This distortion voltage V2 is shown by a waveform graph in FIG. 39(*d*). Thus generated distortion voltage V2 provides V2–V1 made from liquid crystal applying voltage VLC applied to the liquid crystal layer 3905 and the waveform being cut off by the amount corresponding to the spike voltage distortion V2 in FIG. 39(*e*). The liquid crystal applying voltage VLC applied to the liquid crystal layer 3905 is varied of its effective voltage due to the distortion of drive voltage waveform (voltage V2) generated in voltage at the scanning electrode side. Such variation of effective voltage is still varied with phase difference of the square wave applied to the signal electrode 3903. Depending on the display image there exist a pixel having voltage variation to be increased and a pixel having voltage variation to be decreased, these are seen as fluctuation of transmittance of light on display picture of the liquid crystal display element. This describes an irregularity on display called as a crosstalk.

The explanation in more detail is provided as undermentioned for crosstalk generation due to the driving voltage waveform distortion in the simple-matrix type liquid crystal display device as shown in FIGS. 35 to 37.

FIGS. 40(*a*) and 40(*b*) are views of the data signal waveform and the scanning signal waveform (non-selected period) applied to the liquid crystal layer corresponding to the region (a) and the region (b) in FIG. 35. A spike shaped distortion voltage in synchronization with the data signal waveform is generated on the scanning signal waveform of the non-selected period. This is because the scanning electrode receives induction from the data signal waveform through the static capacitance formed by the liquid crystal layer and to vary an potential of the scanning electrode. As a result, the liquid crystal applying voltage of the region (a) (that is, the waveform overlapped of the data signal waveform and the scanning signal waveform) is decreased by the voltage corresponding to the distortion as shown by oblique lines in FIG. 40(*a*). On the other hand, decrease of the liquid crystal applying voltage of the region (b) hardly arises substantially as shown by oblique lines in FIG. 40(*b*).

Therefore, the liquid crystal applying voltage (b) of the region (a) becomes smaller comparing to that of the region (b), thereby a dark crosstalk is generated.

FIGS. 41(*a*) and 41(*b*) show a data signal waveform and a scanning non-selected voltage waveform corresponding to the region (c) and (d) in FIG. 36 (or the region (h), region (f) in FIG. 37 respectively). FIG. G shows wavefrom variation before and after polarization inversion. Solid lines in FIG. 41 designate the display pattern 3507 of vertical line shape in FIG. 36, dotted lines designate the display pattern 3513 of block shape in FIG. 37. A distortion voltage is generated on the scanning signal waveform at the time of inverting a polarity, and differs depending on the display pattern, in FIG. 41. This arises because the polarity of the induction potential differs at every display pattern when a potential of the scanning electrode is varied by receiving induction from the data signal waveform through the static capacitance of liquid crystal at the time of inverting polarity.

Consequently, in vertical line shaped display pattern in FIG. 36, a liquid crystal applying voltage of the region (c) is increased by the amount corresponding to a distortion voltage shown in oblique line portion of FIG. 41(*a*). On the other hand, the liquid crystal applying voltage of the region (d) is decreased by the amount corresponding to the distortion voltage shown by the oblique line portion of FIG. 41(*b*). Accordingly, the liquid crystal applying voltage of the region (c) becomes larger compared to that of the region (d) thereby to generate a bright crosstalk at the region (c). In the block shaped display pattern, to the contrary, the liquid crystal applying voltage in the region (h) in FIG. 37 is decreased by the amount corresponding to the distortion voltage compared to that of the region (f), then the dark crosstalk is generated in the region (h).

FIGS. 42(*a*) and 42(*b*) are views of the data signal waveform and the scanning signal waveform corresponding to the region (e) and the region (f) in FIG. 37 respectively. A distortion occurs in the scanning selected voltage waveform in the region (e).

In FIG. 42(*a*), when a rise of the scanning selected voltage waveform (so called scanning pulse) and variation of the data signal (variation from potential V3 to potential V5 in FIG. 42) are synchronized with each other, the rise of the scanning pulse is induced from the signal electrode by the static capacitive coupling to vary the potential of the scanning electrode. That is to say, the scanning pulse is affected and made dull. A voltage of the scanning electrode when being affected induction shown in oblique line portion in FIG. 42(*e*) is made smaller compared to the voltage waveform of the scanning electrode when not affected of induction in FIG. 42(*b*), therefore the dark crosstalk is horizontally generated in the region (e) in FIG. 37. By the similar principle in the rise of the pulse, the scanning electrode is affected the same induction effect due to the variation of the data signal, then in total, the liquid crystal applying voltage corresponding to two scanning electrodes is affected variation. On the other hand, a rise of the scanning pulse in the region (g) in FIG. 37 becomes relatively steep because of receiving induction in reverse polarity (reverse direction) to the region (e). Then, the voltage of the scanning electrode of the region (g) becomes larger compared to the voltage of the scanning electrode of the region (f), this causes generation of the bright crosstalk in horizontal in the region (g).

To eliminate such drive waveform distortion, a basic countermeasure is first considered to reduce output resistance of the driver, resistance of the transparent electrode for the driving electrode, a connection resistance across the driver and the transparent electrode, and moreover an output resistance of the power supply circuit for supplying voltage to the driver. However, there actually exists limitation in reducing resistance of the transparent electrode forming the scanning electrode and the signal electrode or output resistance inside the driver circuit, it is difficult to effectively prevent these electric resistance itself. A transparent conductive film formed of tin oxide or ITO (indium tin oxide) is generally used for material of the driver electrode of the liquid crystal display element. This transparent conductive film has a relatively larger electric resistance, and its sheet resistance results in an extent from 10 to 15 Ω/□. When metallic material is used, a lower electric resistance in an extent from 0.1 to 0.2 Ω/□ is easily obtained compared to the relatively larger electric resistance such as ITO. A problem for reducing the electric resistance of the electrode formed of transparent conductive films is considered in that a generation of the distortion voltage inside the electrode is suppressed by reducing an appearance of electric resistance of the transparent electrode by providing the wire connection formed of metallic material in parallel at the lateral side of the scanning electrode or the signal electrode formed of the transparent conductive films.

However, this method produces a complicated construction inside the liquid crystal display element, it is extremely difficult on production technique to provide the still more fine metallic wiring connection in addition to more miniaturization required in the electrode, and disadvantageously a higher production cost is required.

It is considered that reduction of the driver IC output resistance is considerably effective to eliminate the drive waveform distortion.

But, development of the driver IC having a considerably lower output resistance is not easy, such IC therefore requires a particular construction such as a larger size of a transistor inside the IC for reducing the output resistance. This makes the external size of the IC large and prevents a practical use of the devices.

The other procedures such as various kinds of improvements for the drive processes are carried out for reducing the scanning signal waveform distortion.

A technique in deriving the drive method of the simple-matrix type liquid crystal display device has been disclosed, for example, in Japanese Patent Application Laid Open No.171718 in 1990, and this technique includes a method that one output of the scanning driver circuit is connected to a differential state pulse negation circuit, and the voltage waveform of an inversion polarity to the pulse of differential state detected by the differential state pulse negation circuit is synthesized with non-selected voltage for the scanning driver.

This method hardly reduce actually the voltage waveform distortion of the scanning electrode generated inside the liquid crystal display element (liquid crystal cell), although the waveform distortion of output of the scanning driver is reduced, because in this method the voltage taken by monitoring the voltage from one output of the scanning driver circuit is fed back to the scanning driver circuit.

Even when the voltage fed back to the scanning driver circuit is amplified to a level in an extent of distortion voltage to be a cause of the crosstalk, because the voltage to be fed back (feedback voltage) is obtained only from one output of the scanning driver circuit, largeness of the voltage distortion of the output other than such obtained one output is not reflected, thus it is actually not possible to carry out sufficiently effective reduction of the voltage distortion for all the scanning electrodes. The reason is that a largeness of the output voltage distortion exhibits different sizes at every scanning electrode.

In this method, the actual effective reduction of the drive waveform distortion of the scanning electrode of the liquid crystal display element is extremely difficult because the scanning electrode itself of the liquid crystal display element is not included in the feedback loop (feedback system). It is desirous for reducing the crosstalk that an effect of the distortion reduction is obtained as uniformly as possible over the entire liquid crystal display element, needless to say, in addition to reduction of the drive waveform distortion of the scanning electrode of the liquid crystal display element.

Another method of reducing the scanning drive waveform distortion includes a method disclosed in SID, 1990 Digest, p.412 to p.415. This method of driving is that the control voltage (complimentary voltage) of a voltage level based on the ON or OFF dot number counted from the display data is generated, and applied to the scanning power supply section for supplying voltage to the scanning driver circuit to synthesize with the scanning non-selected voltage and to cancel voltage fluctuation due to the distortion voltage each other.

However, this method intends to cancel dull phenomenon or distortion of voltage of the scanning electrode each other using a fine voltage level previously set corresponding to the dot number of ON and OFF of the display data (image data). Thus, for example, in the device for varying contrast by changing the liquid crystal drive voltage or for performing a gradation representation, the largeness of the voltage distortion is varied with change of the liquid crystal drive voltage, an optimum correction becomes difficult because the optimum correction voltage value is shifted from a correction voltage previously set as a correction value at the initial time for canceling the voltage distortion and the like. This control system therefore requires addition of a readjustment circuit and the like for automatically resetting an optimum correction voltage at every time required. An incorporation of such circuit having a readjustment circuit and for setting fine voltage depending on the display data causes another disadvantage in considerably complicated construction of the liquid crystal drive circuit system. The same readjustment circuit is also desired for adjusting variation of a response characteristic due to aged change of the liquid crystal layer or variation of temperature condition and the like.

Another method for reducing the scanning drive waveform distortion is disclosed in Eurodisplay 1984, Digest p.15 to p.20. This method of driving is basically similar to the control system as immediately previously described, but a different point resides in the control voltage (complimentary voltage) which is taken out from a voltage of the signal electrode. A variation of the voltage applied on the signal electrode is detected by obtaining a mean value of voltages of all the signal electrodes. Such method is resultantly similar to the method of counting the number of ON dot or OFF dot.

This method is that a control voltage previously set based on the data signal which is a cause of varying the voltage of the scanning electrode is formed and this control voltage is applied to the scanning signal power supply to synthesize to the scanning electrode waveform. Thus, an optimum correction is not always performed for dull phenomenon or distortion itself of the voltage of the scanning electrode, rather the optimum correction is shifted due to change of the temperature condition or aged change and the like of the liquid crystal layer, the correction voltage (control voltage) is readjusted at every time required. The largeness of the voltage distortion is varied depending on variation of the liquid crystal driving voltage even in changing contrast by varying the liquid crystal driving voltage or in performing gradation representation, the optimum correction voltage is required to be reset at every time required. Additional readjustment circuits and the like are required. An incorporation of the circuit having such adjustment circuits and performing setting of the fine voltage based on the data signal disadvantageously produces a considerably complicated construction of the liquid crystal drive circuit system. The similar adjustment circuit is required for the aged change.

In another point of view of the driving method, an example of the method of driving for a simple-matrix type liquid crystal display device having a rapid response time includes the Active Addressing method, or the Multiple Line Selection Method disclosed in SID, in 1992, Digest, p.228 to p.231 and p.232 to p.235. In a voltage averaging method generally used, liquid crystal is applied a scanning signal of waveform formed of both a selected pulse of higher voltage in a very short time within one frame period and a non-selected voltage of a lower voltage of the period other than the selected pulse period. Contrast to this, in the previous method of driving is given of both a scanning waveform Fi (t) formed of an optional orthonormal set and a multi-valued signal waveform Gj (t), consequently the synthetic voltage waveform applied to the liquid crystal is distributed within a frame period. In case of using the liquid crystal display element having a higher response speed, the conventional general method of averaging voltages follows the selected pulse to become so called "frame response" state and to lower a contrast ratio. To the contrary, according to Active Addressing Method, such drawback is solved to obtain an image display of a higher contrast ratio.

However, the Active Addressing Method is to apply a waveform in accordance with the orthonormal set to the scanning signal waveform, and a result obtained by computing the resultant with the display data is converted into a voltage to apply to the signal electrode, therefore the same as previously described, potentials across the opposing driving electrodes each other are induced through the liquid crystal respectively by a mating side. That is, the scanning electrode is induced by the signal electrode drive waveform varied with reference to the display data, and a potential of the scanning electrode is distorted at every time of the data signal change. The signal electrode is also induced by the scanning signal waveform, and a potential of the signal electrode is distorted at every time of the scanning signal change.

Therefore, the liquid crystal display device using such method of driving generates more frequently the signal electrode drive waveform distortion compared to the general method of averaging voltages, rather the crosstalk more easily generates.

In the active-matrix type liquid crystal display device using a switching element such as TFT, a voltage distortion is generated by induction and the like of the counter electrodes each other as described above. The active-matrix type liquid crystal display element is essentially constructed of a scanning (gate) line connected to a TFT switching array, a Cs line for operating a complimentary accumulated capacitance (Cs) arranged for maintaining charges of a signal (source) line and liquid crystal, and an counter electrode opposing to a TFT switching array substrate and for applying voltage to the liquid crystal. These electrodes and wiring are replaced by a distributed constant circuit of the electric resistors and the capacitors in a manner of an equivalent circuit. When a liquid crystal drive voltage is applied to such circuit, distortion or dull phenomenon occur on the voltage wavefrom of the electrode. For example, on applying the data signal to a data line, the potentials of the counter electrodes are affected by induction through liquid crystal, similarly, the potentials of the scanning lines also affected by the variation, thus the crosstalk is generated on the display surface due to these variations of the potentials.

As hereinbefore described, in the conventional art there have not been solved the adverse effects where the drive voltage waveforms are affected by both the connection resistances across the driver IC's and the liquid crystal display elements and the electric resistances of electrodes of the liquid crystal display elements. An effort in various ways has been made for indirectly excluding these adverse effects, but any of the ways are difficult to solve the problem of the distortions, moreover the extremely complicated construction and adjustment of the liquid crystal driving circuit systems remain disadvantageously.

In the conventional art intending to eliminate the distortion voltages as above, it is difficult to prevent the distortion voltages that is generated in the driving electrodes such as the scanning electrodes by induction from the external of liquid crystal display elements. For example, in case of arranging a tablet on the liquid crystal display elements for detecting the position, the driving electrode of the liquid crystal display element is affected by induction of pulse voltage generated from the tablet, this case varies its potential, consequently dull phenomenon or distortion are generated on the driving voltages.

The problem existing in the conventional liquid crystal display devices resides in the irregularity of the display surface (crosstalk) due to variation of the liquid crystal applying voltage generated by voltage distortions caused from the induction that is arisen by static capacitance of the liquid crystal display elements and by a total sum of electric resistances such as the output resistance of driver IC, the connection resistance across the driver IC and the liquid crystal display element, and the electric resistances like the driving electrode resistance of the liquid crystal display element and the like.

In the conventional art further proposed for solving the problems described above, since a problem still remains because an accurate correction is not achieved, a device capable of readjustment of an optimum correction voltage is still required, accordingly the device comes complicated.

SUMMARY OF THE INVENTION

The invention is made for solving these problems. An object of the invention is to provide a liquid crystal display device capable of realizing a high grade of image display by a simple and inexpensive means of solving a drawback of display fluctuation or crosstalk on a display in the liquid crystal display device.

BRIEF DESCRIPTION OF THE DRAWINGS

FIGS. 39(*a*), 39(*b*), 39(*c*), 39(*d*) and 39(*e*) are typical views of one scanning electrode of the conventional liquid crystal display device;

DESCRIPTION OF THE PREFERRED EMBODIMENTS

EMBODIMENT 1

Figure 1:
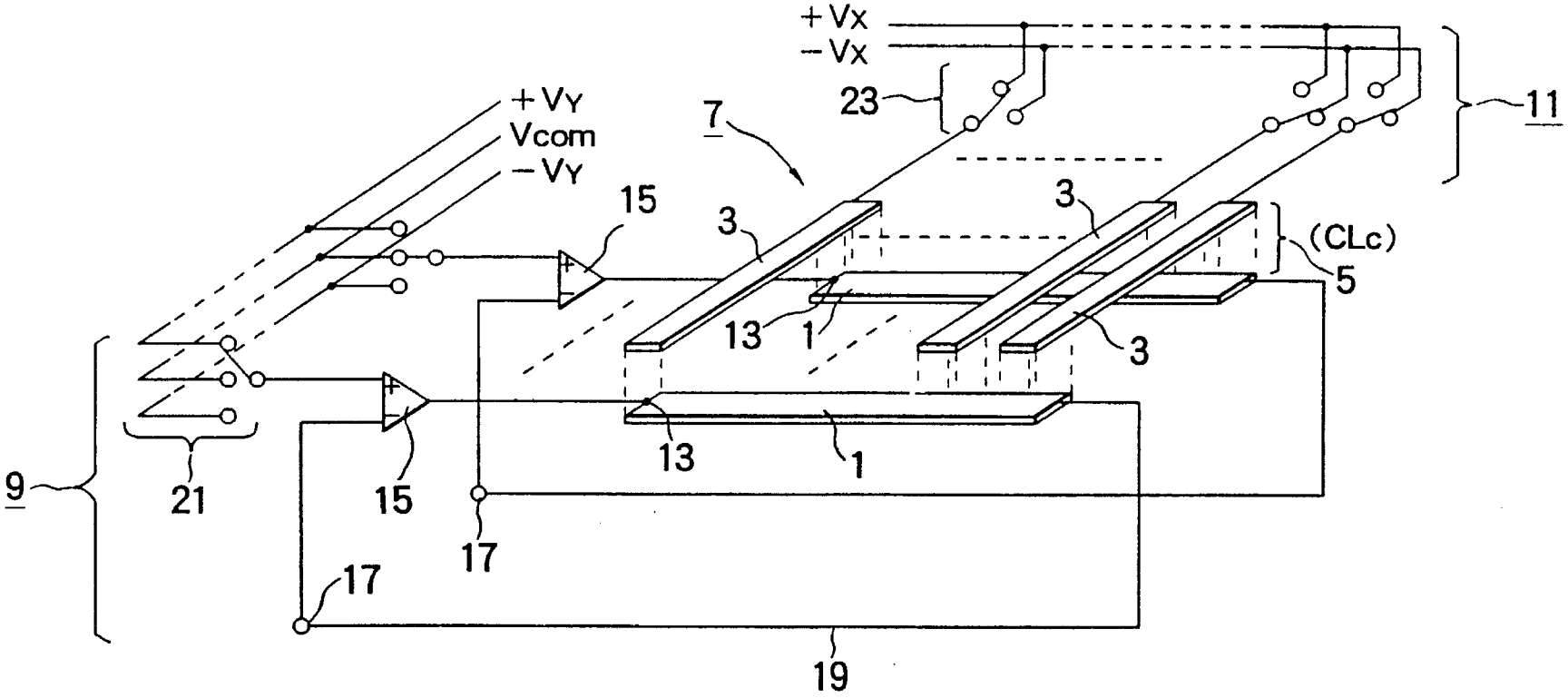
FIG. 1 is a view of a liquid crystal display device of an embodiment 1.

FIG. 1 is a typical view of a liquid crystal display device of an embodiment 1 according to the invention. The liquid crystal display device includes liquid crystal display elements 7, and a scanning driver circuit 9 and a data driver circuit 11 both for driving the liquid crystal display elements 7. The liquid crystal display elements 7 have liquid crystal layers (liquid crystal composition) 5 held in a gap between a scanning electrode 1 formed of transparent conductive films such as ITO and a signal electrode 3 both arranged opposing to each other in a matrix shape. The liquid crystal display elements 7 is constructed in that, at each scanning electrode 1, a voltage of the scanning electrode 1 other than voltage of a voltage input terminal 13 is directly detected and connected to an input terminal 17 of an operational amplifier 15 provided within a scanning driver circuit 9, and thus the voltage of the scanning electrode is controllably negative fed back. Then, the operational amplifier 15 functions that the detected voltage from the scanning electrode 1 is negative fed back to the scanning electrode 1.

In the liquid crystal display device of the embodiment 1, the negative feedback of the voltage of the scanning electrode 1 provides cancellation of variation of distortions and the like even when any of distortion or dull phenomenon are generated in the voltage of the scanning electrode 1 due to receiving induction or external disturbance from voltage of the signal electrode. Thus, the crosstalk on the display image is eliminated.

Figure 2A:
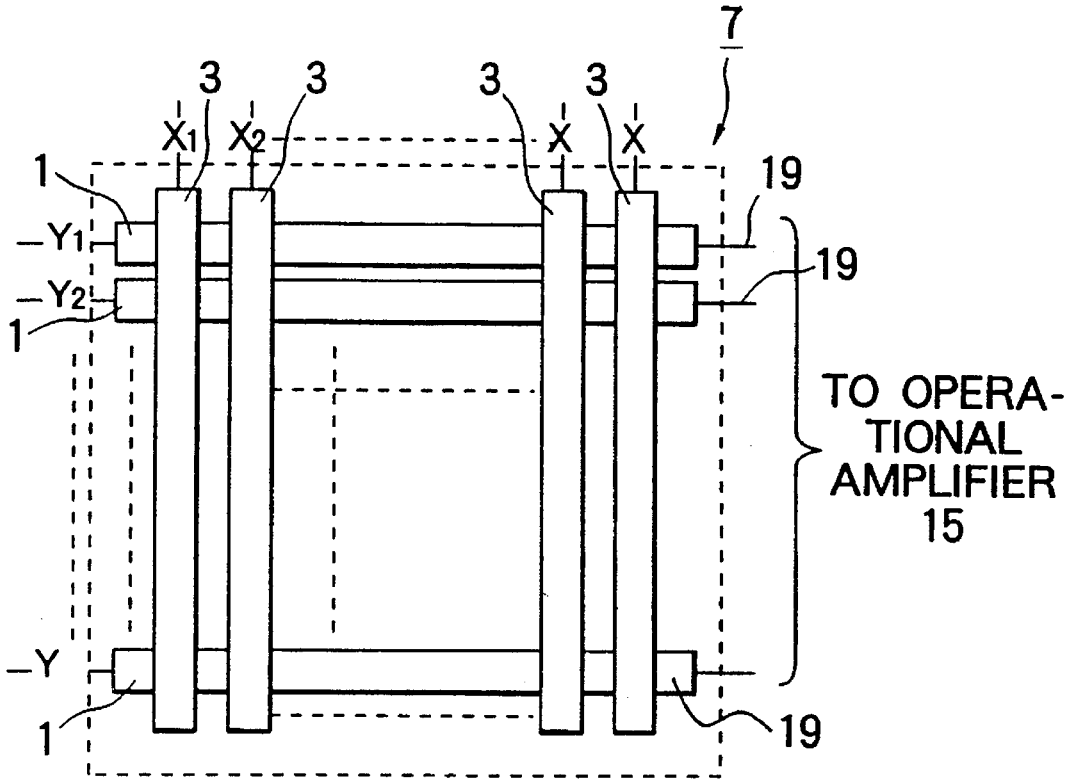
FIGS. 2(*a*) and 2(*b*) are views of a liquid crystal display element of the embodiment 1.
Figure 2B:
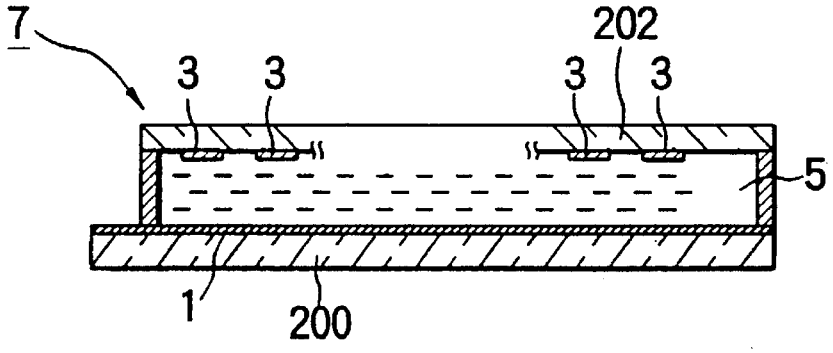

In construction and operation, the liquid crystal display element 7 uses a STN type liquid crystal display element in FIG. 2, having a display capacity (the number of pixels) of 128×64 dots with cell gap of approximately 7 μm, wherein a aligning film (not shown) formed of polyimide treated by a rubbing aligning treatment is provided and liquid crystal molecule is twisted in a cell of the liquid crystal display element 7 by 240°. The liquid crystal layer 5 uses ZLI-2293 made by Merk Corporation. The scanning electrode 1 and the signal electrode 3 are made up from material of transparent conductive film such as ITO. A wiring 19 is provided on the scanning electrode 1 for detecting a voltage other than that of the voltage input terminal of the scanning electrode 1. In FIG. 1, the wiring 19 is connected to an open end side opposite to the voltage input terminal of the scanning electrode 1.

An optical phase compensating cell (not shown) is adhered on the liquid crystal display element 7 for producing a monochrome display to obtain black when no voltage is applied and white when a voltage is applied.

Figure 3:
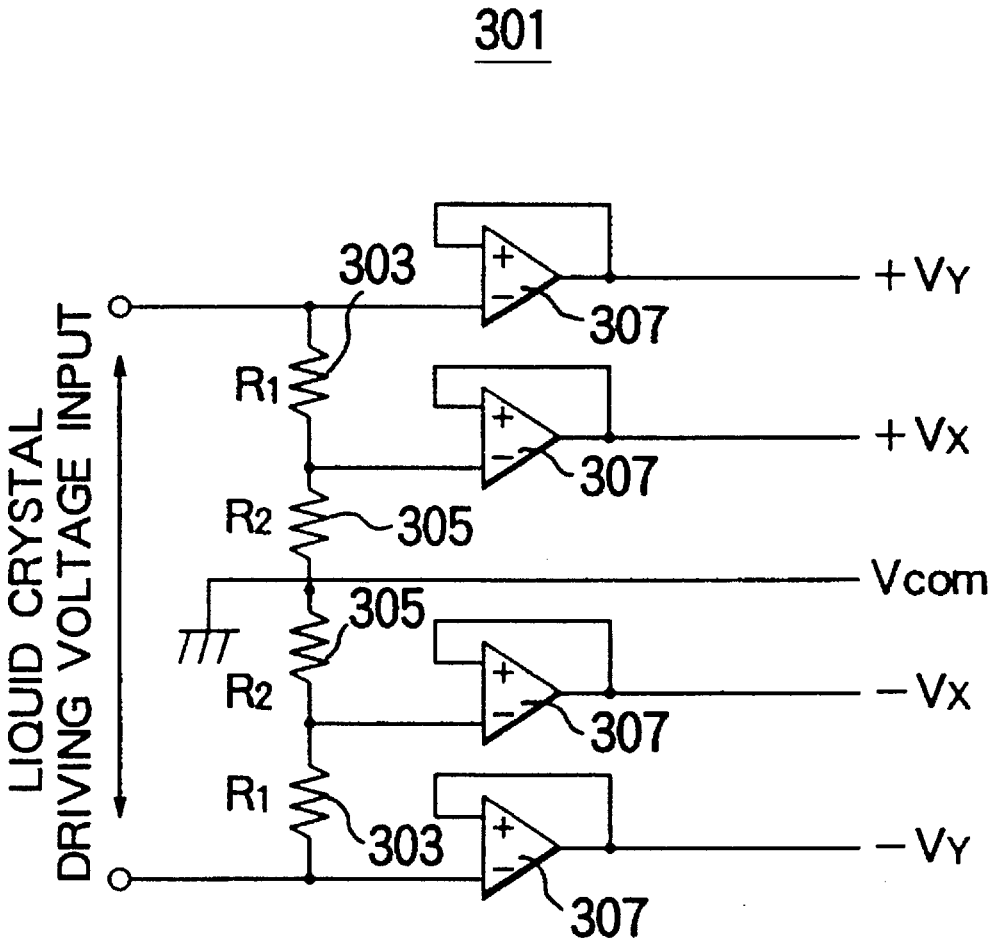
FIG. 3 is a view of a liquid crystal display device of the embodiment 1.

In FIG. 1, the scanning electrode 1 of the liquid crystal display element 7 is connected with the scanning driver circuit 9, and the signal electrode 3 is connected with the data driver circuit 11. The scanning driver circuit 9 and the data driver circuit 11 are connected with a power supply circuit 301 in FIG. 3, in which the power supply voltage is input from a liquid crystal driving voltage power supply (not shown), where various driving voltages (+Vy, +Vx, Vcom, −Vx, −Vy) required for driving the liquid crystal display element 7 are produced from such power supply voltage. In the power supply circuit 301 in FIG. 3, the input power supply voltage is divided into potentials corresponding to electric resistance values of an electric resistance (R1) 303 and an electric resistance (R2) 305 to produce the various driving voltages and to output through buffers 307 using the operational amplifiers. The values +Vy, Vcom, −Vy from among the various driving voltages are used for the voltages (scanning signals) applied to the scanning electrodes 1, and +Vx, −Vx are used for the voltages (data signals) applied to the signal electrodes 3.

In the scanning driver circuit 9, one potential is selected from +Vy, Vcom, −Vy by a switching circuit 21, where +Vy, −Vy are used as a potential of a scanning selected voltage (so called as a scanning pulse), and Vcom is used as a potential of a scanning non-selected voltage (voltage of the scanning electrode at the non-selected time). The scanning selected voltage (scanning pulse) is inverted of its polarity for forming into the alternate-current driving, then +Vy is polarity inverted to produce −Vy at the time of polarity inverting. A polarity inversion driving method is, as well known, a method for driving liquid crystal using voltage in a manner of the alternate-current for preventing deterioration of liquid crystal due to application of a direct-current voltage component. Thus, a scanning signal waveform for linearly sequentially scanning by a voltage averaging method is obtained as shown in FIG. 4(*a*).

Figure 4:
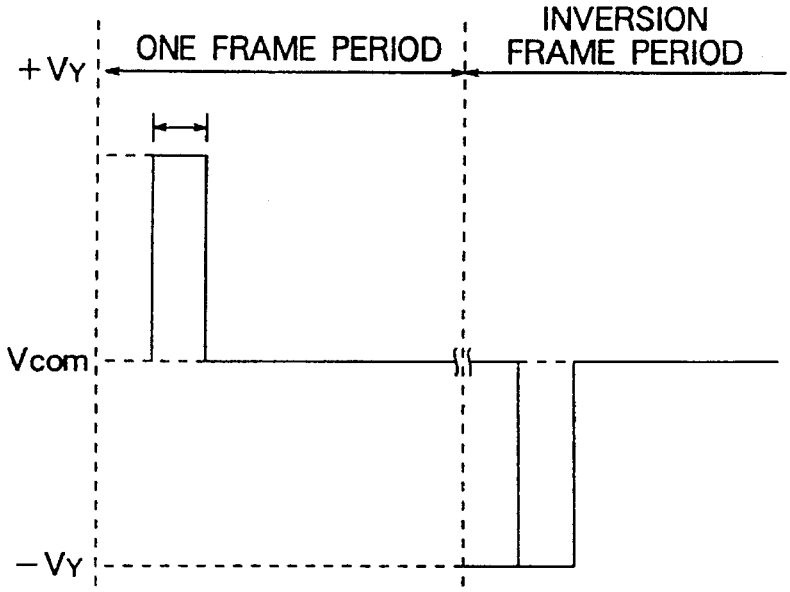
FIGS. 4(*a*), 4(*b*) and 4(*c*) are views of a driving waveform of a liquid crystal display device of the invention 1.
Figure 4:
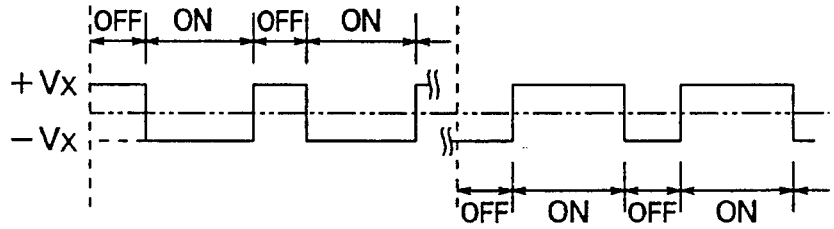
Figure 4:
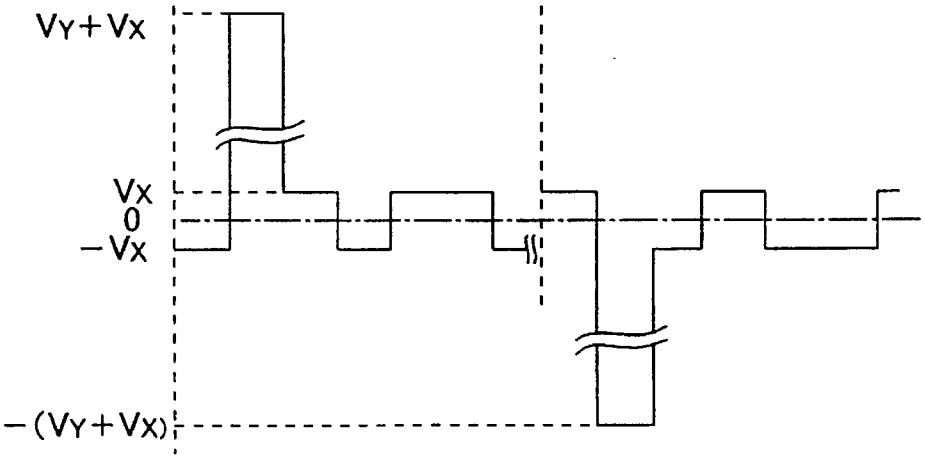

In the data driver circuit 11, one potential is selected from among +Vx, −Vx by the switching circuit 23, where the data signal waveform by the voltage averaging method is obtained in FIG. 4(*b*). The data signal is a voltage for determining a display of the liquid crystal display device, and when an ON display is performed, a voltage of the selected potential is output for exceeding an operational threshold voltage of the liquid crystal by overlapping with the scanning pulse, and when an OFF display is performed, a voltage of the non-selected potential is output for preventing from exceeding an operational threshold voltage of the liquid crystal by overlapping with the scanning pulse. In one frame period in FIG. 4, potential −Vx is the selected potential, potential +Vx is the non-selected potential. Since the polarity inversion is provided for driving in a manner of forming alternate-current, then on polarity inversion, potential −Vx becomes the non-selected potential, and potential +Vx becomes the selected potential.

When the driving voltage is applied to both the scanning electrode 1 and the signal electrode 3 and those are overlapped each other, then the liquid crystal applying voltage waveform obtained by applying to the liquid crystal layer 5 (liquid crystal cell) is, for example, polarity inverted at every frame period basis in FIG. 4(*c*) to become a voltage waveform in which an amplitude of the liquid crystal applying voltage varies depending on display contents (ON, OFF).

The operational amplifier 15, in which the distortion component and dull component of the scanning electrode 1 are detected to be negative fed back to the scanning electrode 1 and to eliminate such voltage distortion and dull phenomenon of the scanning electrode 1, is arranged in the scanning driver circuit 9. The input terminal 17 of the operational amplifier 15 is connected to each of a plurality of linearly arranged scanning electrodes 1 arranged in plural rows at one-to-one connection basis by the wiring 19, and a voltage variation (for example, a spike shaped distortion voltage etc.) produced in the voltage of the scanning electrode 1 by detecting each voltage of the connected scanning electrodes 1, is inverted and fed back to the scanning electrode 1 (that is, a negative feedback to the scanning electrode 1).

Even when the liquid crystal display device is formed so as to incorporate the scanning electrode 1 into a negative feedback loop using the operational amplifier 15 and a distortion voltage is induced in a voltage of the scanning electrode 1, then induced distortion component is detected from the scanning electrode 1, to synthesize it with an output of the scanning driver circuit 9, to be fed back to the scanning electrode 1, and to cancel the distortion voltage. Thereby, the crosstalk of the display image is eliminated.

The liquid crystal display device of the embodiment 1 is driven to display the image, and its display quality is visually inspected. A liquid crystal driving voltage used for driving the liquid crystal display device has a waveform in FIG. 4 that is polarity inverted at every 13 line basis with a duty ratio of 1/64, a bias ratio of 1/10, and a frame frequency of 80 Hz.

In inspection, after an entire display is made white. a black and white horizontal strip pattern is displayed in a region of vertical 50 dots×horizontal 10 dots adjacent to a display center, continuously the number of dots at horizontal of the region is gradually increased up to 100 dots, then in any of cases a uniform display without crosstalk is maintained. The Chinese characters and alphabet are continuously displayed, then generation of the distortion voltage in the scanning electrode 1 is suppressed to maintain the uniform display without crosstalk.

COMPARISON EXAMPLE TO EMBODIMENT 1

The conventional construction of the liquid crystal display device, in which the wiring 19 for detecting the scanning electrode voltage from the scanning electrode 1 and the operational amplifier 15 inside the scanning driver circuit 9 are removed from the liquid crystal display device of the embodiment 1, has been driven under the same driving condition of the embodiment 1 to display the image.

First, an entire display is made white. Thereafter a black and white horizontal strip pattern is displayed in a region of vertical 50 dots×horizontal 10 dots adjacent to a display center, continuously the number of dots at horizontal of the region is gradually increased up to 100 dots. When the black and white horizontal strip pattern is displayed in the region of vertical 50 dots×horizontal 10 dots, a crosstalk darker than its periphery is generated on its vertical direction. The horizontal dot number of the display region is gradually increased, the crosstalk in vertical direction has been more remarkably generated. In addition, a new crosstalk is generated in horizontal direction of the horizontal strip pattern display, its display quality has been considerably deteriorated. When the Chinese characters and alphabet are continuously displayed, then the remarkable crosstalk chained to vertical and horizontal directions is generated to produce a conspicuous irregularity and to exceedingly lower the display quality.

EMBODIMENT 2

Figure 5:
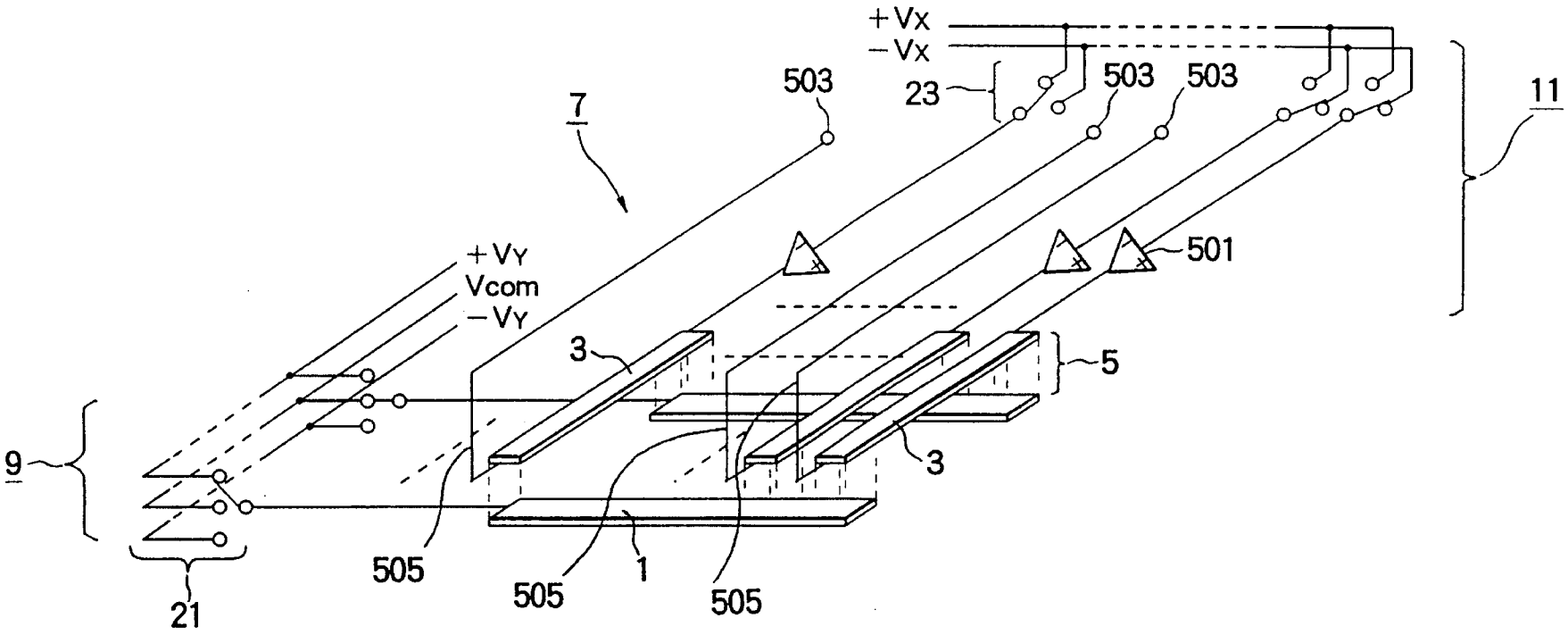
FIG. 5 a view of a liquid crystal display device of an embodiment 2.

FIG. 5 is a typical view of a liquid crystal display device of an embodiment 2, where the same numerals as in FIGS. 1 to 4 are given to the same parts as those described in the embodiment 1.

A liquid crystal display device of this embodiment 2 is characterized in that the negative feedback loop of the embodiment 1 is applied to the signal electrode 3, and the negative feedback controllably cancels a voltage variation such as distortion voltage generated in a voltage of the signal electrode 3 induced by the scanning selected voltage (scanning pulse).

An operational amplifier 501 arranged inside the data driver circuit 11 functions that the voltage distortion component and dull component of the signal electrode 3 are detected to be negative fed back to the signal electrode 3 for eliminating the voltage distortion and dull phenomenon of the signal electrode 3. The input terminal 503 of the operational amplifier 501 is connected to each of a plurality of signal electrodes 3 arranged in plural rows at one-to-one connection basis by the wiring 505. In this operational amplifier 501, a voltage variation (for example, a signal delay and the like) produced in the signal electrode voltage by detecting each voltage of the connected signal electrodes 3, is inverted and fed back to the signal electrode 3 (that is, a negative feedback to the signal electrode 3).

Even when the liquid crystal display device is formed so as to incorporate the signal electrode 3 into a negative feedback loop using the operational amplifier 501 and a distortion voltage is induced in a voltage of the signal electrode 3, then induced distortion component of the signal electrode 3 is detected, to synthesize it with an output of the data driver circuit 11, to be negative fed back to the signal electrode 3, and to cancel the distortion voltage component of the signal electrode 3. Thereby, the crosstalk of the display image is eliminated.

The liquid crystal display device of the embodiment 2 is driven to display the image, and its display quality is visually inspected. A liquid crystal driving voltage for driving the liquid crystal display device has a waveform in FIG. 4 that is polarity inverted at every 13 line basis with a duty ratio of 1/128, a bias ratio of 1/10, and a frame frequency of 80 Hz.

In inspection, after an entire display is made white. a black and white horizontal strip pattern is displayed in a region of vertical 100 dots×horizontal 10 dots adjacent to a display center, continuously the dot number at horizontal of the region is gradually increased up to 50 dots, then in any of cases a uniform display without crosstalk is maintained. The Chinese characters and alphabet are continuously displayed, then generation of the distortion voltage in the scanning electrode 1 is suppressed to maintain the uniform display without crosstalk.

COMPARISON EXAMPLE TO EMBODIMENT 2

The conventional construction of the liquid crystal display device, in which the wiring 505 for detecting the voltage from the signal electrode 3 and the operational amplifier 501 inside the data driver circuit 11 are removed from the liquid crystal display device of the embodiment 2, has been driven under the same driving condition as the embodiment 2 to display the image.

First, an entire display is made white. thereafter a black and white horizontal strip pattern is displayed in a region of vertical 100 dots×horizontal 10 dots adjacent to a display center, continuously the dot number at horizontal of the region is gradually increased up to 50 dots. When the black and white horizontal strip pattern is displayed in the region of vertical 100 dots×horizontal 10 dots, a crosstalk darker than its periphery is generated on its vertical direction. The horizontal dot number of the display region is gradually increased, the crosstalk in vertical direction has been more remarkably generated. When the Chinese characters and alphabet are continuously displayed, then the remarkable crosstalk chained to vertical directions is generated to produce a conspicuous irregularity and to lower the display quality considerably.

EMBODIMENT 3

A liquid crystal display device of an embodiment 3, in an active-matrix type liquid crystal display device using switching elements such as TFT (Thin Film Transistor) elements, is characterized in that a voltage distortion generated in an counter electrode is canceled by a negative feedback control and generation of a crosstalk is suppressed.

Figure 6:
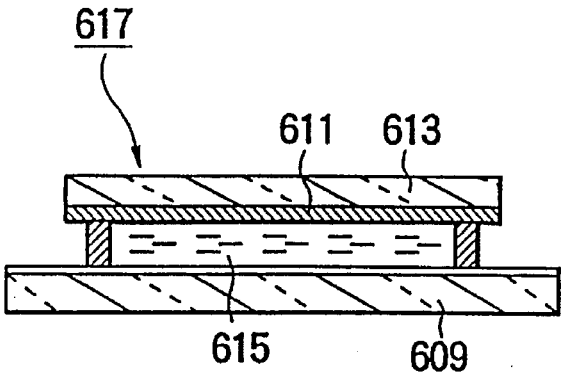
FIGS. 6(*a*) and 6(*b*) are views of a liquid crystal display device of an embodiment 3.
Figure 6:
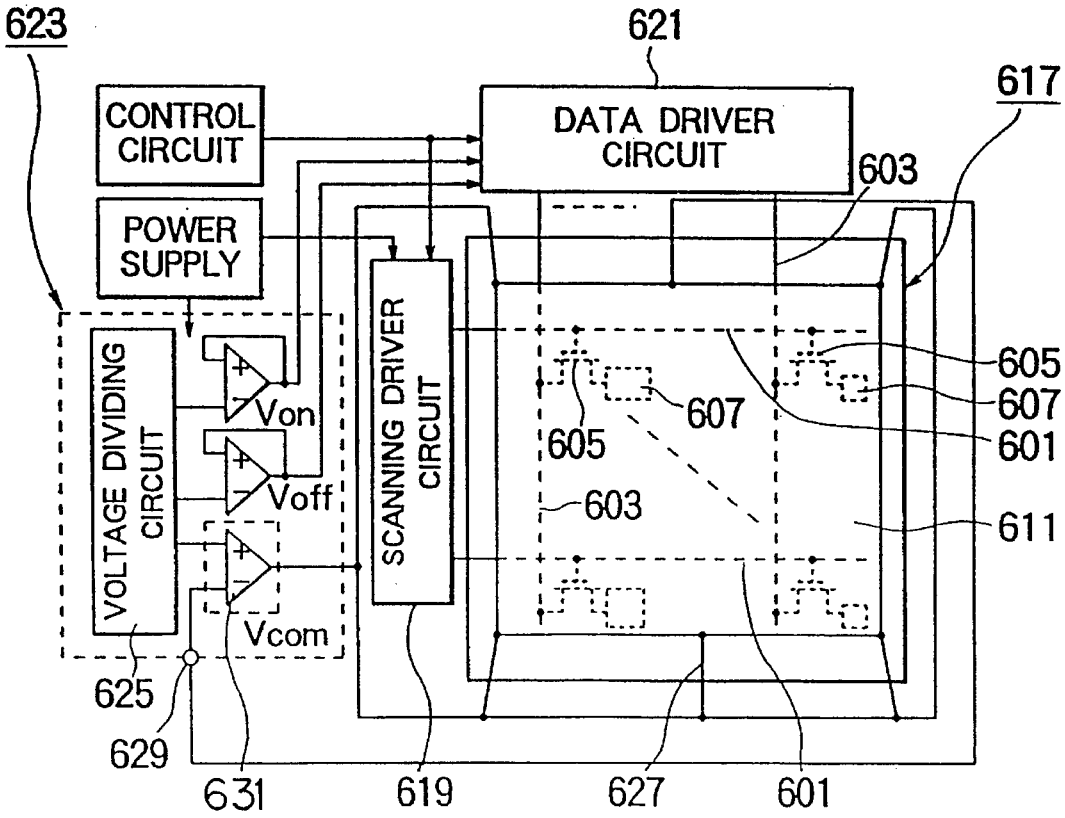

FIG. 6 is a typical view of a liquid crystal display device of an embodiment 3. Scanning lines 601 arranged in plural rows and data lines 603 arranged in plural rows are disposed orthogonally each other in a matrix shape. A TFT 605 is arranged at every crossing position of the scanning lines 601 and the data lines 603. The TFT 605 is connected of its gate with the scanning line 601, of its source with the data line 603, and of its drain with a pixel electrode 607 respectively. These portions are formed on the TFT array substrate 609 side. A main body of a liquid crystal display element 617 in FIG. 6(*a*) is constituted of both an opposing substrate 613 formed thereon with an counter electrode 611 made of a transparent conductive film arranged opposing to the TFT array substrate 609 and a liquid crystal layer 615 held in a gap between the TFT array substrate 609 and the opposing substrate 613. In FIG. 6(*b*) there are provided a scanning driver circuit 619, a data driver circuit 621, and a driving voltage supply circuit 623, those of which are formed of separate bodies of IC's in this embodiment 3. However, those may preferably be made up into one body of IC.

The active-matrix type liquid crystal display element is driven by holding charges in a predetermined period at a liquid crystal capacitance of $C_{LC}$ in accordance with a driving principle, then in general, an auxiliary capacitance CS for assisting the liquid crystal capacitance $C_{LC}$ and an auxiliary electrode for wiring them are provided. But in FIG. 6, for simplifying explanation there is omitted the auxiliary capacitance and the auxiliary electrode each having a slight relationship directly with the essentials of the invention. The active-matrix type liquid crystal display element using the TN type liquid crystal is used for the liquid crystal display element 617, which, as shown by partially omitted sectional view in FIG. 6(*a*), has a construction that it holds the liquid crystal layer 615 sealed between the TFT array substrate 609 and the opposing substrate 613 arranged opposing thereto. The TFT array substrate 609 is formed thereon with 480 scanning lines 601 and 640 data lines 603. The opposing substrate 613 arranged on its entire surface with the counter electrode 611 formed of the transparent conductive film, is arranged opposing to and coupled with the TFT array substrate 609. The scanning driver circuit 619 and the data driver circuit 621 are connected to the scanning lines 601 and the data lines 603 on the TFT array substrate 609 respectively. In the scanning driver circuit 619, the scanning selected voltage (scanning pulse) of a potential equal to or more than an operation threshold value for forming the conducting between a source and a drain of the TFT 605, is applied to the scanning lines 601 sequentially in the order of the lines. The data driver circuit 621 receives ON-voltage Von and OFF-voltage Voff supplied from the driving voltage supply circuit 623 to selectively output the ON-voltage Von or OFF-voltage Voff to the respective data lines 603 in accordance with display data to be input. The opposing substrate 611 is connected with the driving voltage supply circuit 623 and applied the counter electrode voltage Vcom. Actually, the power supply voltage is divided by a voltage dividing circuit 625 provided inside the driving voltage supply circuit 623 to produce potentials of Von, Voff, and Vcom respectively. Since liquid crystal is promoted its deterioration by being applied direct-current voltage and generally required to be driven by alternate-current voltage, then potentials Von, Voff and Vcom are polarity inverted periodically.

In FIG. 6 there is used an operational amplifier 631 in which the voltage distortion component and dull component of the counter electrode 611 are detected to be negative fed back to the counter electrode 611 through wiring 627 and an input 629 provided on the driving voltage supply circuit 623 connected thereto for eliminating the distortion and dull phenomenon of the voltage of the counter electrode 611. The operational amplifier 631 for performing the negative feedback control is connected to the counter electrode 611 and inverts a voltage variation (that is, for example, the spike shaped distortion voltage and the like) generated in the voltage of the counter electrode 611 to negative feed back it to the counter electrode 611. The operational amplifier 631 in this embodiment 3 is simultaneously used as a buffer for applying the counter electrode voltage Vcom to the counter electrode 611.

Even when the liquid crystal display device is formed so as to incorporate the counter electrode 611 into a negative feedback loop formed of the operational amplifier 631 and a distortion voltage is induced in a voltage of the counter electrode 611, then induced distortion component is detected, to synthesize it with a voltage of the counter electrode 611 at the operational amplifier 631, to be negative fed back to the counter electrode 611, and then to cancel the distortion voltage of the counter electrode 611. Thereby, the crosstalk of the display image is eliminated.

Actually, the liquid crystal display device described above is driven to display using a H line inversion driving system for inverting and driving a polarity of the data signal waveform at every scanning selected period basis, a V line inversion driving system capable of inverting a polarity of the data signal waveform at every data line basis and inverting and driving it at every frame basis, and further a H common inversion driving system for inverting and driving the counter electrode voltage at every scanning basis. As a result of these, by any of those driving systems the distortion is effectively removed from the counter electrode voltage and a satisfactory display image has been realized without crosstalk.

In this embodiment 3, the wiring 627 detecting the counter electrode voltage is positioned substantially at a center of the counter electrode. However in the invention, such position is not limited to the center thereof, therefore, even when it is provided on an end of the counter electrode 611, the distortion of the counter electrode voltage is similarly effectively canceled by a negative feedback control.

COMPARISON EXAMPLE TO EMBODIMENT 3

The wiring 627 connected to the counter electrode 611 for detecting the counter electrode voltage is removed from the liquid crystal display device in the embodiment 3. The negative feedback control operation of the operational amplifier 631 is allowed to stop and used as an ordinary voltage follower, and to produce the active-matrix type liquid crystal display device having the conventional construction using a voltage follower formed of the conventional operational amplifier, which has been driven to display the image under the driving condition as in the embodiment 3.

As a result, a distortion voltage has been generated in the counter electrode to generate a crosstalk chained to horizontal direction, to produce a conspicuous irregularity of the display, and to considerably deteriorate a display quality. In particular, in case of being driven by the H line inversion driving system and the H common inversion driving system both capable of varying a polarity of the data signal at every scanning selected period basis, a large distortion voltage is generated in the counter electrode to considerably produce the crosstalk.

EMBODIMENT 4

Figure 7:
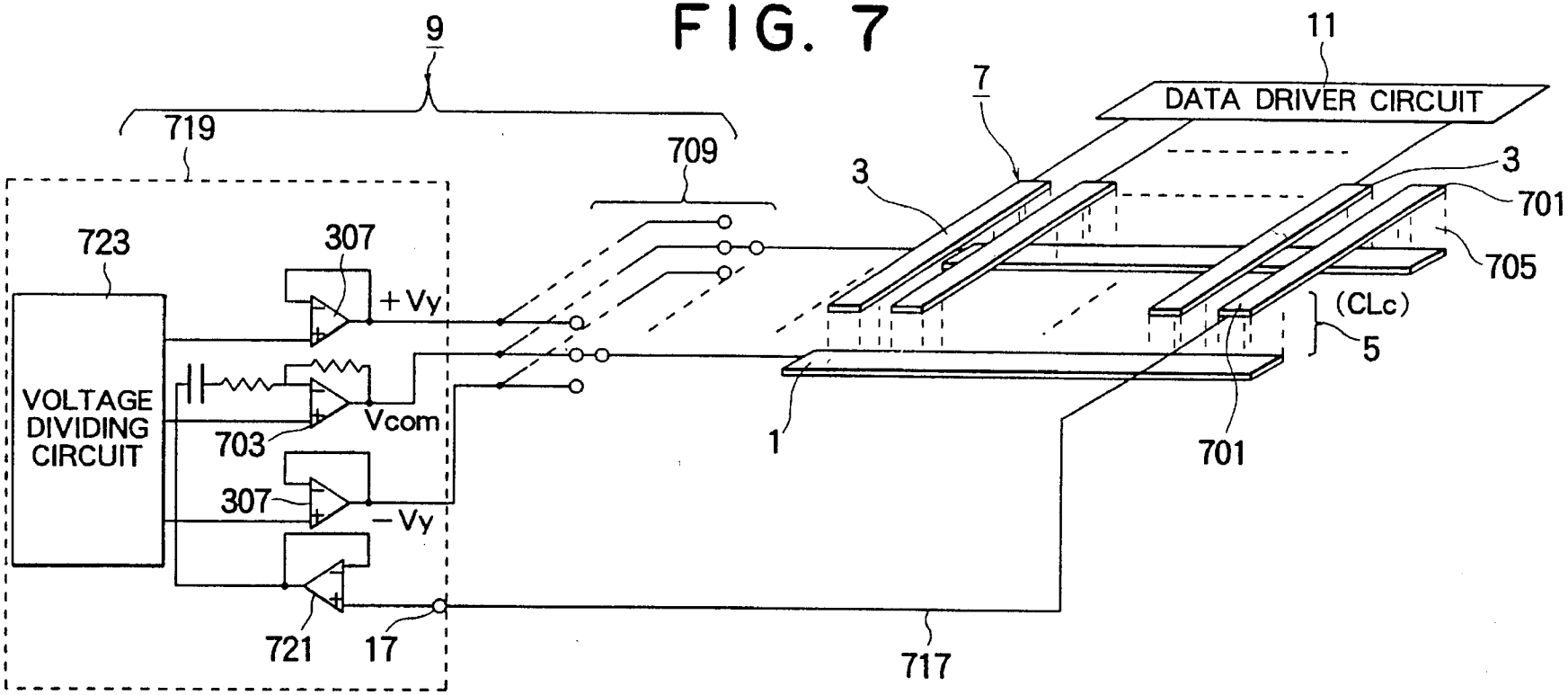
FIG. 7 is a view of a liquid crystal display device of an embodiment 4.
Figure 8:
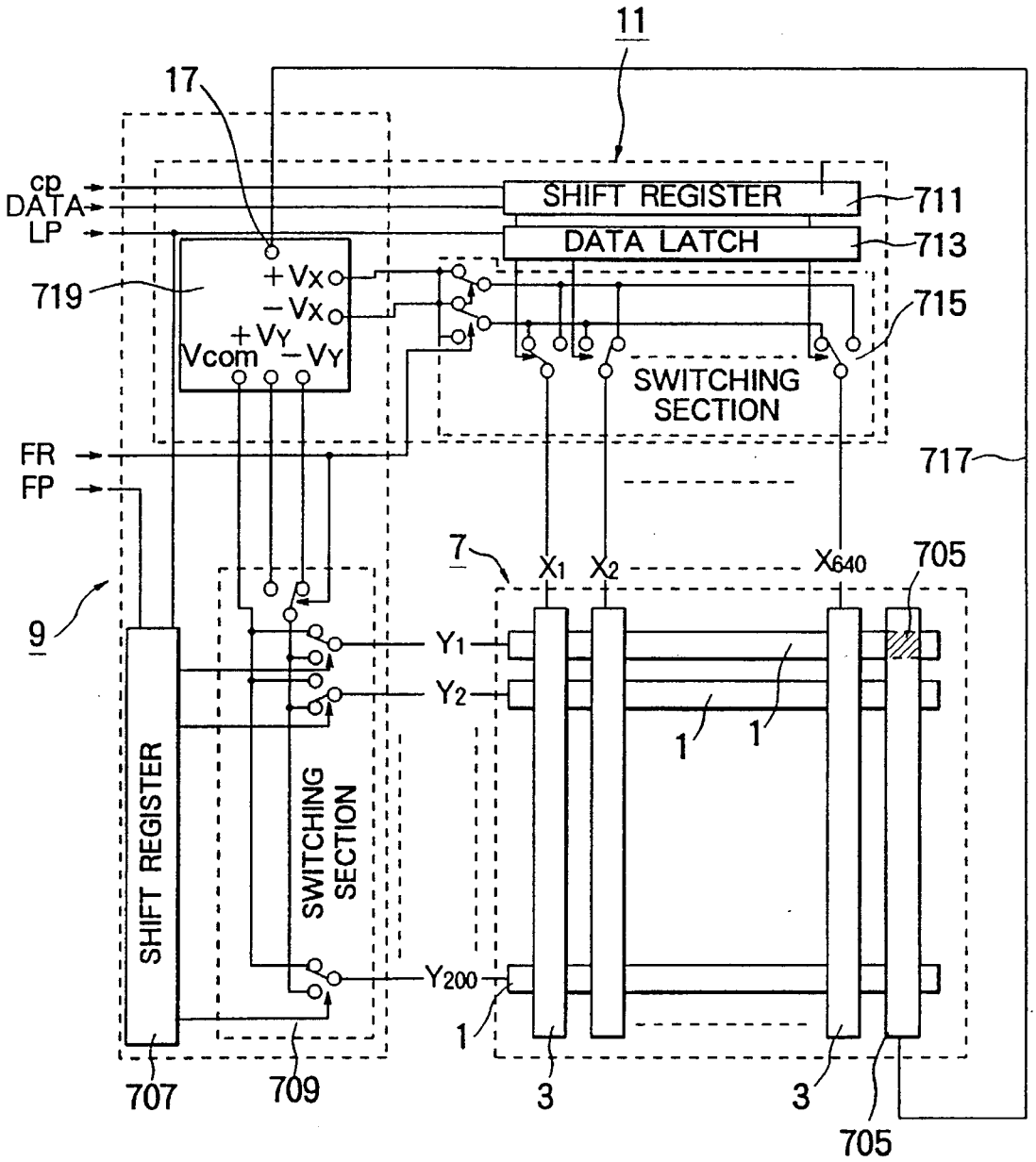
FIG. 8 is a view of a liquid crystal display device of the embodiment 4.

FIG. 7 is a typical view of a liquid crystal display device of an embodiment 4, and FIG. 8 is essentials of a circuit construction thereof, where the same numerals are given for the same parts as those of the embodiments 1 to 3.

The liquid crystal display device includes a liquid crystal display element 7, a scanning driver circuit 9 and a signal circuit 11 for driving the liquid crystal display element 7, a voltage detecting electrode 701 for detecting voltage of a scanning electrode 1 provided on the liquid crystal display element 7, and an operational amplifier 703 for negative feeding back to the scanning electrode 1 a voltage detected by the voltage detecting electrode 701.

In the embodiment 1, a voltage of the scanning electrode 1 is detected from the wiring 19 directly connected to the scanning electrode 1, and negative fed back it to the scanning electrode 1. However, in the embodiment 4, the invention is characterized in that the voltage detecting electrode 701 arranged opposing to all the scanning electrodes 1 is provided and the voltages are detected all together from all the scanning electrodes 1 by the voltage detecting electrode 701 to negative feed back its average to the scanning electrode 1.

Figure 9:
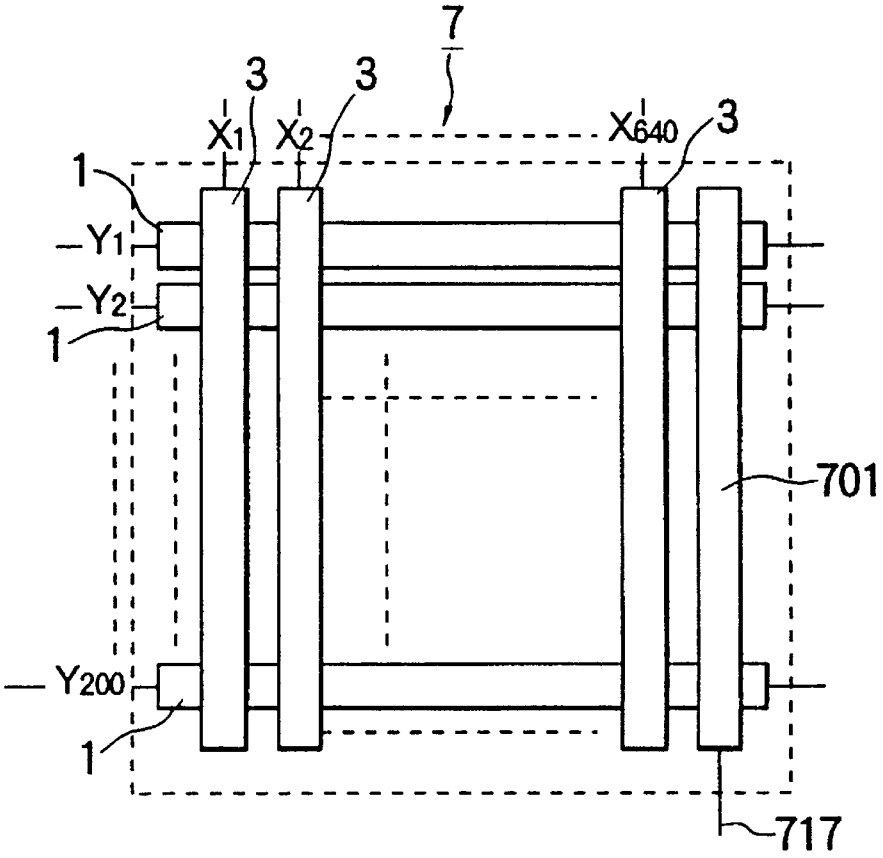
FIGS. 9(*a*) and 9(*b*) are views of a liquid crystal display device of the embodiment 4.
Figure 9:
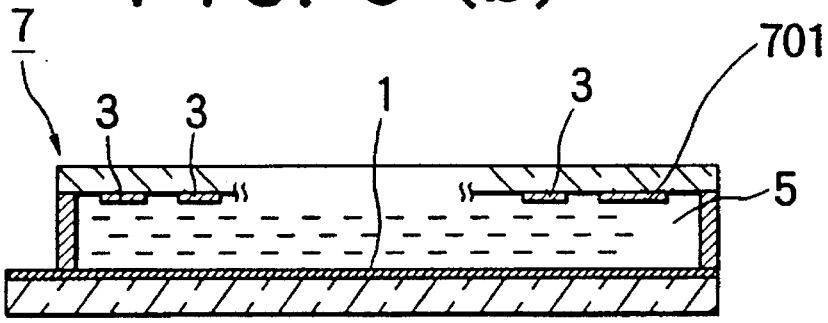

In FIG. 9, the liquid crystal display element 7 uses a STN type liquid crystal display element which holds a liquid crystal composition 5 in a gap between the scanning electrode 1 and the signal electrode 3 which are formed of a transparent conductive film such as ITO and arranged opposing to each other in a matrix shape. A size of display surface is a half of A4 size with a display capacity (the number of pixels) of 640×200 dots. This STN liquid crystal display element 7 has a cell gap of approximately 7 μm, wherein an aligning film (not shown) formed of polyimide treated by a rubbing aligning treatment is provided and liquid crystal molecules are twisted in a cell of the liquid crystal display element 7 by 240°. The liquid crystal layer 5 uses ZLI-2293 made by Merk Corporation. The scanning electrode 1 and the signal electrode 3 are made up from material of transparent conductive film of ITO.

To provide a monochrome display for the liquid crystal display device of the embodiment 4, an optical phase compensation cell is adhered on the liquid crystal display element, where are obtained black when voltage is not applied, and white when voltage is applied.

In the liquid crystal display element 7 described, a voltage detecting electrode 701 in almost the same electrode shape as the signal electrode 3 is provided as opposing to a tail end of each scanning electrode 1. A static capacitance 705 is formed wherein both the voltage detecting electrode 701 and a terminus portion of the scanning electrode 1 are used as electrodes and liquid crystal 5 as dielectric body is held between such electrodes.

As is apparent from FIG. 8, the terminus portion of scanning electrode 1 and the voltage detecting electrode 701 are made the electrodes, the liquid crystal 5 between such electrodes is made the dielectric body, and the static capacitance 705 is formed. Accordingly, the liquid crystal display element 7 in this embodiment 4 is obtained by providing an extremely small extent of change on a construction of the conventional liquid crystal display element. In practice, when the signal electrode 3 is patterning formed from the transparent conductive film such as ITO by photolithography, only by changing its pattern, the liquid crystal display element 7 is formed together with formation of the signal electrode 3.

Essentials of the scanning driver circuit 9 are constructed of a shift register 707 and a switching circuit 709. Essentials of data driver circuit 11 are constructed of a shift register 711, a data latch 713, and a switching circuit 715.

A voltage variation such as distortion voltage and the like generated in the scanning non-selected voltage of the scanning electrode 1 is detected together by capacitive coupling with the static capacitance 705 by the voltage detecting electrode 701. Wiring 717 is provided for transmitting a voltage detected at the voltage detecting electrode 701 to an input terminal 17 of the scanning driver circuit 9.

Figure 10:
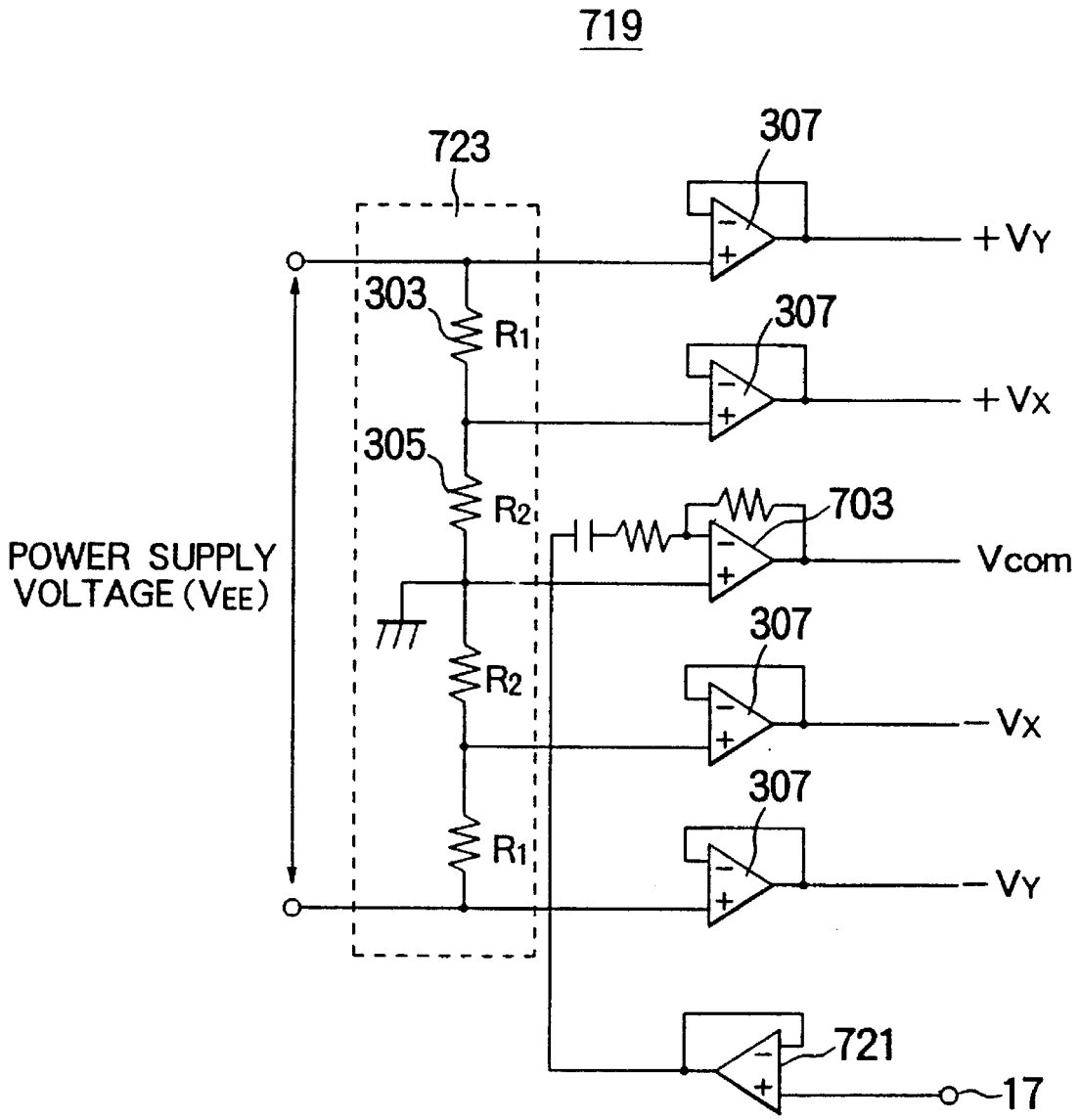
FIG. 10 is a view of a liquid crystal display device of the embodiment 4.

The detected voltage received at the input terminal 17 is input to the operational amplifier 703 for outputting a scanning non-selected voltage (Vcom) through a buffer 721 formed of an operational amplifier in a driving voltage supply circuit 719 in FIG. 10, and synthesized with the scanning non-selected voltage (Vcom) by the operational amplifier 703 to be negative fed back to the scanning electrode 1. The operational amplifier 703 is used as a buffer for outputting the scanning non-selected voltage (Vcom) and simultaneously used as an operational amplifier constituting a negative feedback loop.

Thus, the negative feedback is formed in which the voltage detected by the voltage detecting electrode 701 from the scanning electrode 1 is negative fed back to the scanning electrode 1 through the operational amplifier 703. The voltages of entire scanning electrodes 1 are detected together by the voltage detecting electrode, the detected voltages are negative fed back to the scanning electrodes 1, accordingly even when the scanning electrodes 1 disposed in a row generate a voltage change such as distortion and the like in the scanning electrode voltage by receiving induction or external disturbance from the signal electrode 3, then such voltage variation is canceled. In this way, generation of the crosstalk on the display image is prevented.

The driving voltage supply circuit 719 in FIG. 10 essentially includes, as in the embodiment 1, a voltage dividing circuit 723 using the electric resistances (R1) 393 and (R2) 305, the buffer 307 for outputting each potential produced from such voltage dividing circuit as each driving voltage (+Vx, +Vy, −Vx, −Vy, Vcom), and an operational amplifier 703 simultaneously used as a buffer.

The liquid crystal display device of the invention described above is allowed to display by a liquid crystal driving voltage having waveform in FIG. 4 at a duty ratio of 1/200, a bias ratio of 1/13, and a frame frequency 80 Hz, and its display quality is visually inspected.

After the entire display is made white, a white and black horizontal strip pattern is displayed on a region of vertical 100 dots×horizontal 10 dots adjacent to a center of the display, continuously the dot number of horizontal of the region is gradually increased up to 300 dots, as a result of these, any of cases has maintained a uniform display without crosstalk. When Chinese characters or alphabet are continuously employed, the uniform display without crosstalk has been maintained with suppression of generation of distortion voltage in the scanning electrode.

COMPARISON EXAMPLE TO EMBODIMENT 4

The wiring 717 of the voltage detecting electrode 701 has been removed from the liquid crystal display device of the embodiment 4. Thus, the liquid crystal display device, in which the same function as the conventional liquid crystal display device is made up by stopping function of the negative feedback loop, is allowed to display under the same condition as in the embodiment described above.

First, an entire display is made white. Thereafter, a black and white horizontal strip pattern is displayed in a region of vertical 100 dots×horizontal 10 dots adjacent to a display center, continuously the number of dots at horizontal of the region is gradually increased up to 300 dots. But, from around the time that the black and white horizontal strip pattern is displayed in the region of vertical 100 dots× horizontal 10 dots, a crosstalk darker than its periphery is generated on its vertical direction. The horizontal dot number of the display region is gradually increased, the crosstalk in vertical direction has been more remarkably generated, its display quality has been considerably deteriorated. When the Chinese characters and alphabet are continuously displayed, then the remarkable crosstalk chained to vertical and horizontal directions is generated to produce a conspicuous irregularity and to lower the display quality.

EMBODIMENT 5

Figure 11A:
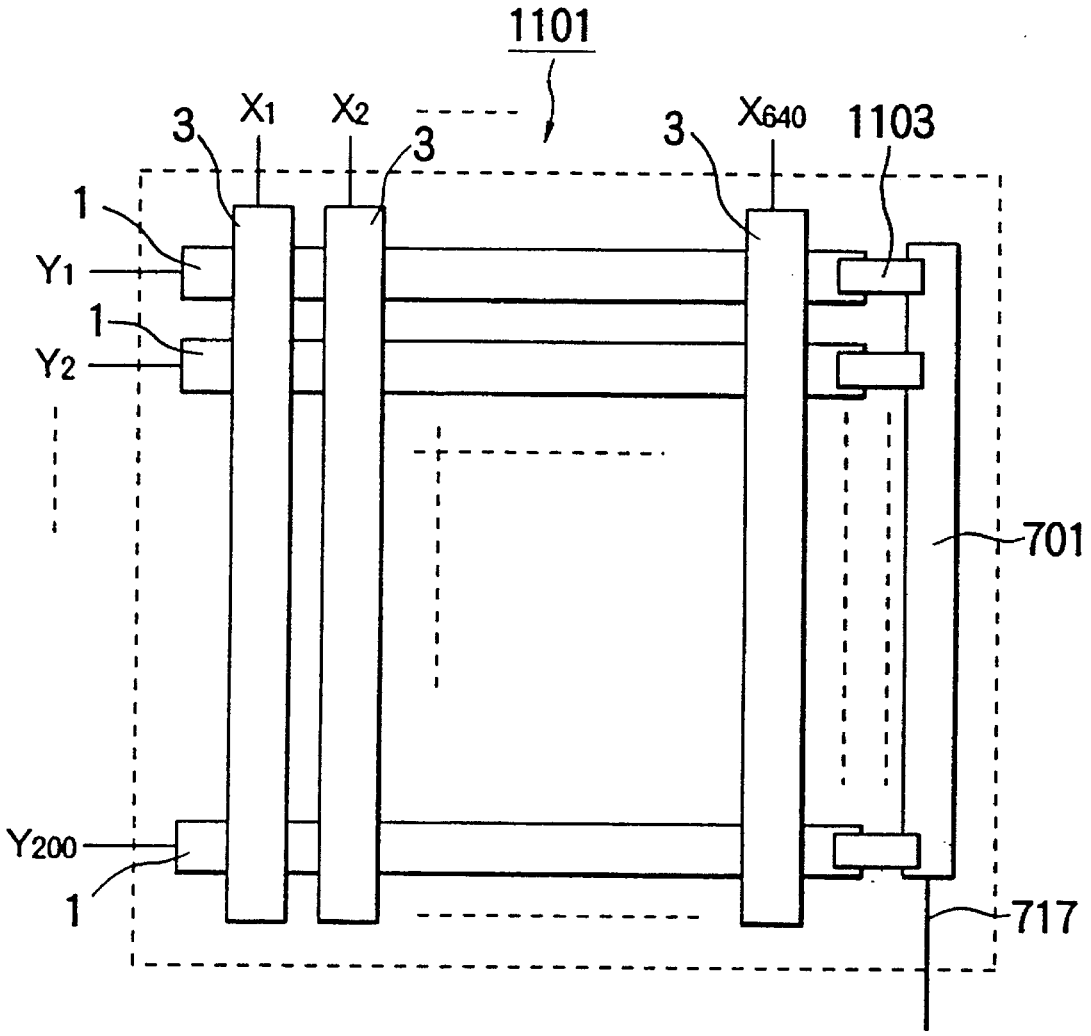
FIGS. 11(*a*) and 11(*b*) are views of a liquid crystal display device of an embodiment 5.
Figure 11B:
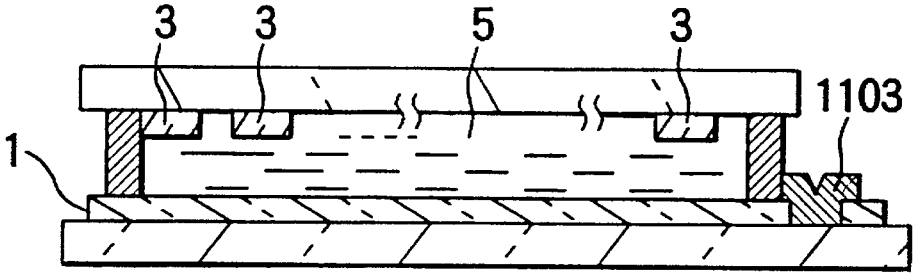

The liquid crystal display element 7 in the liquid crystal display device of the embodiment 4 is modified to a liquid crystal display element 1101 with a construction in FIG. 11 for this embodiment 5. The liquid crystal display element 1101 is characterized by including a resistor element 1103 having a specific electric resistance as a means for detecting voltage other than the voltage input terminal 13 of each scanning electrode 1 instead of, in the embodiment 4, the static capacitance 705 formed of the voltage detecting electrode 701, the scanning electrode 1, and the liquid crystal layer 5. The same numerals are given for the same parts as those in the embodiments 1 to 4.

Each scanning electrode 1 is connected with the resistor element 1103, through which a voltage of the scanning electrode 1 is detected by the voltage detecting electrode 701. Then, one end of the each resistor element 1103 is connected each of the scanning electrodes 1 respectively, and another end thereof is connected together (commonly) with the voltage detecting electrode 701.

The resistor element 1103 is formed as a film thickness resistor obtained by printing a resistance body between the respective scanning electrode 1 and the voltage detecting electrode 701. The resistor element 1103 is formed to have an electric resistance of 1 MΩ by suitably setting a film thickness, a width of the resistor body, and a length. The voltage detecting electrode 701 detects a voltage from each scanning electrode 1 through the resistor element 1103. The voltage detected by the voltage detecting electrode 701 is input, to the operational amplifier 703 for outputting the scanning non-selected voltage (Vcom), through both the wiring 717 connected with the voltage detecting electrode 701 and the input terminal 17 and the buffer 721 in FIG. 10, and then negative fed back to the scanning electrode 1 from the operational amplifier 703.

In the liquid crystal display device of this embodiment 5, here as in the embodiment 4, the voltage of all the scanning electrodes 1 is detected together through the voltage detecting electrode, and thus detected voltage provides the negative feedback control to the scanning electrode, accordingly even when the voltage of the scanning electrode 1 arranged in a row produces voltage variation such as distortion and the like by receiving induction or external disturbance from the signal electrode 3, then the voltage variation such as distortion and the like are canceled. In this way, the voltage variation such as distortion voltage and the like of the scanning electrode 1 is eliminated, and as a result, the crosstalk of the display image is stopped.

The liquid crystal display device described above is driven to display by the liquid crystal driving voltage of the waveform with polarity inverted with respect to the scanning pulse and the data signal in FIG. 4 under the driving condition of a duty ratio of 1/200, a bias ratio of 1/13, and a frame frequency 80 Hz, and its display quality is visually inspected.

After the entire display is made white, then white and black horizontal strip patterns is displayed on a region of vertical 100 dots×horizontal 10 dots adjacent to a center of the display, continuously the dot number of horizontal of the region is gradually increased up to 300 dots, as a result of these, any of cases has maintained a uniform display without crosstalk. When Chinese characters or alphabet are continuously displayed, the uniform display without crosstalk has been maintained with suppression of generation of distortion voltage in the scanning electrode.

EMBODIMENT 6

Figure 12:
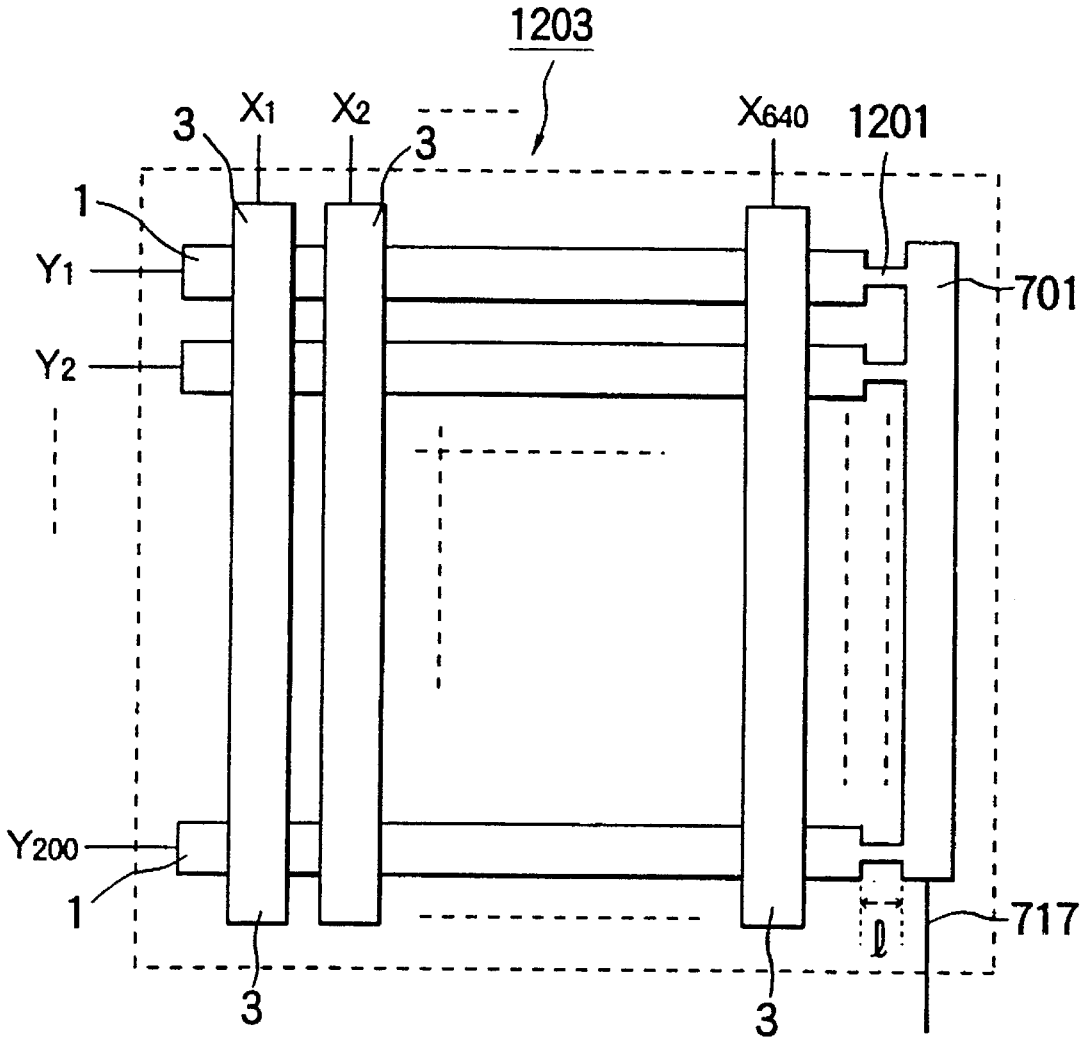
FIG. 12 is a view of a liquid crystal display device of an embodiment 6.

The resistor element 1103 is formed as a film thickness resistance by the printing method of the embodiment 5. However, the resistor element may preferably be received the patterning formed from a part of the scanning electrode 1 made of the transparent conductive film for obtaining a predetermined resistance value, unlike the separate body of the film thickness resistor for the resistor element in the embodiment 5. Such an example of this embodiment 6 is shown in FIG. 12, where the same numerals are given for the same parts as those in FIG. 11.

An end portion of the scanning electrode 1 is subjected to patterning by a width of approximately 2 μm and a length of 50 mm, and a narrow width portion 1201 is made to have an electric resistance of 500 kΩ, and used as an electric resistance instead of the resistor element 1103 described.

The liquid crystal display device of the embodiment 6, which uses the liquid crystal display element 1203 having the narrow width portion 1201 as an electric resistance at the opening end side of the scanning electrode 1, has been driven under the same driving condition as in the embodiment 5.

After the entire display is made white, then white and black horizontal strip patterns is displayed on a region of vertical 100 dots×horizontal 10 dots adjacent to a center of the display, continuously the dot number of horizontal of the region is gradually increased up to 300 dots, as a result of these, any of cases has maintained a uniform display without crosstalk. When Chinese characters or alphabet are continuously displayed, generation of the distortion voltage in the scanning electrode 1 has been suppressed, and the uniform display without crosstalk has been maintained.

EMBODIMENT 7

A liquid crystal display device in this embodiment 7 is capable of suppressing the crosstalk by eliminating distortion of the voltage waveform of the scanning lines by applying the negative feedback control technique shown in the previously described embodiments with respect to the scanning lines of the active-matrix type liquid crystal display device using a three terminal element such as the TFT element and a two-terminal element such as a MIM (metal-insulator-metal) element.

Figure 13:
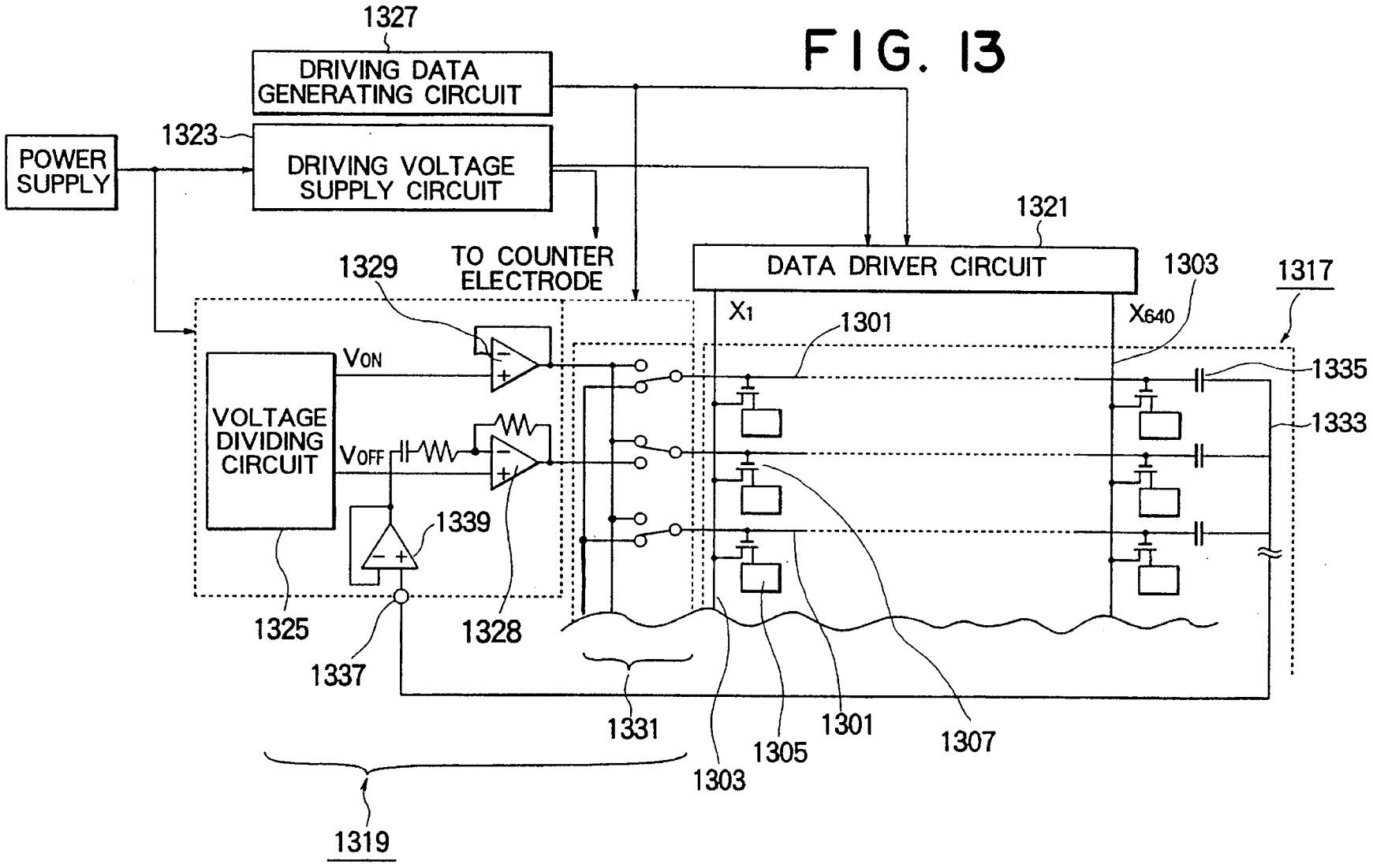
FIG. 13 is a view of a liquid crystal display device of an embodiment 7.
Figure 14:
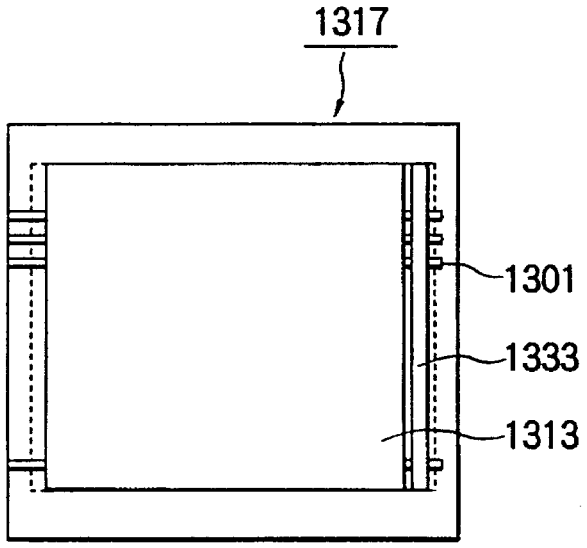
FIGS. 14(*a*), 14(*b*) and 14(*c*) are views of a liquid crystal display device of the embodiment 7.
Figure 14:
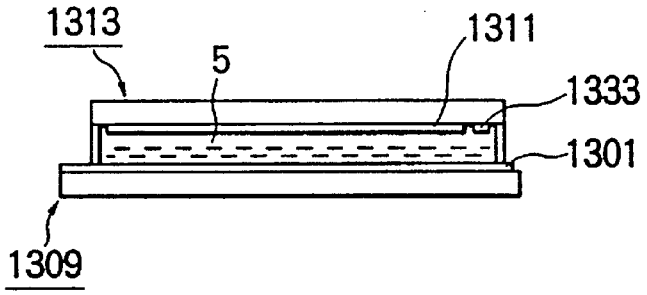
Figure 14:
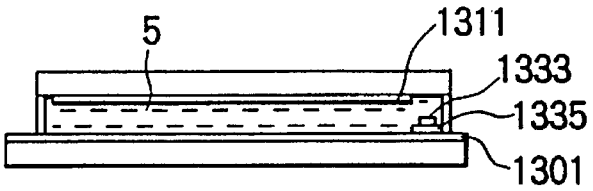

FIG. 13 is a typical view of a liquid crystal display device of this embodiment 7, and FIG. 14 shows a plan view and a sectional view of a liquid crystal display element of this embodiment 7.

A TFT array substrate 1309 is formed wherein each pixel electrode 1305 and each TFT element 1307 connected thereto are arranged at each crossing position of scanning lines 1301 with data lines 1303, the 480 scanning lines 1301 and the 640 data lines 1303 are arranged in a matrix shape. An opposing substrate 1313 is formed thereon with an counter electrode 1311 which is arranged opposing to the TFT array substrate 1309 and formed on its opposing surface with a transparent conductive film. A liquid crystal display element 1317 is formed in which a liquid crystal layer 1315 is held between the TFT array substrate 1309 and the opposing substrate 1313. There are provided a scanning driver circuit 1319 for applying scanning signal on each scanning line 1301, a data driver circuit 1321 for applying data signal on each data line 1303, and a driving voltage supply circuit 1323 for supplying various driving voltages on the driver circuit and the counter electrode (not shown). In FIG. 13, the counter electrodes are omitted for simplifying the explanation.

The TN type liquid crystal display element is used for a liquid crystal display element 1317, which has a display capacity (the number of pixels) of 640×480 dots. A cell gap of the liquid crystal display element 1317 is approximately 5 μm with an aligning film (not shown) made of polyimide and subjected to a rubbing aligning treatment, and liquid crystal molecules are twisted by 90° between the TFT array substrate 1309 and the opposing substrate 1313.

In accordance with the display data input, an ON-voltage waveform or an OFF-voltage waveform or a waveform having an intermediate potential between these waveforms is output from the data driver circuit 1321. The scanning driver circuit 1319 mainly includes a voltage dividing circuit 1325 for generating a gate potential Von making TFT 1307 a turn ON state and a gate potential Voff making TFT 1307 a turn OFF state each by dividing the power supply voltage, an operational amplifier 1329 for outputting buffer of the pervious potentials, and a switching section 1329 for receiving scanning data and selectively outputting the scanning signal to the scanning lines 1301. A scanning line voltage detecting section 1331 in an electrode shape is provided for detecting voltage other than that on the voltage input terminal of the scanning lines 1301 of the liquid crystal display device constructed as above. In an equivalent circuit, static capacitance 1333 is arranged by the scanning line voltage detecting section 1331 and the scanning lines 1301 and the liquid crystal layer 1315. For the static capacitance 1333 there have been prepared one construction using the liquid crystal layer 5 as dielectric in FIG. 14(*b*) and another construction formed of the scanning signal detecting section 1331 of the electrode shape provided on a $SiO_2$ thin film 1335 as dielectric layer formed immediately above the scanning lines 1301 in FIG. 14(*c*).

The scanning driver circuit 1319 inputs, a voltage received from an input terminal 1337, into the operational amplifier 1328 through a buffer 1339. The voltage detected by the scanning signal detecting section 1331 is connected to the scanning signal control terminal 1337 and to be negative fed back to the scanning lines 1301 by the operational amplifier 1328.

Thus, even when the voltage of the scanning lines 1301 receives variation such as voltage distortion and the like by external disturbance such as a data signal and the like, such voltage variation is detected to be negative fed back to the scanning lines 1301 and to operate for canceling the voltage variation. In this way, the crosstalk of the display is eliminated.

The liquid crystal display device, in which at least a part of the scanning lines 1301 is included in the negative feedback loop, is capable of effectively eliminating the voltage distortion of the scanning electrode and realizing a satisfactory display without crosstalk even with any driving method used; namely, the H line inversion driving system for driving with inversion of a polarity of the data signal at every scanning selected period basis; the V line inversion driving system for driving with inversion of a polarity of the data signal at every data line basis concurrently with inversion of the same at every frame basis; and the H common inversion driving system for driving with inversion of voltage of the counter electrode at every scanning selected period basis.

EMBODIMENT 8

The scanning electrode 1 of the liquid crystal display device of the embodiment 4 is formed of the transparent conductive film such as ITO, which however has relatively higher electric resistance as an electric conductive material. Accordingly, the use of such electric resistance provides difference between voltage on supply end side and voltage on terminus side of the scanning electrode 1, this causes a difference between the generating ways of each voltage variation to be a cause of the crosstalk.

Figure 15:
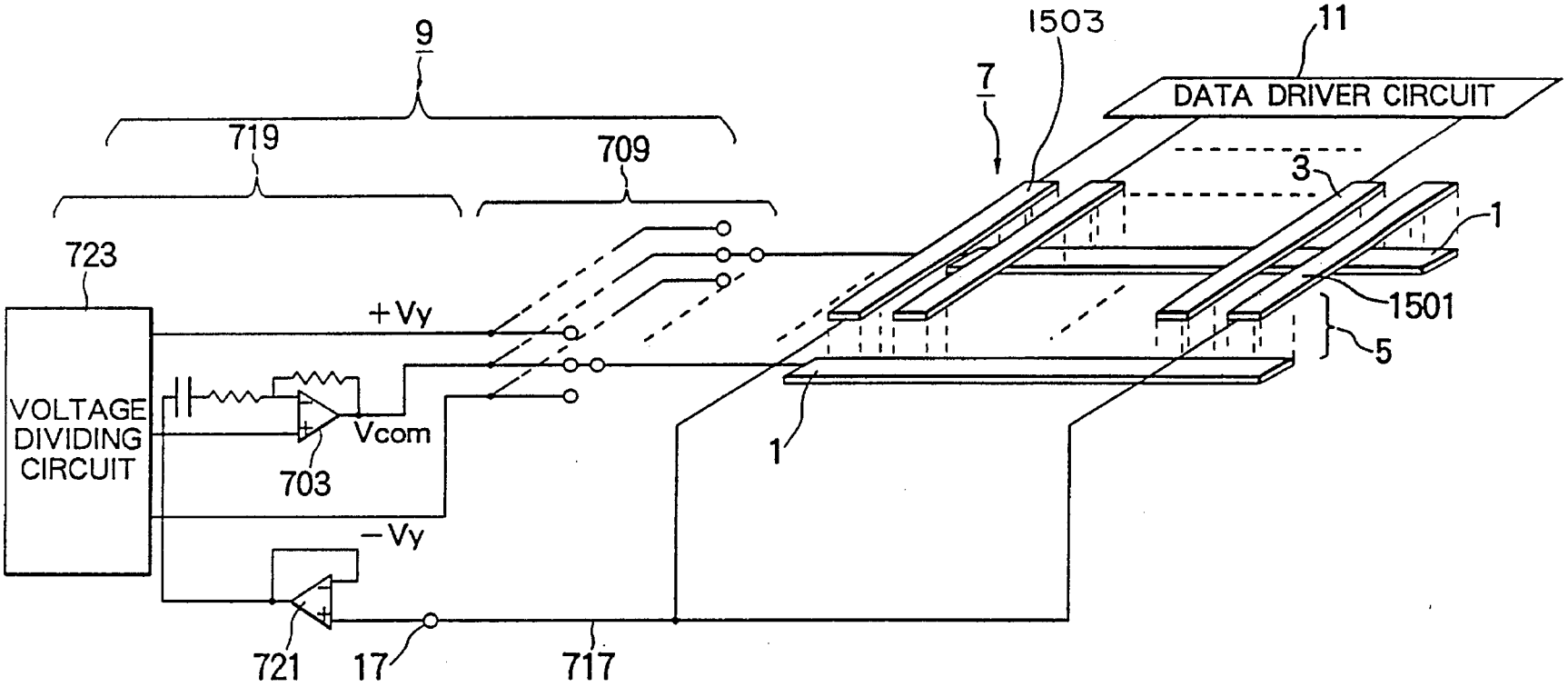
FIG. 15 is a view of a liquid crystal display device of an embodiment 8.

To carry out a negative feedback control by further accurately detecting the voltage variation generated in the scanning electrode, a liquid crystal display element of this embodiment 8 in FIG. 15 has been used.

In detail, two of voltage detecting electrodes 1501, 1503 in an electrode shape (strip shape) substantially the same as in the signal electrode 3 are formed opposing to the scanning electrode 1 through the liquid crystal 5 respectively on the supply end and terminus portion of the scanning electrode 1. Thus, static capacitance in the liquid crystal 5 as dielectric is formed on both the supply end and terminus portion of the each scanning electrode 1. The two voltage detecting electrodes 1501, 1503 are connected to the operational amplifier 703 through the input terminal 17, the wiring 717, and buffer 721 the same as in the embodiment 4 and the other, thereby the negative feedback loop is formed.

In the liquid crystal display device of the embodiment 8, constituent elements other than the two voltage detecting electrodes 1501, 1503 and the constituent elements relating thereto are the same as in the embodiment 4.

The liquid crystal display device of the embodiment 8 is driven to display various test patterns under the same condition as the embodiment 4, then it has been confirmed that in any of cases above a satisfactory uniform display is realized over an entire display surface without crosstalk.

In this way, the voltage detecting electrodes 1501, 1503 are arranged respectively on the power supply end and the terminus portion of the scanning electrode 1 to form the negative feedback loop from the power supply end to the power supply end and the negative feedback loop from the terminus portion to the power supply end, the scanning electrode voltage at the power supply end and the scanning electrode voltage at the terminus portion each of the scanning electrode 1 are detected to produce an arithmetical mean thereof, thereby a more accurate detect of the scanning electrode voltage is provided over the entire display surface to cancel a troublesome voltage variation such as a voltage distortion and to further effectively suppress the crosstalk for realizing a satisfactory display.

It is of course that further the several number of voltage detecting electrodes may be provided to detect correspondingly more voltages of a plurality of positions.

EMBODIMENT 9

Figure 16:
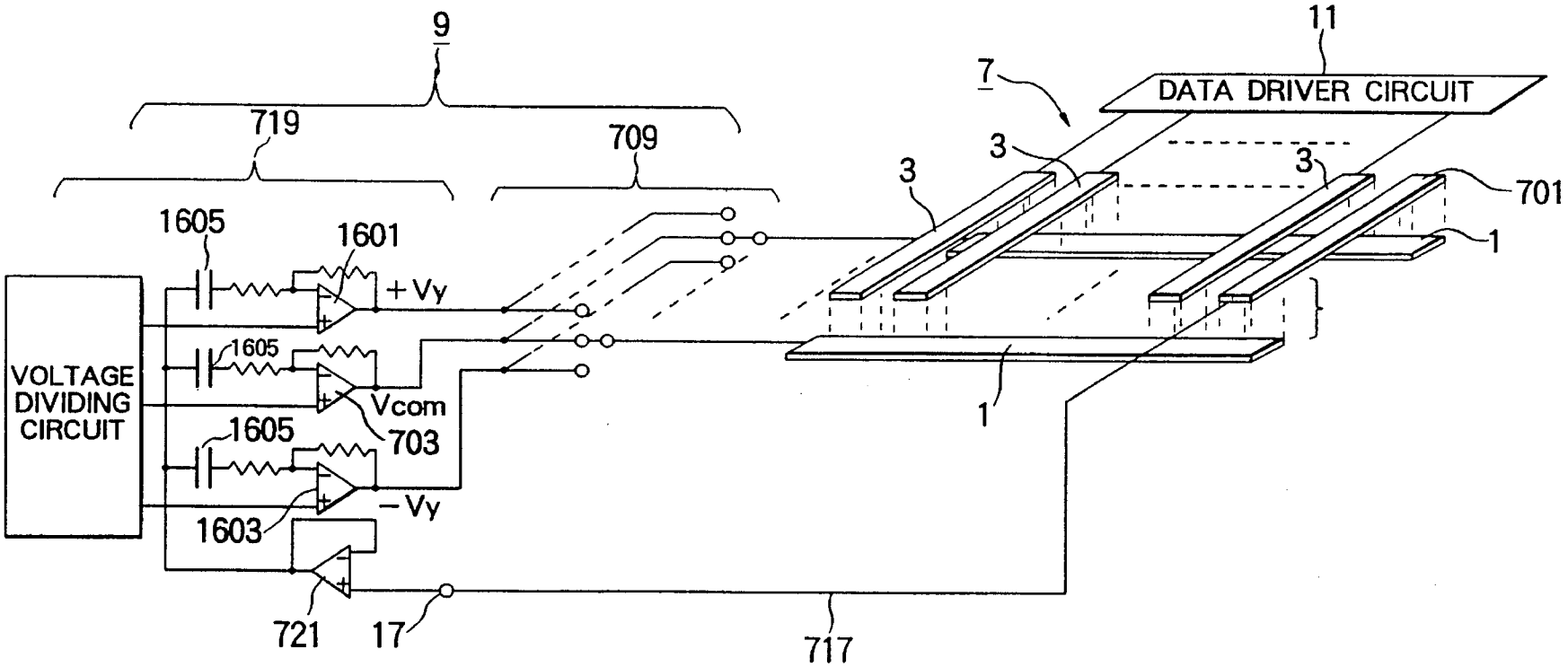
FIG. 16 is a view of a liquid crystal display device of an embodiment 9.

FIG. 16 is a typical view of a liquid crystal display device of an embodiment 9, where the same numerals are given to the same parts as those in the embodiments described.

A liquid crystal display device of an embodiment 9 is characterized in that the negative feedback control is performed not only for the scanning electrode voltage on the scanning non-selected time but also for the scanning electrode voltage (so called as scanning pulse) on the scanning selected time, and s voltage fluctuation such as a voltage distortion is canceled.

Figure 17:
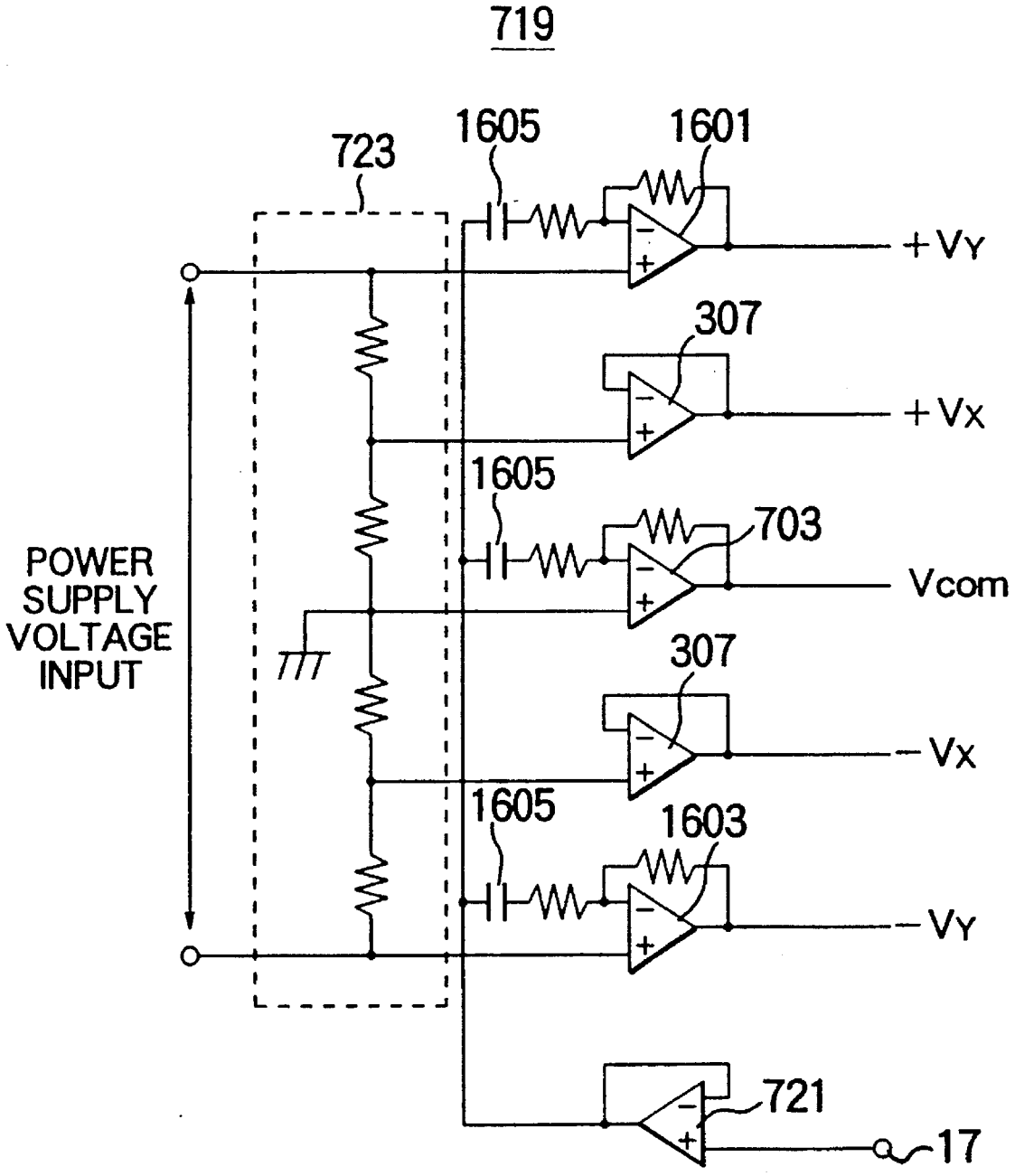
FIG. 17 is a view of a liquid crystal display device of the embodiment 9.

In the embodiment 4 and the other embodiments described, a voltage detected from the voltage detecting electrode 701 is input only to the operational amplifier 703 used as a buffer for outputting the scanning non-selected voltage (Vcom), and the detected voltage is negative fed back only to the scanning non-selected voltage (Vcom). However, a liquid crystal display device of this embodiment 9 is characterized in that, in FIG. 17, the voltage detected from the voltage detecting electrode 701 is input not only to the operational amplifier 703 used as a buffer for outputting the scanning non-selected voltage (Vcom) in the driving voltage supply circuit 719 but also to the operational amplifiers 1601, 1603 used as a buffer for outputting a scanning pulses (+Vy, −Vy), then the negative feedback control is performed also for the scanning pulses (+Vy, −Vy), thereby the voltage variation such as voltage distortion generated in the scanning pulse is canceled to effectively suppress crosstalk on the display image. The construction of the other constituent elements of the embodiment 9 is substantially similar to the embodiment 4 and so forth described.

The operational amplifiers 703, 1601, 1603 are connected to the voltage dividing circuit 723 through a capacitor 1605. The reason of such connection through the capacitor 1605 is that only the voltage variation component having effect of alternate-current voltage included in the voltage variation is induced by a capacitive coupling of the capacitor 1605, to be output to a next stage of the switching section 709 from respective operational amplifiers 703, 1601, 1603, to be opened to a direct-current voltage (Vy, Vy, Vcom) input from the voltage dividing circuit 723, and thereby to prevent a short circuit of the direct-current voltage.

The liquid crystal display device of the embodiment 9 is driven to display at a duty ratio of 1/200, a bias ratio of 1/13, and a frame frequency of 80 [Hz], and its display quality has visually been inspected. After the entire display is made white, then white and black horizontal strip patterns are displayed on a region of vertical 150 dots×horizontal 10 dots adjacent to a center of the display, continuously the dot number of horizontal of the region is gradually increased up to 500 dots, as a result of these, any of cases has maintained a uniform display without crosstalk. When Chinese characters or alphabet are continuously displayed, generation of the distortion voltage in the scanning electrode 1 has effectively been suppressed, and the uniform display without crosstalk has been maintained.

This embodiment 9 employs the one voltage detecting electrode 701 in an electrode shape. However, the two voltage detecting electrodes 1501, 1503 of the embodiment 8 may preferably be used for the voltage detecting electrode 701. The use of the two voltage detecting electrodes 1501, 1503 provides further accurate detecting of the scanning electrode voltage over an entire display surface, thereby an adverse influence of voltage variation such as voltage distortion is canceled to effectively suppress the crosstalk and to realize a satisfactory display.

The technique of the embodiment 9 capable of canceling the voltage variation produced in the scanning pulse by the negative feedback control is applied to the scanning lines of the active-matrix type liquid crystal display device using TFT as a switching element.

COMPARISON EXAMPLE TO EMBODIMENT 9

The wiring 717 of the voltage detecting electrode 701 has been removed from the liquid crystal display device of the embodiment 9. Thus, the liquid crystal display device having the same function as that of the conventional liquid crystal display device made up by stopping a function of the negative feedback loop, is allowed to display under the same driving condition as in the embodiments described.

A horizontal strip pattern of the white and black lines is allowed to display on a white ground on a region vertical 150 dots×horizontal 10 dots, then there arises a darker display unevenness in vertical direction (vertical crosstalk) in the region than that on periphery or a slightly whiter or darker display unevenness in horizontal direction (horizontal crosstalk) to the white line and black line than a white on the periphery, a display quality has thus been deteriorated. Continuously, the horizontal dot number of this region is gradually increased up to 500 dots, then a density of crosstalk portion of the display is increased in horizontal and vertical to more remarkably produce an irregularity of the display. When the Chinese characters and alphabet are displayed, similarly the crosstalk is generated with deterioration of the display quality.

EMBODIMENT 10

A liquid crystal display device of an embodiment 10 is characterized in that the waveform distortion of the voltage at the scanning non-selected time is canceled by performing the negative feedback control for the scanning non-selected voltage, simultaneously, the waveform distortion of the scanning pulse is suppressed in a way that the scanning selected voltage, i.e., a rise waveform and a fall waveform of the scanning pulses are made into a dull (delayed) waveform such as a sinusoidal waveform.

Specifically, by adding a sinusoidal shaped waveform generating section to the driving voltage supply circuit 719 described in the embodiment 4 and so forth, a waveform of the scanning pulses (+Vy, −Vy) is changed into the sinusoidal wave for outputting. The other portions are substantially the same construction as the liquid crystal display device described in the embodiment 4 and the others.

Figure 18:
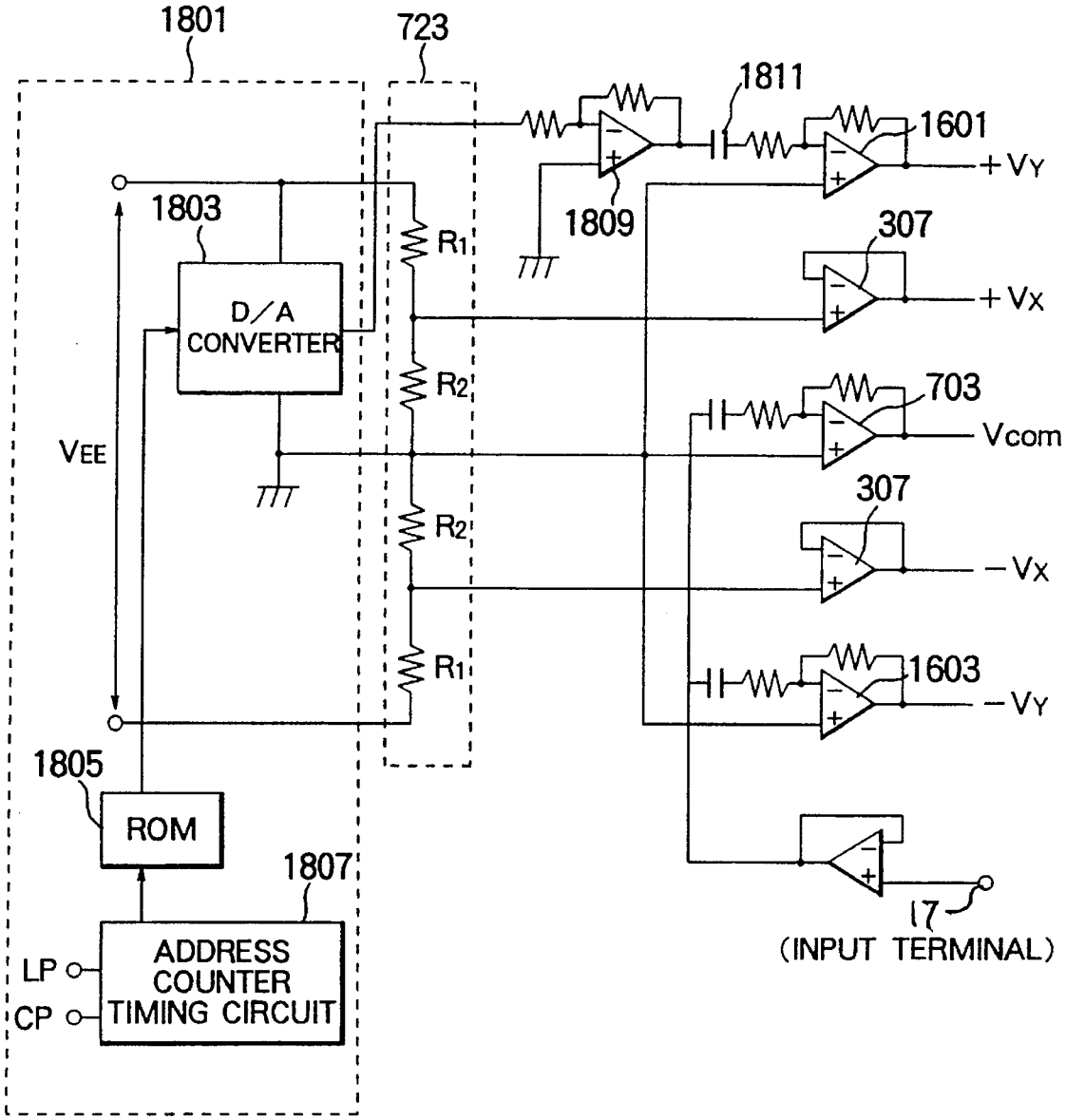
FIG. 18 is a view of a liquid crystal display device of an embodiment 10.

A sinusoidal shaped waveform generating section 1801 in FIG. 18 essentially includes a D/A converter 1803, a ROM 1805, and an address counter timing circuit 1807.

Figure 19:
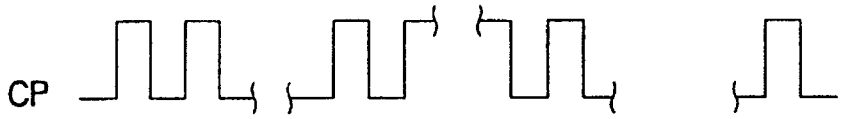
FIGS. 19(*a*), 19(*b*), 19(*c*) and 19(*d*) are views of a driving voltage waveform of a liquid crystal display device of the embodiment 10.
Figure 19:
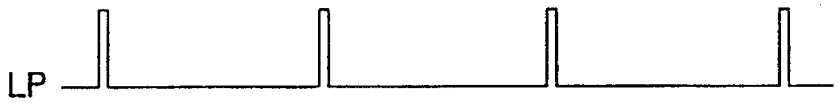
Figure 19:
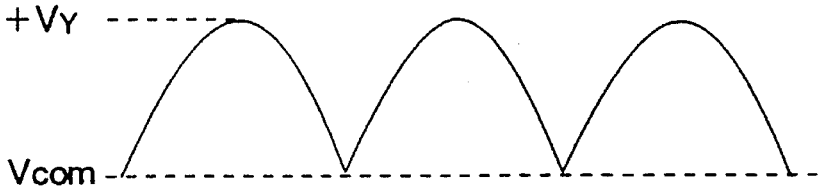
Figure 19:
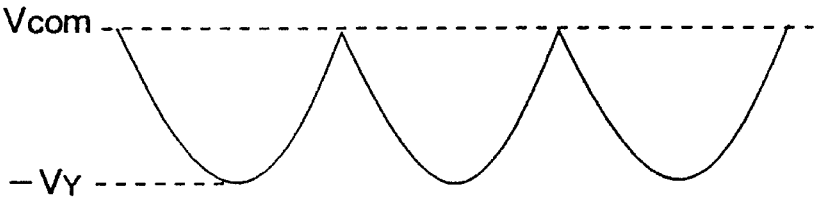

The address counter timing circuit 1807, in synchronization with a LP signal, receives a CP signal and starts to count, and to read sinusodial waveform data previously stored in the ROM 1805. Then, with reference to this sinusodial waveform data, the D/A converter 1803 generates an actual sinusoidal wave to output to the operational amplifier 1601 through a buffer 1809 and a capacitor 1811. Thus obtained sinusoidal wave, the LP signal, and the CP signal are respectively shown in FIGS. 19(*a*), (*b*), and (*c*).

Figure 20:
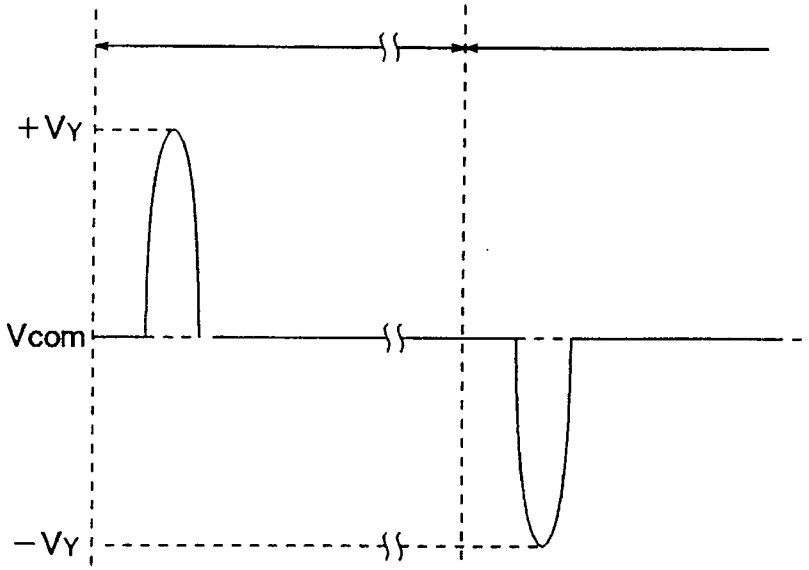
FIGS. 20(*a*), 20(*b*) and 20(*c*) are views of a driving voltage waveform of a liquid crystal display device of the embodiment 10.
Figure 20:
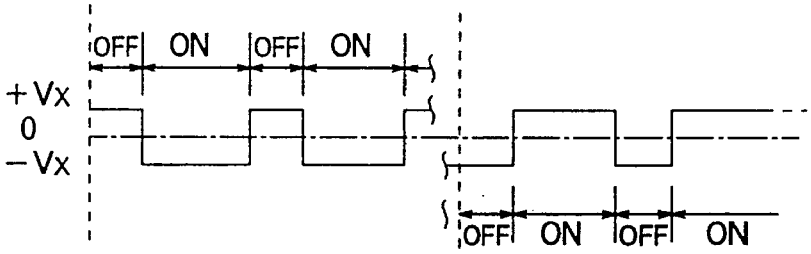
Figure 20:
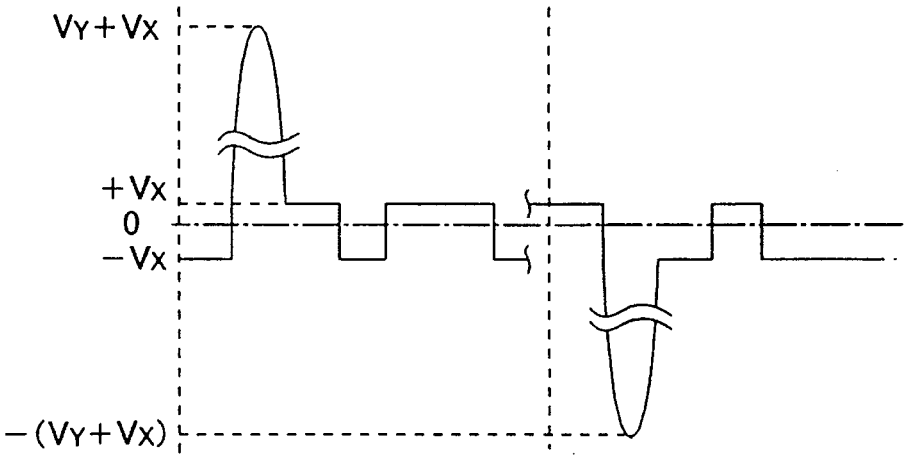

Waveforms of the scanning pulses (+Vy, −Vy) in the liquid crystal display device of the embodiment 10 become sinusoidal waves in FIG. 20(*a*) which are voltage waves hardly affected by harmonics. In this manner, by making the waveforms of rise and fall of the scanning pulses to be dull, a distortion or the like of the voltage waveform generated by receiving induction and the like from the data signal of the signal electrode 3 at the selected time of the scanning electrode 1 is changed into inconspicuous one, an adverse influence to the image display is sufficiently suppressed. Of course, it is required that the sinusoidal waveform is previously set for preventing the liquid crystal driving from being disturbed by an effective value of the then scanning pulse, and this set value is stored into ROM 1805 for forming such sinusoidal waveform as sinusoidal waveform data.

On the other hand, the voltage distortion at the scanning non-selected time of the scanning electrode 1 is canceled by carrying out the negative feedback control for the scanning non-selected voltage as is the cases of the embodiments 4 and 7 and the others described. Accordingly, it is needless to say that distortion of the scanning non-selected voltage of the scanning electrode 1 is eliminated.

It is apparent that two voltage detecting electrodes 1501, 1503 or further the more number of voltage detecting electrodes of the embodiment 8 described may preferably be employed also in this embodiment 10.

The liquid crystal display device of this embodiment 10 is driven to display by a driving voltage waveform in FIG. 20 at a duty ratio of 1/200, a bias ratio of 1/13, and a frame frequency of 80 [Hz], and its display quality has visually been inspected. Once the entire display is made white, then a white and black horizontal strip patterns is displayed on a region of vertical 150 dots×horizontal 10 dots adjacent to a center of the display, a uniform display without crosstalk is obtained. Continuously, the dot number of horizontal direction of the region is gradually increased up to 500 dots, a display irregularity is not generated, a satisfactory display has been maintained. When Chinese characters or alphabet are continuously displayed, it has been confirmed that a satisfactory display without crosstalk is realized.

EMBODIMENT 11

A liquid crystal display device of an embodiment 11 is characterized in that the waveform distortion of the voltage at the scanning non-selected time by performing the negative feedback control for the scanning non-selected voltage is canceled, concurrently, the waveform distortion of the scanning pulse is suppressed by way that the scanning selected voltage, ie., a rise waveform and a fall waveform of the scanning pulses are made into a dull (delayed) waveform.

Specifically, by adding a dull shaped waveform generating section to the driving voltage supply circuit 719 described in the embodiment 4, waveforms of the scanning pulses (+Vy, −Vy) are changed into the sinusoidal shape for outputting. The other portions are substantially the same construction as the liquid crystal display device described in the embodiment 4 and the others.

Figure 21:
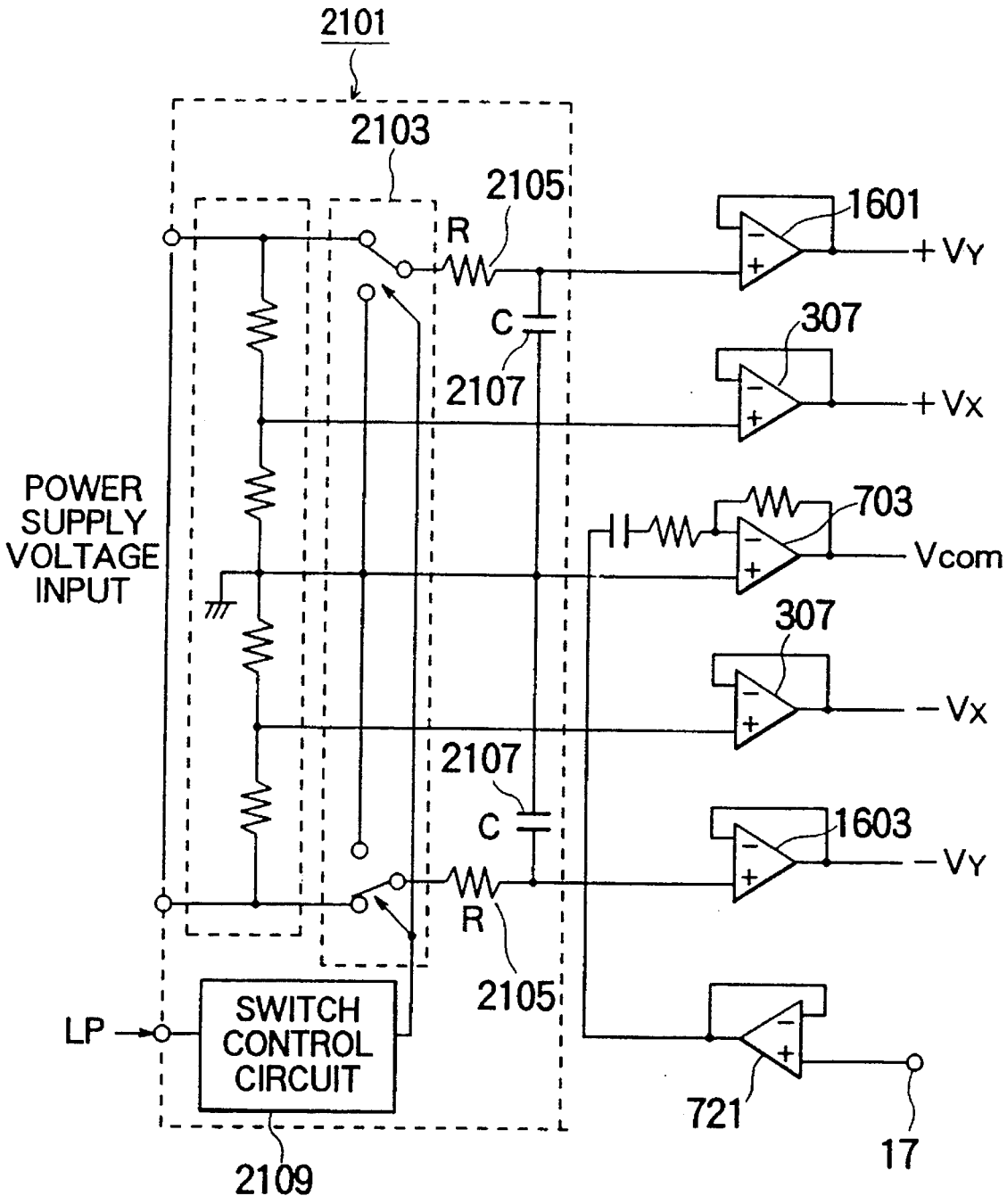
FIG. 21 is a view of a liquid crystal display device of an embodiment 11.
Figure 22:
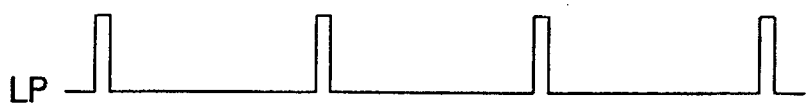
FIGS. 22(*a*), 22(*b*), 22(*c*) and 22(*d*) are views of a driving voltage waveform of a liquid crystal display device of the embodiment 11.
Figure 22:
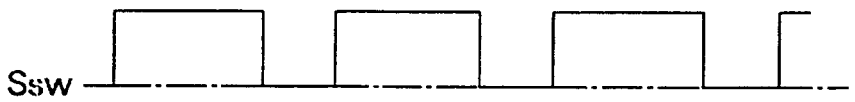
Figure 22:
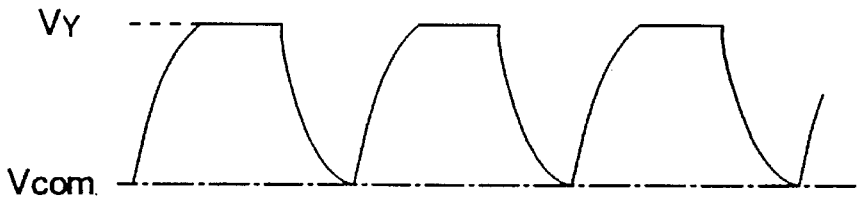
Figure 22:
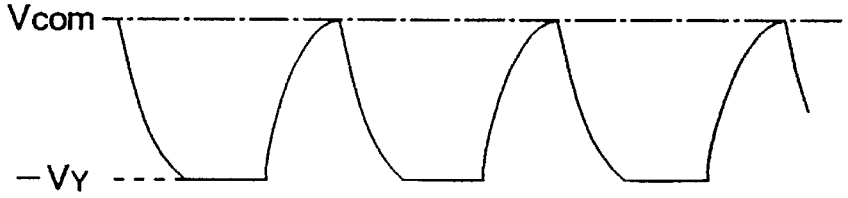

A dull shaped waveform generating section 2101 mainly includes, as in FIG. 21, a switching control circuit 2103, a resistor element 2105, a static capacitance 2107, and a switching control circuit 2109. The switching circuit 2103 switches a voltage applied to the scanning electrode 1 into a scanning pulse (scanning selected voltage) and a scanning non-selected voltage by an analog switch. The switching by the analog switch is controlled by a switching control signal $S_{SW}$ sent by the switching control circuit 2109 in accordance with a latch pulse LP. Such LP and $S_{SW}$ are shown in FIGS. 22(*a*), (*b*). A duty ratio of the switching control circuit $S_{SW}$ is adjusted depending on a time constant CR of the static capacitance 2107 and the resistor element 2105 to obtain a waveform in FIGS. 22(*c*), (*d*). In the device of this embodiment 11, the time constant estimated from the static capacitance $C_{LC}$ of the liquid crystal cell of the liquid crystal display element and the electric resistance R of the scanning driver circuit and scanning electrode is approximately 1 [μs], a static capacitance value of the static capacitance 2107 and an electric resistance value of the resistor element 2105 are set for obtaining the time constant of approximately 1 [μs] of rise and fall of the voltage waveform applied to the scanning electrode.

Figure 23:
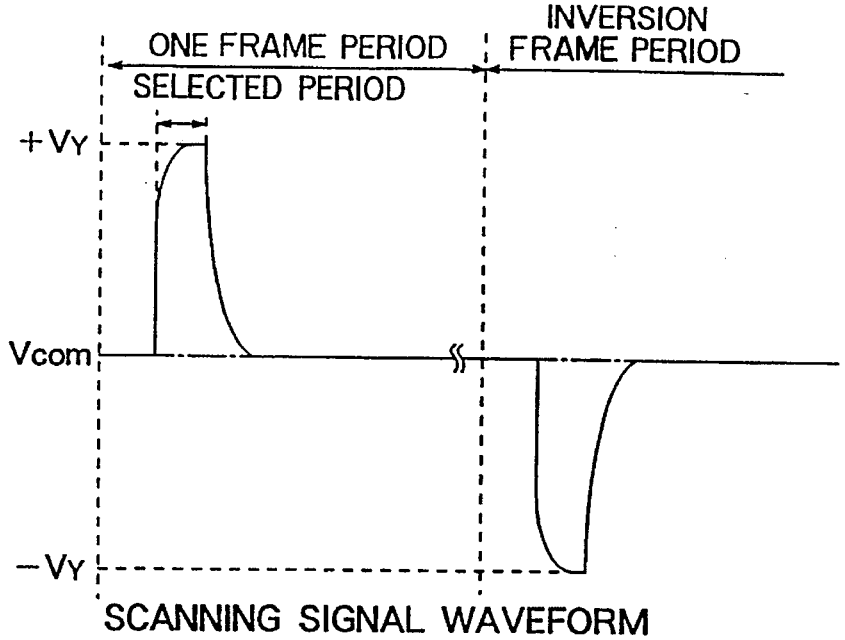
FIGS. 23(*a*), 23(*b*) and 23(*c*) are views of a driving voltage waveform of a liquid crystal display device of the embodiment 11.
Figure 23:
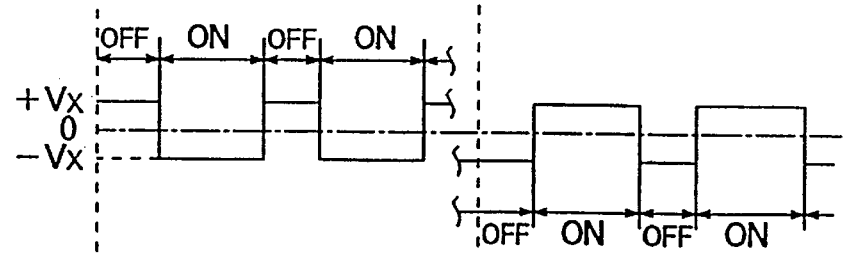
Figure 23:
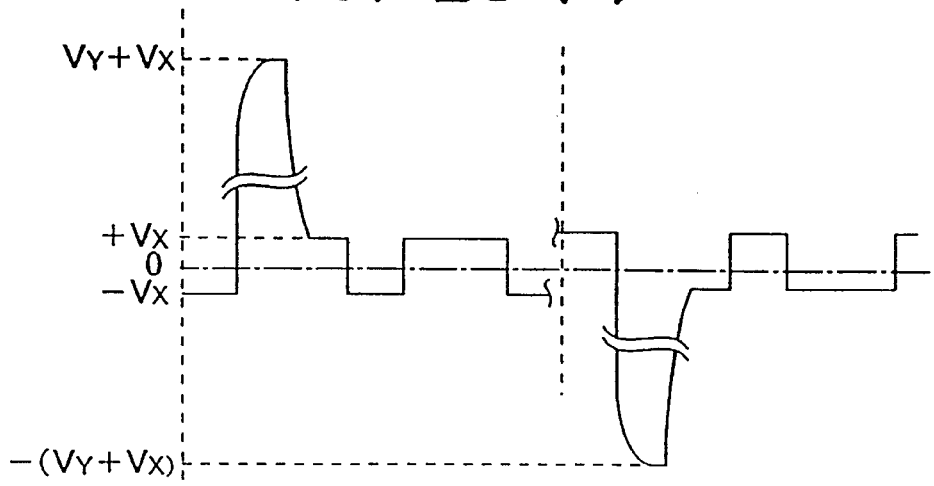

The scanning pulse waveform is made a waveform having the dull rise and fall in FIG. 23(*a*) and voltage waveforms thereof are hardly affected by harmonics. Thus, by changing into the dull waveform of rise and fall of the scanning pulse, the scanning electrode 1 received induction due to the data signal changes a harmonic voltage distortion produced in the scanning pulse into inconspicuous one, and further sufficiently suppresses an adverse influence to the image display. Of course, the scanning pulse voltage must be set to prevent the driving of liquid crystal from being disturbed by an effective value of the scanning signal at the select time.

The voltage waveform distortion of the scanning electrode 1 at the non-selected time is canceled as in the embodiment 4 to 7 by performing the negative feedback control for the voltage at the non-selected time, the voltage waveform distortion of the scanning electrode at the non-selected time is eliminated with such a satisfactory suppression of influence to the image display.

The two voltage detecting electrodes 1501, 1503 or further the several number of voltage detecting electrodes of the embodiment 8 may preferably be used in the embodiment 10.

For the dull shaped waveform generating section, a method in the embodiment 10 for changing a waveform stored in the ROM 1805 into dull shaped waveform data instead of the sinusodial waveform data may be employed in this embodiment 11 for utilizing the sinusoidal shaped waveform generating section 1801 as a dull shaped waveform generating section.

The liquid crystal display device of the embodiment 11 is allowed to display at a duty ratio of 1/200, a bias ratio of 1/13, and a frame frequency of 80 [Hz], and its display quality has been visually inspected. Once the entire display is made white, then white and black horizontal strip patterns are displayed on a region of vertical 150 dots×horizontal 10 dots adjacent to a center of the display, a uniform display without crosstalk is obtained. Continuously, the dot number of horizontal direction of the region is gradually increased up to 500 dots, a display irregularity is not generated, a satisfactory display has been maintained. When Chinese characters or alphabet are continuously displayed, it has been confirmed that a satisfactory display without crosstalk is realized.

COMPARISON EXAMPLE TO EMBODIMENT 11

In this embodiment 11, the static capacitance value of the static capacitance 2107 and the electric resistance value of the resistor element 2105 of the dull shaped waveform generating section 2101 have been changed so that a time constant for making the voltage waveform of the scanning pulse dull is made less than a time constant 1 [μs] estimated from the static capacitance $C_{LC}$ and the electric resistance R of the liquid crystal display element. Concretely, a time constant of 0.5 [μs] is used in this comparison example. The same display as in the embodiment 11 is allowed to perform, and its display quality has visually been inspected. Once the entire display is made white, then the white and black horizontal strip pattern is displayed on a region vertical 150 dots×horizontal 10 dots at a display center, where a uniform display without crosstalk has been produced. Following this, the horizontal dot number is gradually increased up to 500 dots, then from the time of exceeding about 400 dots, slightly blacker and whiter display irregularities than those of periphery are observed on horizontal direction of the region displayed of the horizontal strip pattern, it has been confirmed that the display quality is deteriorated.

EMBODIMENT 12

Figure 24:
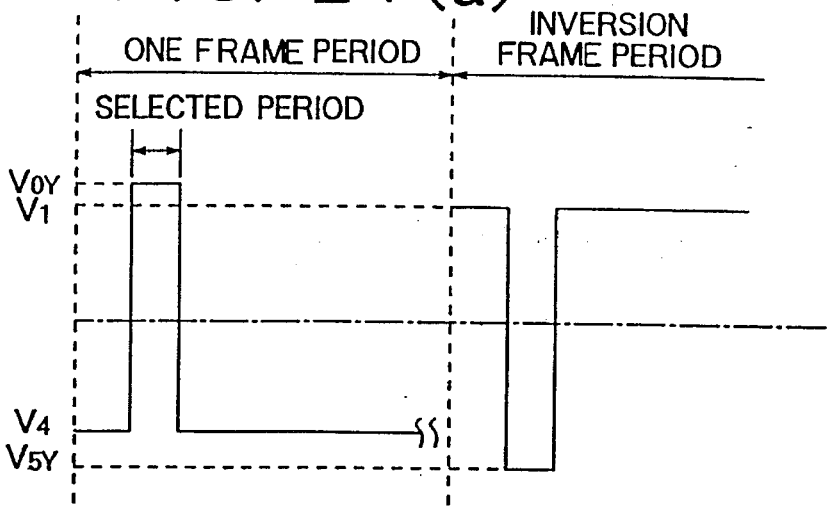
FIGS. 24(*a*), 24(*b*) and 24(*c*) are views of a driving voltage waveform of a liquid crystal display device of an embodiment 12.
Figure 24:
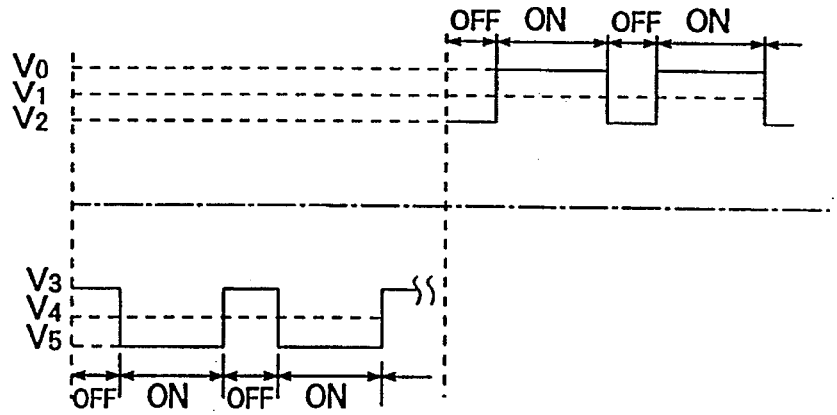
Figure 24:
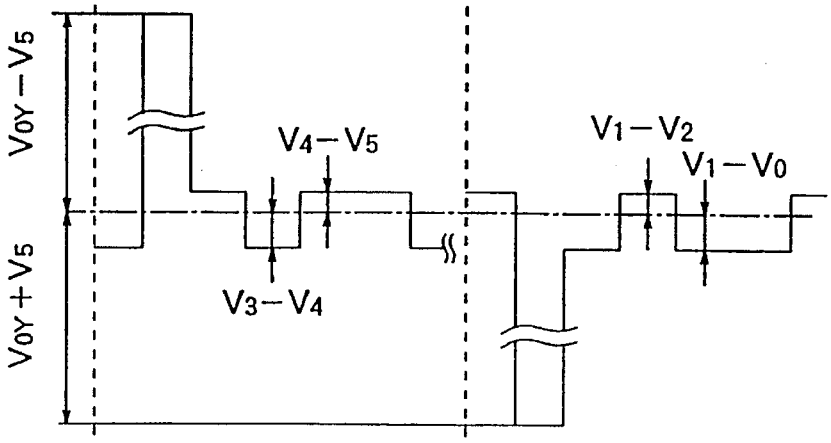

A waveform in FIG. 24 is used as a driving voltage waveform for driving a liquid crystal display device. A voltage waveform applied to the scanning electrode 1, in FIG. 24(*a*), becomes a voltage $V_{0Y}$ as a scanning pulse and a voltage $V_{5Y}$ at the polarity inverting time thereof each during a scanning selected period, and further a voltage $V_1$ and a voltage $V_4$ at the polarity inverting time thereof each during the scanning non-selected period. For a voltage waveform applied to the signal electrode 3 in FIG. 24(*b*), a data signal of one frame period is fluctuated centered on the voltage $V_4$ to become a voltage $V_3$ or a voltage $V_5$. At its polarity inverting time, it is fluctuated centered on the voltage $V_1$ to become a voltage $V_0$ or a voltage $V_2$. A liquid crystal applying voltage waveform obtained by way that the voltages described are applied to each predetermined scanning electrode and signal electrode to be overlapped with the liquid crystal layer, becomes a waveform that is polarity inverted at every frame basis, as shown in FIG. 24(*c*). Actually, a liquid crystal display device capable of producing a high fine image display uses many times such driving voltage waveform.

The embodiment 12 is characterized in that the voltage variation such as voltage distortion generated in a liquid crystal display device using a driving voltage waveform immediately previously described is suppressed by a negative feedback control. The same numerals are given for the same parts as those of the liquid crystal display device of the embodiment 4 and so forth.

Figure 25:
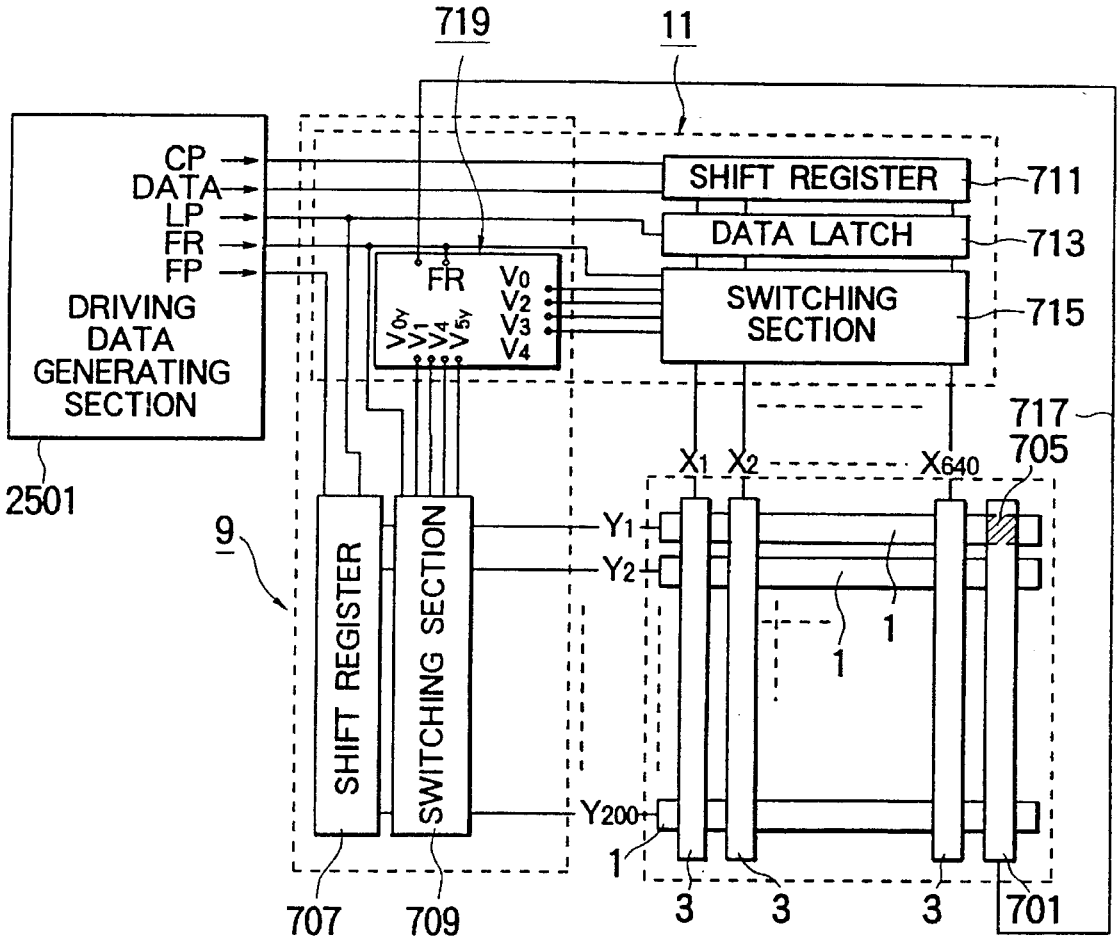
FIG. 25 is a view of a liquid crystal display device of the embodiments 12, 16, and 17.
Figure 26A:
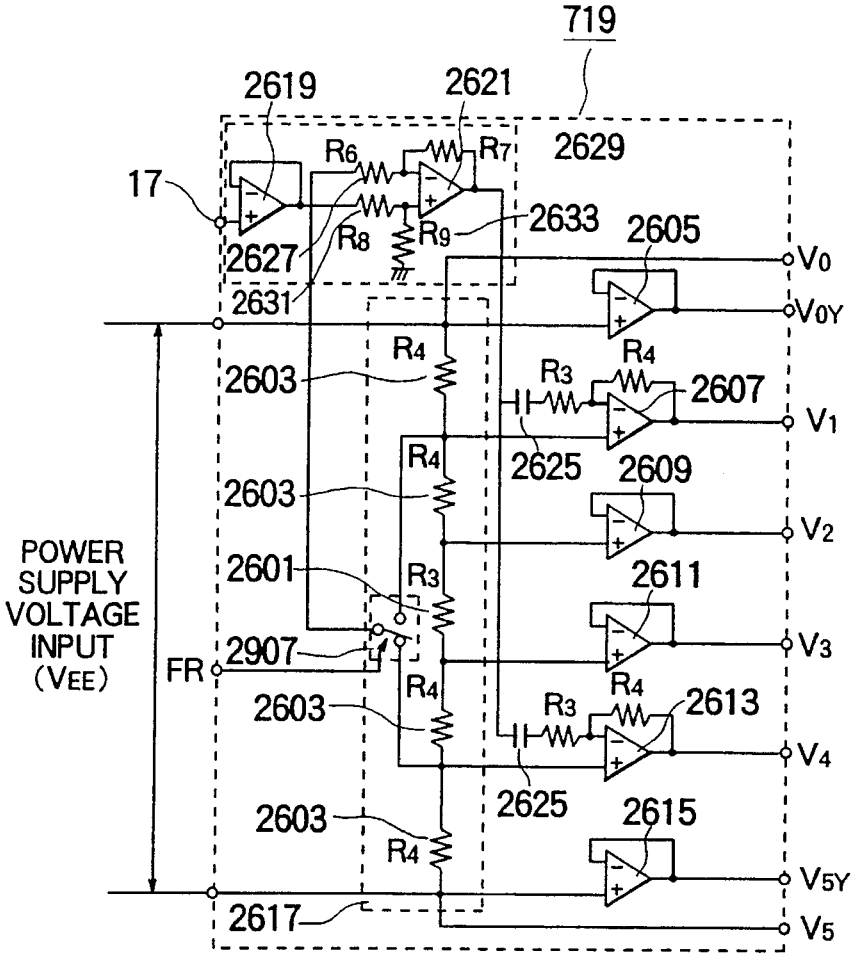
FIGS. 26(*a*), 26(*b*), 26(*c*) and 26(*d*) are views of a liquid crystal display device of a driving voltage supply circuit in the embodiment 12.
Figure 26B:
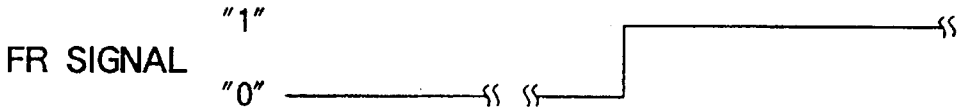
Figure 26C:
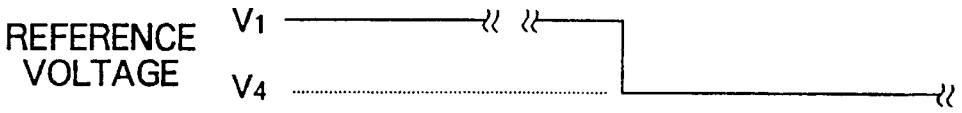
Figure 26D:
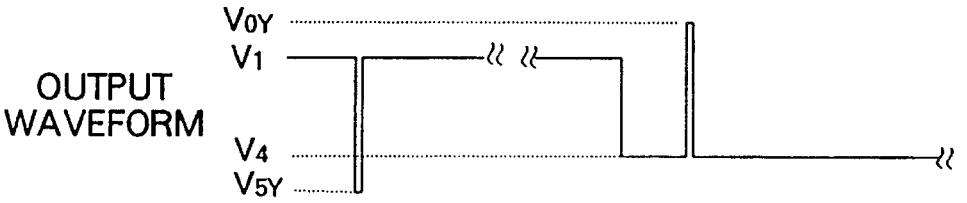

In detail, in FIG. 25, a scanning driver circuit 9 includes a shift register 707 and a switching section 709. In the shift register 707, the scanning data for selecting the scanning electrode 1 sequentially along a row is transferred at one after another basis of the scanning electrode 1. In the switching section 709, scanning pulses ($V_{0Y}$, $V_{5Y}$) at the scanning selected time and voltages ($V_1$, $V_4$) at the scanning non-selected time are selected by the scanning data. The scanning driver circuit 9 is controlled by FP (frame pulse) for determining one frame and by LP (latch pulse) for determining the one scanning time. To prevent deterioration due to applied direct-current voltage component, liquid crystal is required to be driven by alternate-current voltage, then these switching sections 709 are provided with function for inverting the polarity at a predetermined period, which is controlled by FR (polarity inversion) signal in FIG. 26(*b*) given from a control section 2501.

A data driver circuit 11 includes a shift register 711 for transferring DATA (display image data) given from a control section 2501, a data latch 713 for storing the DATA, and a switching section 715 for selecting data signals ($V_0$, $V_2$, $V_3$, $V_5$) by the DATA. The data driver circuit 11 is controlled by receiving CP (clock pulse), LP (latch pulse), FR (polarity inversion signal), and DATA (display image data) each sent from the control section 2501.

A driving voltage supply circuit 719 is formed inside a scanning driver circuit 9 and the data driver circuit 11.

The driving voltage supply circuit 719 receives power supply voltage supplied from a liquid crystal driving voltage power supply (not shown) to produce respective voltages ($V_0$, $V_1$, $V_2$, $V_3$, $V_4$, $V_5$, $V_{0Y}$, $V_{5Y}$) required for driving the liquid crystal display element. In FIG. 26(*a*), the input power supply voltage is divided by electric resistances ($R_3$) 1601, ($R_4$) 1203, and driving voltages of obtained different potentials are output through each buffer using operational amplifiers 2605, 2607, 2609, 2611, 2613, 2615. The voltages $V_{0Y}$, $V_1$, $V_4$, $V_5$ from among the respective voltages are supplied to the switching section 709 of the scanning driver circuit 9, and $V_0$, $V_2$, $V_3$, $V_5$ from the same are supplied to the switching section 715 of the data driver circuit 11.

The switching section 709 of the scanning driver circuit 9 selects respective output voltage potentials one after another from $V_{0Y}$, $V_1$, $V_4$, $V_{5Y}$ ranging from the scanning electrodes $Y_1$ to $Y_{200}$ in accordance with the scanning data from the control circuit 2501. Specifically, in the switching section 709, if contents of the scanning data thus input is a scanning selected data, the control selects $V_{0Y}$ as a scanning pulse (because of alternate-current driving, this scanning pulse is voltage $V_{5Y}$ at the time of polarity inversion), and if the contents of the scanning data thus input is a scanning non-selected data, the control selects a scanning non-selected voltage $V_4$ (because of alternate-current driving, a voltage is $V_1$ at the time of polarity inversion), and the selected are sent to the respective scanning electrode. Thus, for example, the scanning electrode voltage waveforms are obtained by a general voltage averaging method in FIG. 24(*a*).

The data driver circuit 11 selects at every one basis a voltage from the voltages $V_0$, $V_2$, $V_3$, $V_5$ to be applied to each of the 640 signal electrodes 3 ranging from $X_1$ to $X_{640}$ in accordance with display image data obtained from the control circuit 2501, and the selected voltages are applied to the respective signal electrodes 3.

When the display image data (DATA) is input to the shift register 711, the control proceeds to sequentially transfer as serial data from $X_1$ to $X_{640}$ in accordance with the clock pulse (CP) inside such shift register 711. Inside the data latch 713, the display image data (DATA) serially transferred by the shift register 711 are respectively stored as 640 parallel data ranging from outputs $X_1$ to $X_{640}$ in accordance with LP (latch pulse) at every data latch element basis with the numerals of 640 arranged in rows in a manner of an array. In the switching section 715, at every data basis in accordance with parallel data stored in the data latch 713, if it is the selected (ON) data, then a voltage $V_5$ (because of alternate-current driving, a voltage is $V_0$ at the polarity inversion time) is selected as a selected voltage, and if it is the non-selected (OFF) data, then a non-selected voltage $V_3$ (because of alternate-current driving, a voltage is $V_2$ at the polarity inversion time) is selected, and then the selected are sent to the signal electrode 3. In this way, for example, a data signal waveform by a general voltage averaging method in FIG. 24(*b*) is obtained.

When the scanning electrode 1 and the signal electrode 3 are applied the voltage respectively, a voltage waveform applied to the liquid crystal layer 5 is like that in FIG. 24(*c*), in which a width of the selected pulse is varied depending on the display contents (ON, OFF).

A voltage detecting electrode 701 in an electrode shape the same as in the embodiments described is formed on the liquid crystal display element 7. A static capacitance 705 is formed of the voltage detecting electrode 701, the scanning electrode 1, and the liquid crystal layer 5. The voltage detecting electrode 701 detects voltage variation such as distortion voltage and the like, for example, in a spike shape produced in the scanning electrode 1 by capacitive coupling of the static capacitance 705. Thus detected voltage is input to a driving voltage supply circuit 719, and negative fed back to the driving voltages $V_1$ and $V_4$.

The driving voltage supply circuit 719, in FIG. 26(*a*), mainly includes a voltage dividing circuit 2617 using electric resistance R3, R4, operational amplifiers 2605, 2607, 2609, 2611, 2615 used as a buffer for outputting respective direct-current voltages ($V_0$, $V_1$, $V_2$, $V_3$, $V_4$, $V_5$, $V_{0Y}$, $V_{5Y}$) produced by voltage dividing by the voltage dividing circuit 2617, and an operational amplifier 2607, 2613 used for negative feedback, and an operational amplifier 2619 used as a buffer for input, and the operational amplifiers 2621 used for differential calculation. A reason why the capacitor 2625 is inserted is such that only the alternate-current voltage component such as the voltage distortion and the like are conducted by the capacitive coupling of the capacitor 2625, to provide an open circuit for the direct-current voltage component, and to prevent a short circuit across the operational amplifiers 2607, 2613 each other.

To pick up only the voltage distortion component of the scanning electrode 1, there is allowed to generate a voltage $V_{ref}$ varied in synchronization with the polarity inversion signal FR by a potential corresponding to a width of a voltage applied to the scanning electrode 1 from the scanning driver circuit 9. The reference voltage $V_{ref}$ has a timing relationship in FIG. 26(*c*) for a voltage waveform applied to the scanning electrode 1 from the scanning driver circuit 9 as shown in FIG. 26(*d*).

The operational amplifier 2621 supplies to the operational amplifiers 2607, 2613 a voltage obtained from a difference between a voltage being input through an input terminal 17 and operational amplifier 2619 detected by a voltage detecting electrode 701 of the liquid crystal display element 7 and another voltage taken out from the reference voltage $V_{ref}$ as a voltage being output from the scanning driver circuit. In this way, only the voltage distortion component of the scanning electrode 1 is negative fed back to the scanning electrode 1. Such negative feedback loop feeds back only the voltage distortion component of the scanning electrode 1 to the scanning electrode 1 to eliminate its voltage distortion even in case where the voltage applied to the scanning electrode 1 is a scanning pulse, or a scanning non-selected voltage, or one inverted of its polarity.

Then, it is a matter of course that respective electric resistances (R6) 2627, (R7) 2629, (R8) 2631, (R9) 2633 connected to the operational amplifier 2621 are set to a value capable of obtaining an optimum gain in computation for taking out only the voltage distortion component by the operational amplifier 2621.

The liquid crystal display device of the embodiment 12 is allowed to display by the liquid crystal with a polarity inversion at every 13 scanning line basis at a duty ratio of 1/200, a bias ratio of 1/13, and a frame frequency of 80 Hz, and its display quality has been visually inspected.

Once the entire display is made white, then white and black horizontal strip patterns are displayed on a region of vertical 150 dots×horizontal 10 dots adjacent to a center of the display, continuously, the dot number of horizontal of the region is gradually increased up to 500 dots, and in any cases a satisfactory uniform display without crosstalk has been maintained. When Chinese characters or alphabet are continuously displayed, generation of the distortion voltage in the scanning electrode is suppressed, and a satisfactory display without crosstalk is maintained.

COMPARISON EXAMPLE TO EMBODIMENT 12

Figure 27:
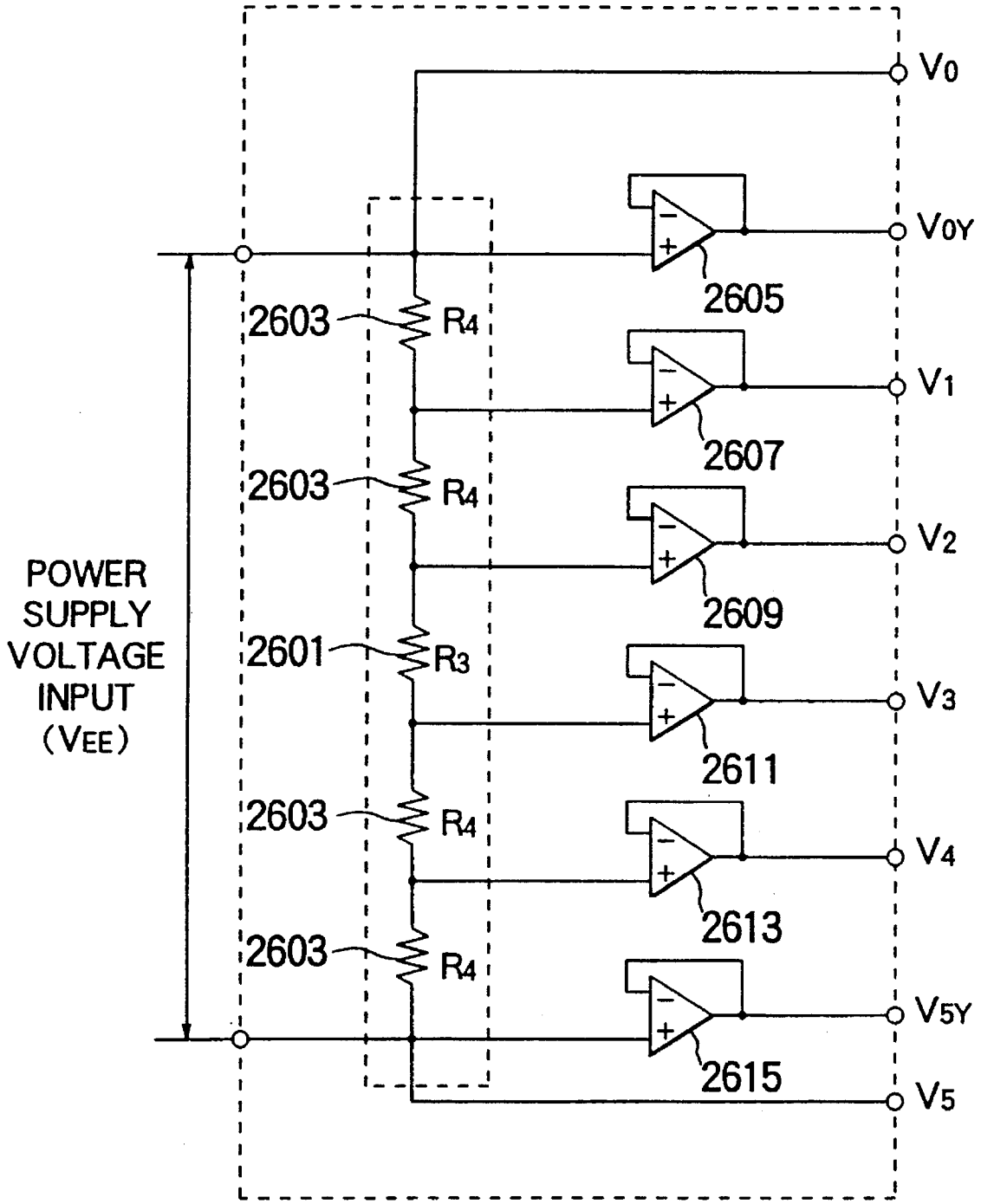
FIG. 27 is a view of a liquid crystal display device of a comparison example for the embodiment 12.

The respective constituent elements such as the operational amplifier 2619, 2621 and the like which forming the negative feedback loop from the driving voltage supply circuit 719, are removed from the liquid crystal display device of this embodiment 12. Thus obtained liquid crystal display device using the driving voltage supply circuit that is conventionally used as shown in FIG. 27, is allowed to display under the same driving condition as the embodiment 12.

First, the entire display surface is made white, thereafter a white and black horizontal strip pattern is allowed to display on a region vertical 150 dots×horizontal 10 dots, then continuously, the horizontal dot number of this region is gradually increased up to 500 dots. But, when the white and black horizontal strip pattern is allowed to display on the region vertical 150 dots×horizontal 10 dots, then a darker crosstalk portion of the display than that of its periphery is more remarkably generated in the vertical direction, and depending on the increase of this horizontal dot number, a vertical crosstalk is also remarkably appeared and deteriorate the display quality. When the Chinese characters and alphabet are displayed, similarly the remarkable crosstalk chained to the vertical and horizontal directions is generated, to conspicuously provide irregularity of the display, and to lower the display quality.

EMBODIMENT 13

The liquid crystal display element of the liquid crystal display device of the embodiment 12 is changed into a construction formed of the liquid crystal display element 7 using the two voltage detecting electrodes 1501, 1503 of the embodiment 8 in FIG. 15. The other constituent elements are the same as in the embodiment 12. A voltage variation of the scanning electrode 1 is more accurately detected by using a plurality of voltage detecting electrodes as equivalent as in the embodiment 8 and the others described.

A liquid crystal display device of this embodiment 13 is allowed to display with a polarity inversion at every 13 scanning line basis at a duty ratio of 1/200, a bias ratio of 1/13, and a frame frequency of 80 Hz, and its display quality has been visually inspected, as in the embodiment 12.

First, the entire display is made white, then white and black horizontal strip patterns are displayed on a region of vertical 150 dots×horizontal 10 dots adjacent to a center of the display, continuously, the dot number of horizontal of the region is gradually increased up to 500 dots, and in any cases a satisfactory uniform display without crosstalk has been maintained. When Chinese characters or alphabet are continuously displayed, generation of the distortion voltage in the scanning electrode is suppressed, and a satisfactory display without crosstalk is maintained. In this case, the crosstalk on the display is more suppressed compared to the embodiment 12.

EMBODIMENT 14

The negative feedback control to the scanning non-selected voltage is employed in the embodiment 12. However, the negative feedback control is performed also for the scanning pulse to eliminate the voltage variation such as a voltage distortion generated in the scanning pulse during the scanning selected period and to more effectively suppress the crosstalk.

Figure 28:
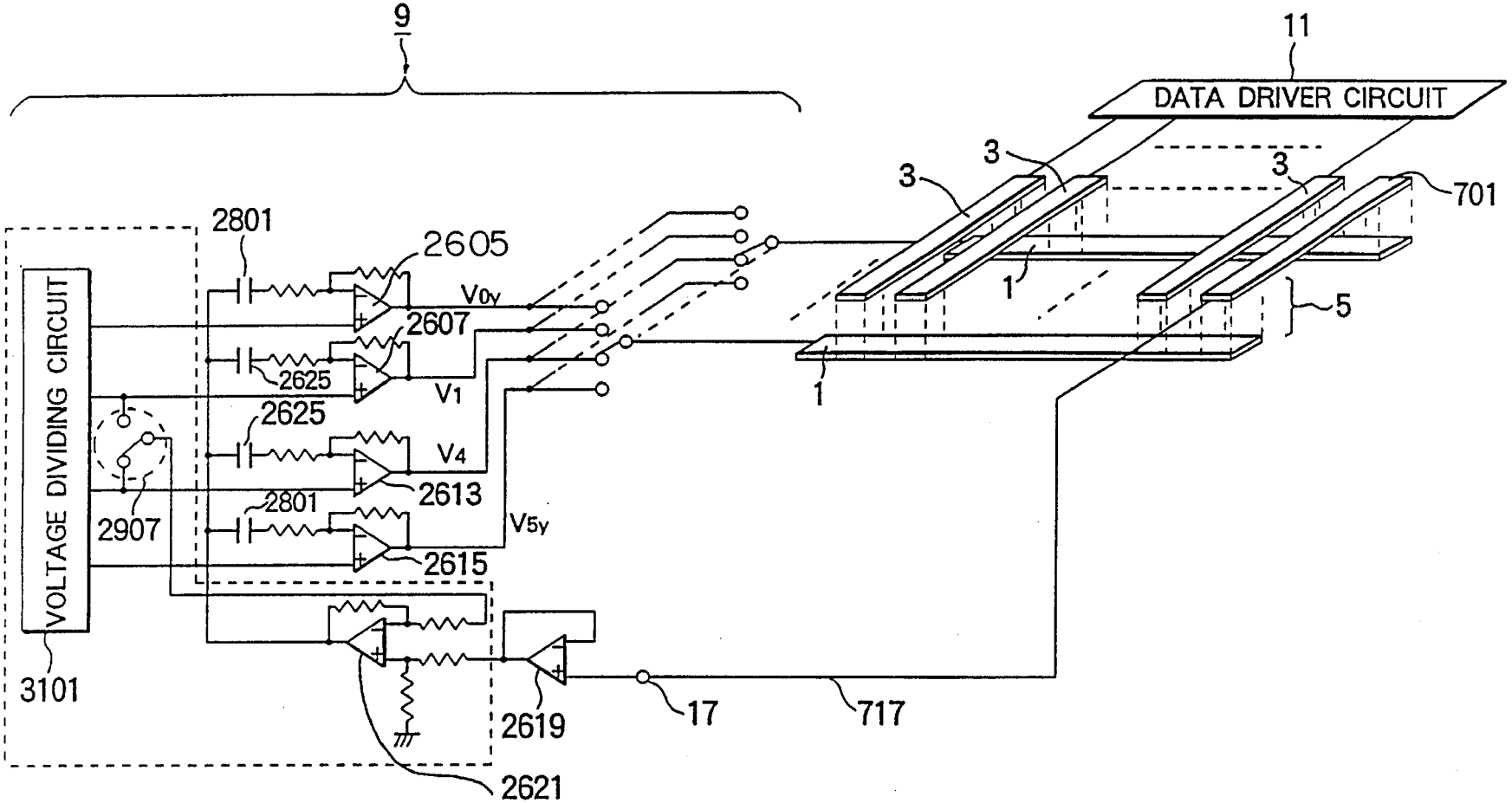
FIG. 28 is a view of a liquid crystal display device of an embodiment 14.

In this case, as shown in FIG. 28, a circuit may preferably be constructed that an output of the operational amplifier 2621 is input not only to the operational amplifiers 2607, 2613 through the capacitor 2801, but also to the operational amplifiers 2605, 2615 through the same.

EMBODIMENT 15

An embodiment 15 is in that two voltage detecting electrodes 1501, 1503 of the embodiment 13 or further a plurality of voltage detecting electrodes are used in the embodiment 14. Thus, a voltage variation of the scanning electrode 1 is more accurately detected.

EMBODIMENT 16

In the liquid crystal display device of the embodiment 12, the control circuit 2501 is changed into one capable of performing 16 gradation representation of the pulse width modulation system to generate a control signal, concurrently it is changed into MSM 5300 made by Oki Electric Co., Ltd. that is the liquid crystal driver IC of the pulse width modulation system as a data driver circuit 11, and a liquid crystal display device of a pulse width modulation system is produced. In the pulse width modulation system, the minimum unit pulse width is shortened by the amount corresponding to the gradation representation in order to timely control the pulse width depending on the gradation representation. In general, the minimum unit pulse width is determined by a CPG signal divided into the gradation number between latch pulses (LP). In this embodiment 16, a variation of the pulse width for the gradation level is selected for obtaining a uniform change of an optical transmittance of the liquid crystal.

The liquid crystal display device of the embodiment 16 is allowed to perform the gradation representation under the driving condition at a duty ratio of 1/200, a bias ratio of 1/13, and a frame frequency of 80 Hz, and its display quality has been visually inspected. Once the entire display is made white, then a remaining 15 level gradation by partitioning vertical or horizontal other than a white display is displayed on a region of vertical 150 dots×horizontal 450 at a center of the display. The crosstalk is hardly observed even in any gradation level, a satisfactory display is obtained, it is confirmed that a clear representation of the 15 level gradation is realized.

COMPARISON EXAMPLE TO EMBODIMENT 16

The negative feedback loop is removed from the driving voltage supply circuit 719 of the liquid crystal display device of this embodiment 16, and changed into the general driving voltage generation circuit conventionally used as shown in FIG. 27. This liquid crystal display device having the general conventional construction is driven to display by the same driving condition as the embodiment 16.

Once the entire display is made white, then a remaining 15 level gradation other than a white display by partitioning in vertical or horizontal is displayed on a region of vertical 150 dots×horizontal 450 adjacent to the display center. As a result, a conspicuous crosstalk is generated on the entire gradation except of a black display of the display region to produce a remarkable irregularity of the display, and a display quality is deteriorated. With this crosstalk generated, only as high as 8 gradations are discriminated.

EMBODIMENT 17

In the liquid crystal display device of the embodiment 12, a control section 2501 is changed into a 16 gradation representation of a FRC (Frame Rate Control) system, simultaneously the data driver circuit 11 is also changed into one compatible to the frame thinning system, and the gradation representation is employed, then its display quality has visually been observed. Once the entire display is made white, then a remaining 15 level gradation other than a white display by partitioning in vertical or horizontal is displayed on a region of vertical 150 dots×horizontal 450 adjacent to the display center. As a result, in any of gradation levels, the crosstalk is hardly observed, satisfactory display is obtained, it is confirmed that a clear display of the 15 level gradation is realized.

EMBODIMENT 18

Figure 29:
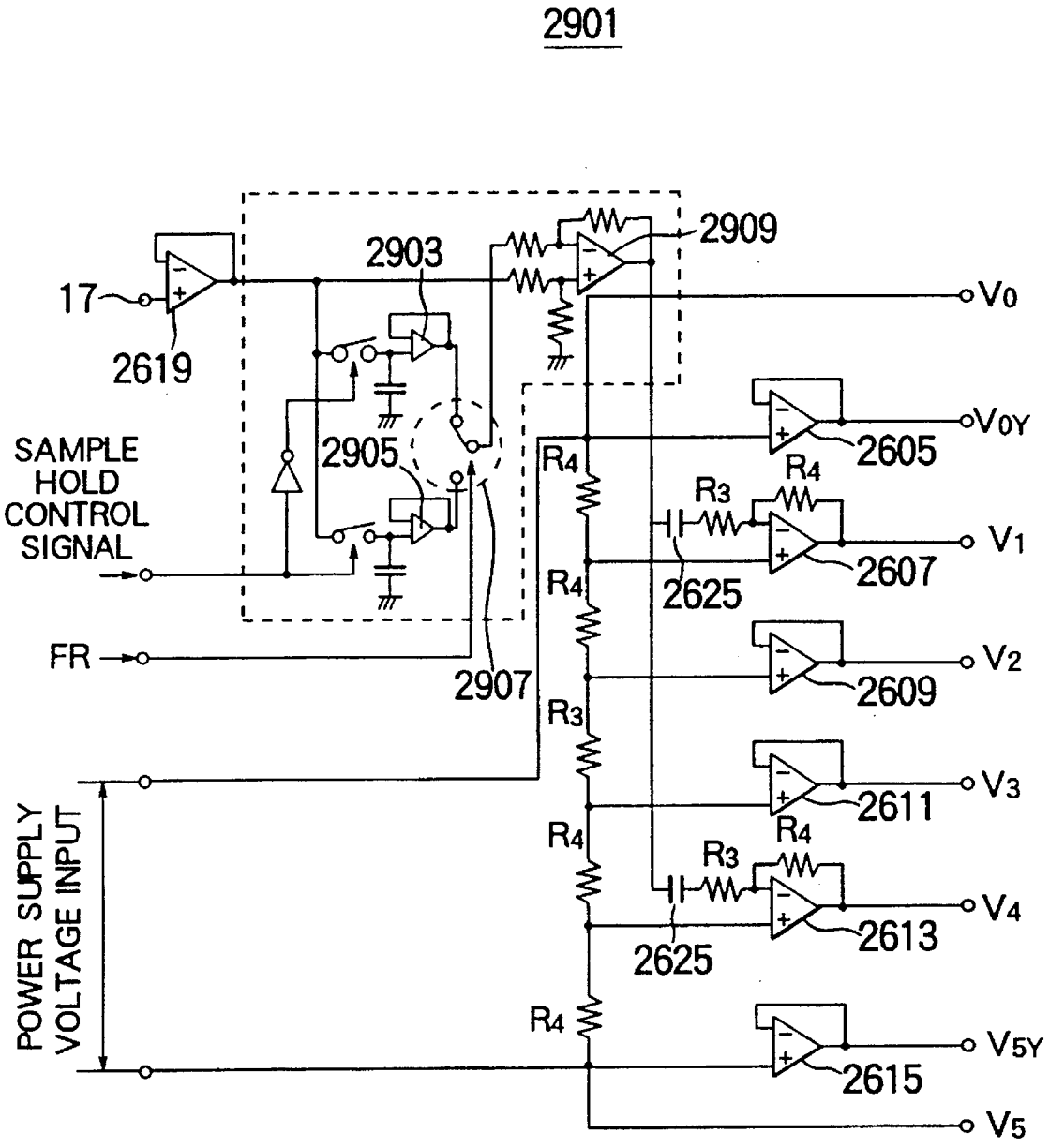
FIG. 29 is a view of a liquid crystal display device of an embodiment 18.

A liquid crystal display device of this embodiment 18 is formed in that the driving voltage supply circuit 719 of the liquid crystal display device of the embodiment 12 is replaced by a driving voltage supply circuit 2901 in FIG. 29.

Figure 30:
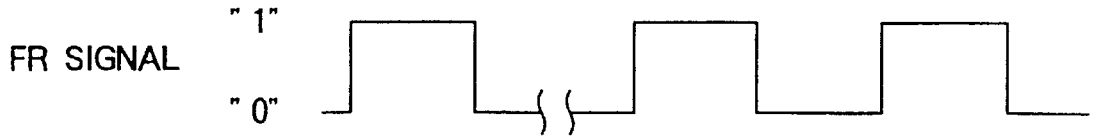
FIGS. 30(*a*), 30(*b*), 30(*c*) and 30(*d*) are views of a driving voltage waveform of a liquid crystal display device of the embodiment 18.
Figure 30:
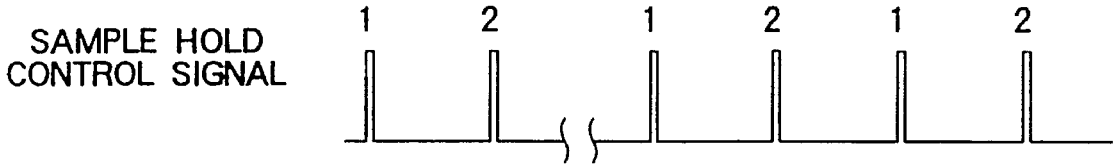
Figure 30:
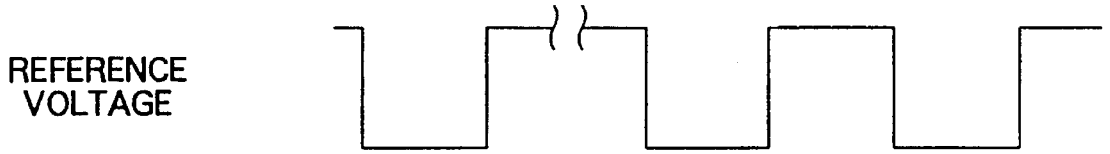
Figure 30:
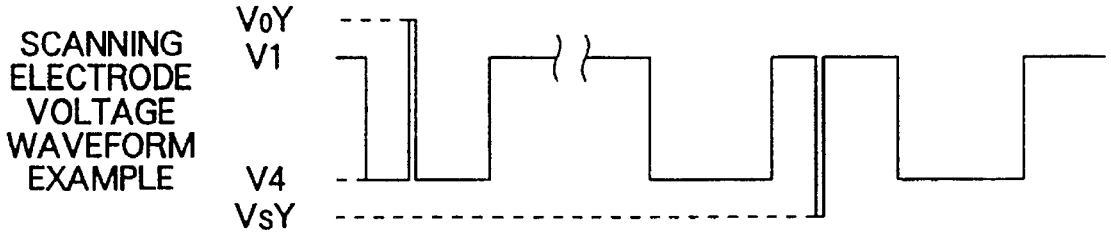

In detail, a distortion voltage component is taken out from a voltage detected from the scanning electrode 1 by the voltage detecting electrode 701 of the liquid crystal display element 7, and negative fed back to the scanning electrode 1. At this time, a sample hold control signal in FIG. 30 is set for holding a voltage applied to the scanning electrode immediately before sample holding circuits 2903, 2905 is polarity inverted because a polarity inversion signal FR becomes active immediately before being switched between 0 and 1. The sample holding circuits 2903, 2905 arranged in parallel with each other are operated by being input both a first sample holding control signal and a second sample holding control signal for holding a voltage of either side polarity of the alternate-current voltage at the time of driving liquid crystal. The voltage being input and held in the sample holding circuits 2903, 2905 is switched by receiving the polarity inversion signal (FR) by a switching circuit 2907 of a following stage, and input into an input side of an operational amplifier 2909 as a reference voltage (Vref) without distortion component fluctuated by setting of the same amplitude in synchronization with the voltage taken out from the scanning electrode 1. The operational amplifier 2909 accurately takes out only the distortion voltage component by taking out a difference between the reference voltage (Vref) without distortion component and a voltage of the scanning electrode including distortion component taken out from the scanning electrode 1.

In this way, in case where the scanning signal is polarity inverted, a voltage variation such as voltage distortion of the scanning electrode 1 is more effectively suppressed by taking out only the distortion voltage component of the scanning electrode voltage and the negative feedback to the scanning electrode 1. Therefore, the technique described is suitable for a polarity inversion period shorter than one frame period.

Even when a potential of the voltage distortion component of the scanning electrode is changed due to variation of an ambient temperature or change of static capacitance or the like of the liquid crystal cell through aged change, then the liquid crystal display device of this embodiment 18 is not affected by potential fluctuation of distortion component. Accordingly, even when an environment variation occurs such as in an operating temperature, a satisfactory negative feedback control is always performed to eliminate the voltage distortion and voltage variation or the like, in addition, the crosstalk of the display image is always suppressed to realize a high grade of image display.

The liquid crystal display device in this embodiment 18 is driven to display by the liquid crystal driving voltage employed in the described embodiments for performing polarity inversion at every 13 scanning line basis at a duty ratio of 1/200, a bias ratio of 1/13, and a frame frequency 80 Hz, then its display quality has been visually inspected.

First, the entire display is made white, and thereafter a white and black strip shape pattern is displayed on a region of vertical 150 dots×horizontal 10 dots adjacent to a center of the display, continuously, the dot number of horizontal of the region is gradually increased up to 500 dots, and in any cases a satisfactory uniform display without crosstalk has been maintained. When Chinese characters or alphabet are continuously displayed, generation of the distortion voltage in the scanning electrode is suppressed, and a satisfactory display without crosstalk is maintained.

Moreover, the liquid crystal display device of the embodiment 18 is placed under the environment condition of an ambient temperature 50° C. to be display in the way described above, where a uniform display without crosstalk has been maintained over a long time.

Furthermore, the liquid crystal display device of this embodiment 18 is allowed to display as described above under the environmental condition of the ambient temperature 50° C., similarly a uniform display without crosstalk has been maintained.

Next, the liquid crystal display device of the embodiment 18 is also placed under the environment condition of an ambient temperature 25° C. and lighted continuously during 2000 hours thereafter to be display in the same way as described above, then in this case, also the uniform display without crosstalk has been maintained. Accordingly, it is confirmed from this experimentation that the liquid crystal display device of the invention exhibits a high grade of display characteristic having a satisfactory durability with a high reliability.

EMBODIMENT 19

Figure 31:
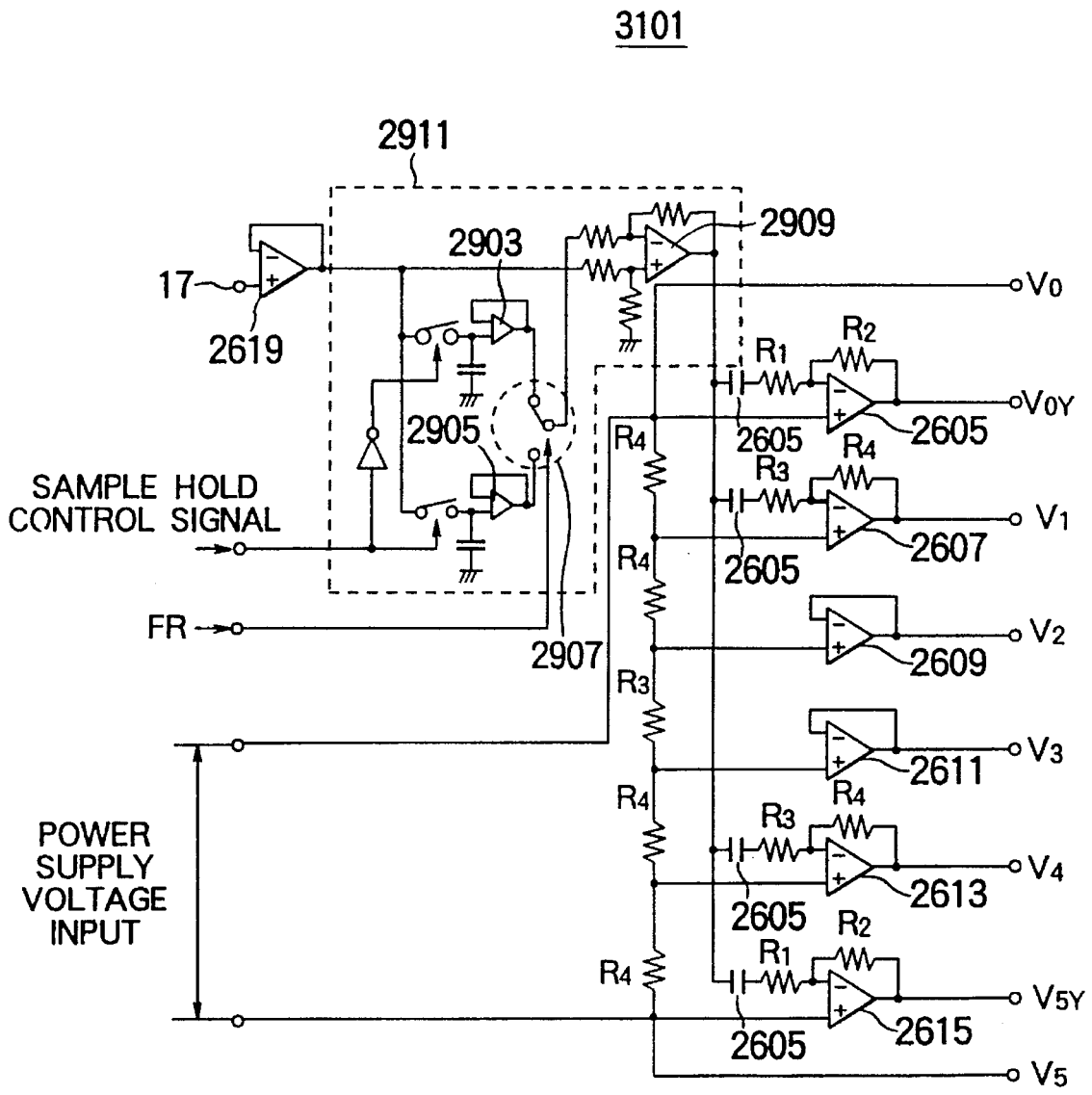
FIG. 31 is a view of a liquid crystal display device of an embodiment 19.

The negative feedback control has been performed only for the scanning non-selected voltage in the previous embodiment 18. But the same negative feedback control is performed also for the scanning pulse. To realize this, a driving voltage supply circuit 3101 in FIG. 31 is provided instead of the driving voltage supply circuit 2901 described. In the driving voltage supply circuit 3101, an output from the operational amplifier 2909 is applied not only to V1, V4 but also to V0Y, V5Y, and only the voltage distortion component detected from the scanning electrode is more accurately taken out and negative fed back to V0Y, V5Y.

A plurality of voltage detecting electrodes are further provided, of course, to carry out the positionally more uniform detection for the scanning electrode voltage.

EMBODIMENT 20

Figure 32:
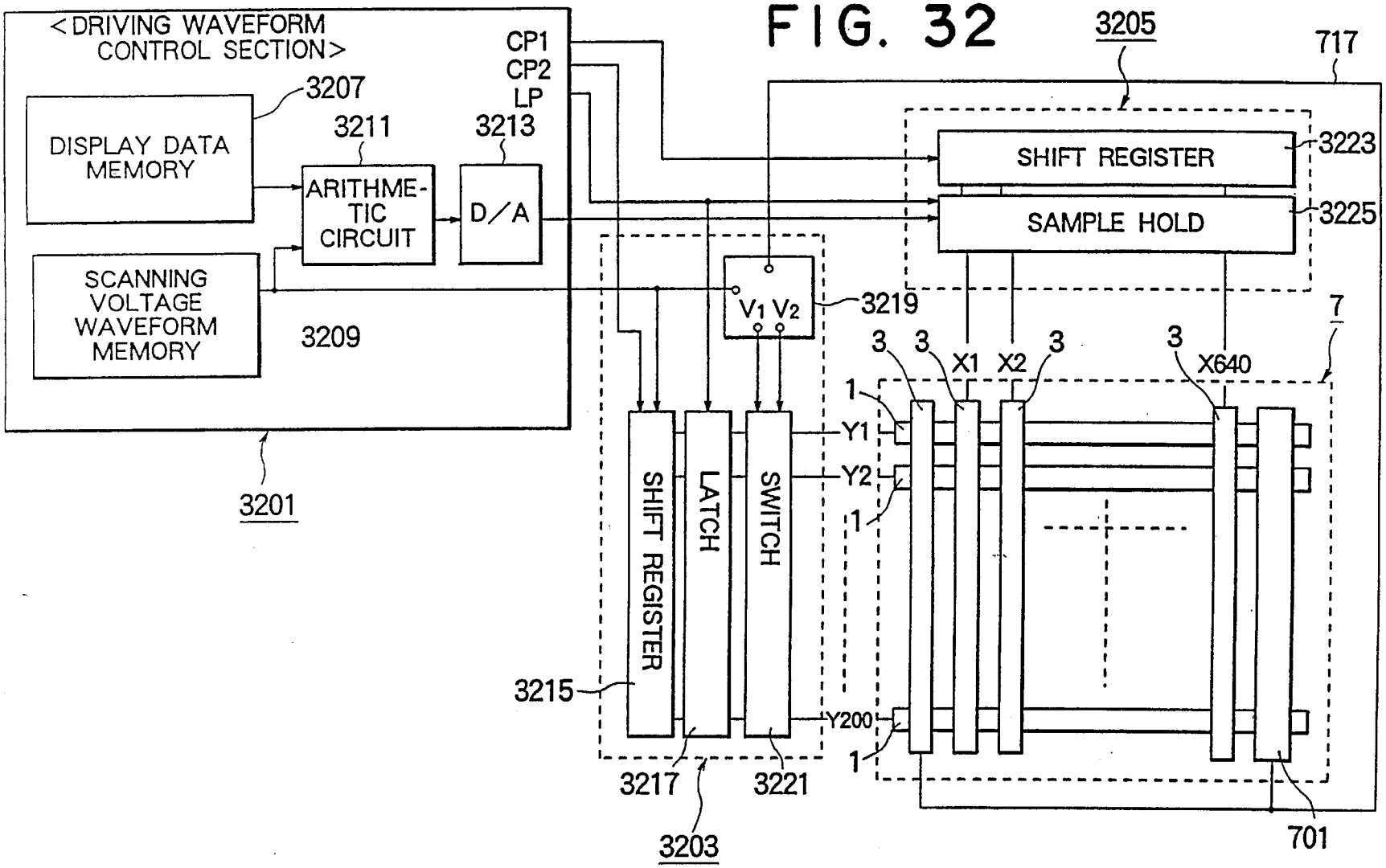
FIG. 32 is a view of a liquid crystal display device of an embodiment 20.

FIG. 32 shows a liquid crystal display device of this embodiment 20, which are constituted of a liquid crystal display element 7, a driving waveform control section 3201, a scanning driver circuit 3203, and a data driver circuit 3205.

The liquid crystal display element 7 is the same as in the embodiments described.

The driving waveform control section 3201 in accordance with Active Addressing Driving Method as disclosed in SID, '92, Digest, p.228 to p.231, comprises a display data memory 3207 for temporary holding display data (DATA) being sequentially input, a scanning signal waveform memory 3209 for storing voltage waveform data corresponding to one period (frame) applied to the scanning electrode 1, and an arithmetic circuit 3211 for producing a signal waveform by being computed from the display data and the scanning signal waveform data. In the display data memory using RAM, the display data corresponding to one display picture (640×200 dots) being sequentially transferred are once held as an alignment 1 (i, J) of 200 rows, 640 columns (i=1–200, j=1–640), those at every 200 row basis are transferred to an arithmetic circuit 3211 in a parallel way. The scanning signal waveform memory 3209 using ROM, in which voltage waveform data F1 (t) (i=1–200) corresponding to one period supplied to the respective 200 scanning electrodes 1 are written in advance, is output repeatedly in parallel manner to each scanning electrode 1 and the arithmetic circuit 3211. For the voltage waveform, there presents an orthonormal system corresponding to 200 rows taken out from among Walsh orthonormal function, row and column, 256×256 formed of binary of −1 and −1.

The signal waveform given by the following equation is computed in the arithmetic circuit 3211, $$Gj(t) = (F/N^{1/2}) \times \sum_{i=1}^{n} I(i, j) \times Fi(t)$$

where F represents a voltage level adjustment coefficient, and N represents the number of scanning electrodes, here 200. This circuit 3211, which includes both exclusive logical sum arithmetic circuits with the number of 200 corresponding to the number of signal electrodes 3 and an adder circuit, computes as an exclusive logical sum a product of the display data (DATA) formed of binary of +1 and −1 and the scanning signal waveform data, and the resultant is added, amplified, and output to the data driver circuit 3205 as a data signal waveform Gj (t).

The scanning driver circuit 3203 includes a shift register 3215 for transferring data read from the scanning signal waveform memory 3209, a data latch 3217 for storing such data, and a switching section 3221 for selecting one from among two level voltage values supplied from a driving voltage supply circuit 3219 in accordance with the data, where is used TMS 57216 made by Japan Texas Instrument Corporation capable of outputting 8 levels of voltage values.

The data driver circuit 3205 samples and holds a voltage output from the arithmetic circuit 3211 over one line scanning period (1H) and outputs it at one time per 1H. The data driver circuit 3205 includes a shift register 3223 for generating a timing signal capable of sequentially sampling and a sample holding circuit 3225 for sampling and holding by receiving a voltage being output from the arithmetic circuit 3211. In this embodiment 20, a driver IC HD 66300 is used for the data driver circuit 3205.

The driving waveform control section 3201, the scanning driver circuit 3203, and the data driver circuit 3205 are controlled by three pulses; namely, a clock pulse supplied from the external for determining the timing of the data transfer and computation and the like; a latch pulse for determining an output timing to the liquid crystal display element 7 with respect to both a voltage applied to the scanning electrode 1 and another voltage applied to the signal electrode 3; and a frame pulse for determining one frame period.

Figure 33:
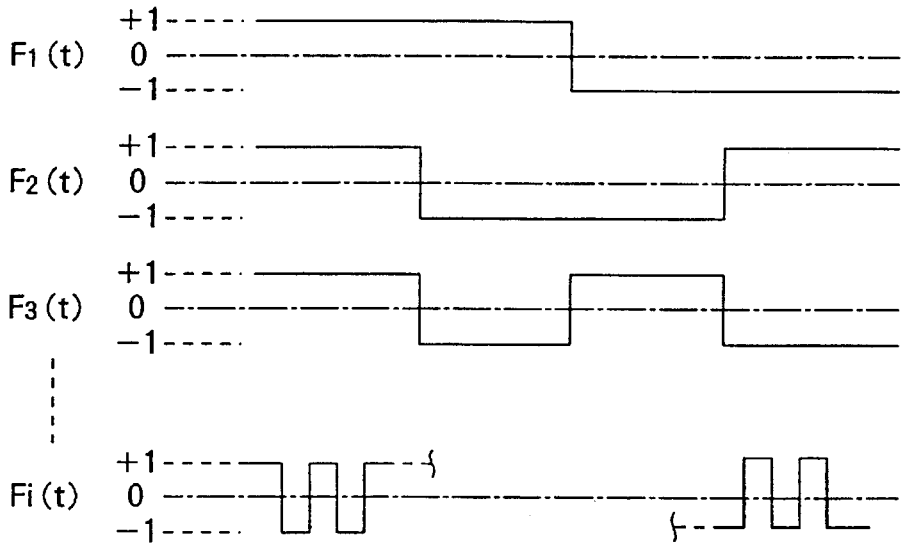
FIGS. 33(*a*), 33(*b*) and 33(*c*) are views of a driving voltage waveform of a liquid crystal display device of the embodiment 20.
Figure 33:
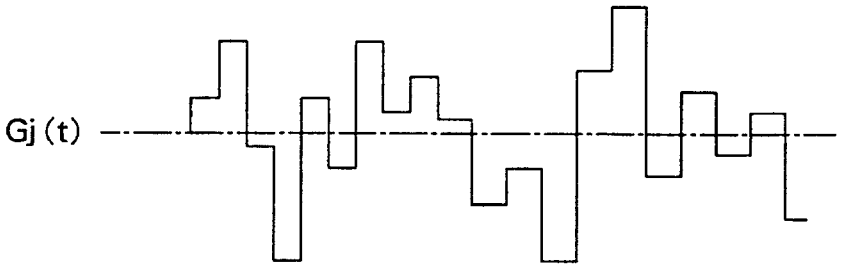
Figure 33:
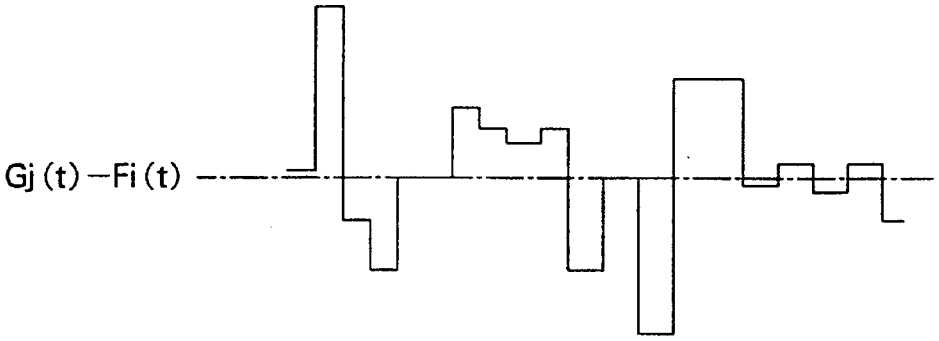

In accordance with a general voltage averaging method of the liquid crystal applying voltage, a voltage, which comprises both a selected pulse of a higher voltage in an extremely shorter time and a non-selected voltage of a lower voltage in a period other than descried, is applied to the liquid crystal within one frame period. Contrast to this, in accordance with the driving method in this embodiment 20, both the scanning signal waveform Fi (t) formed of Walsh function of binary in FIG. 33(*a*) and the signal waveform Gj (t) of multi-values in FIG. 33(*b*) obtained from a computed result of the display data and the scanning signal waveform data, are applied to the liquid crystal, and the obtained resultant values are become the waveform of liquid crystal applying voltage, which becomes the waveform where a high voltage is distributed in a frame period in FIG. 33 (C). Therefore, in case where the liquid crystal display element having a rapid response time is used, in the conventional general voltage averaging method, it becomes the so called "frame response" state following the selected pulse to lower the contrast rate. On the other hand, according to the active addressing driving method, such an adverse influence is prevented, then an advantage is obtained in a higher contrast ratio.

Figure 34:
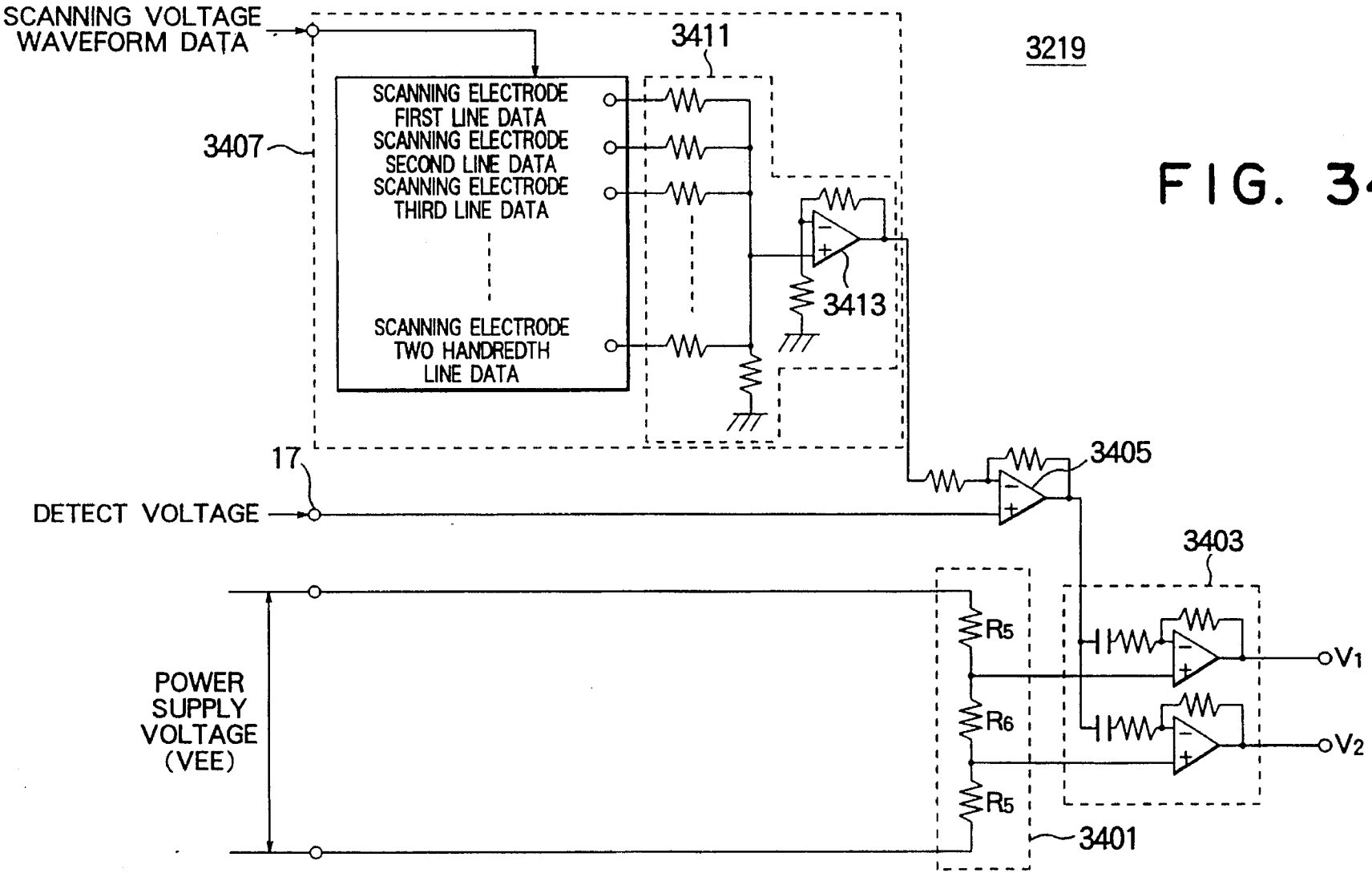
FIG. 34 is a view of a liquid crystal display device of the embodiment 20.
Figure 35:
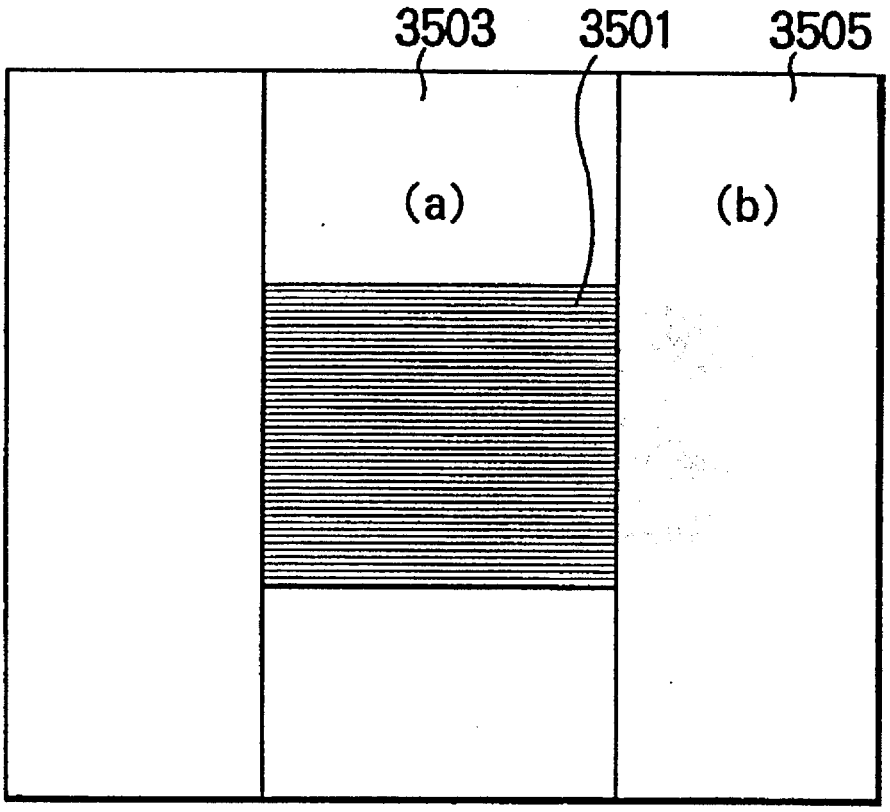
FIG. 35 (PRIOR ART)
FIG. 35 is a view of a crosstalk on a display image of the conventional liquid crystal display device.
Figure 36:
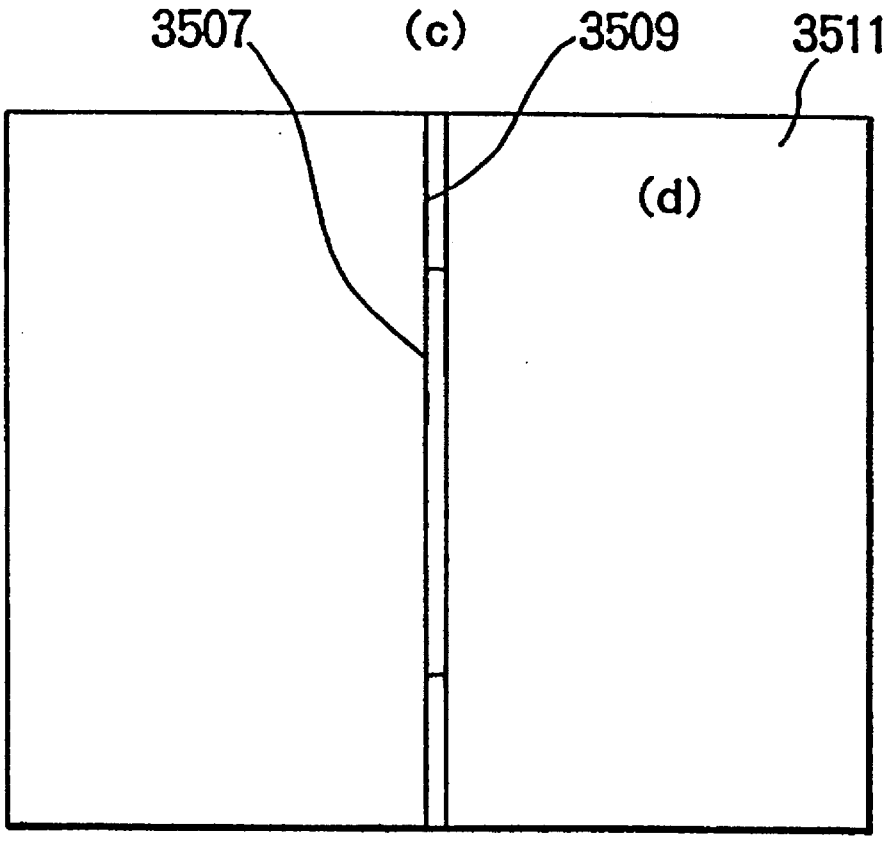
FIG. 36 (PRIOR ART)
FIG. 36 is a view of a crosstalk on a display image of the conventional liquid crystal display device.
Figure 37:
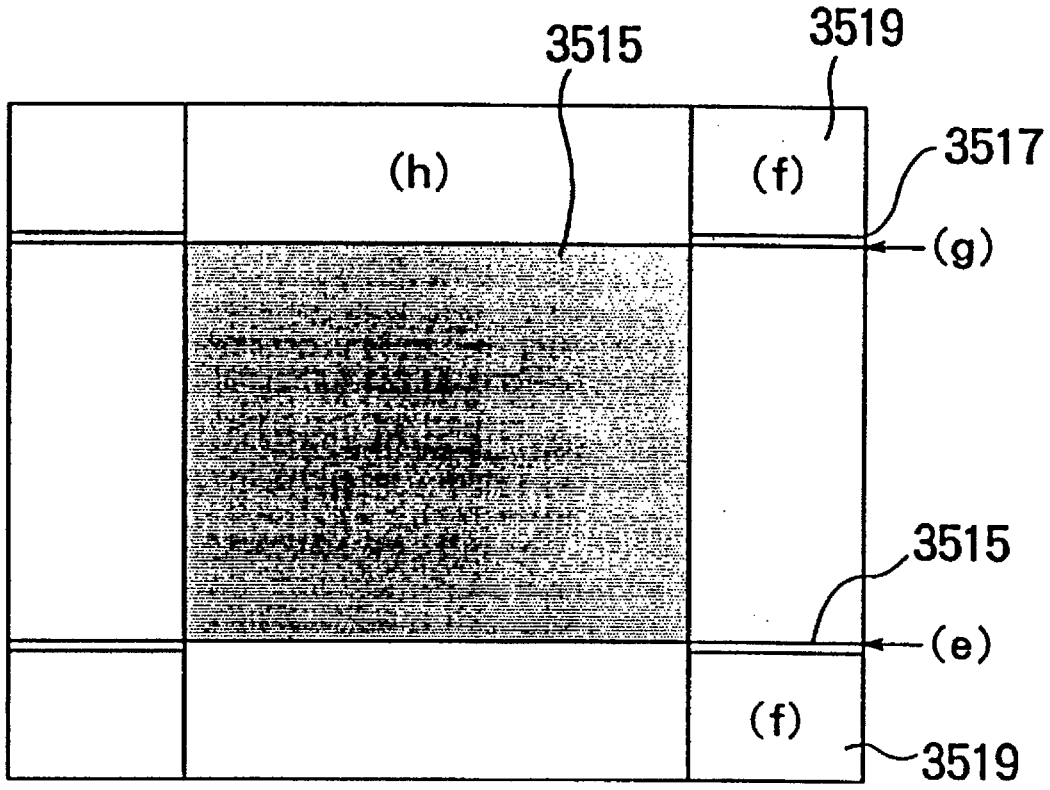
FIG. 37 (PRIOR ART)
FIG. 37 is a view of a crosstalk on a display image of the conventional liquid crystal display device.
Figure 38:
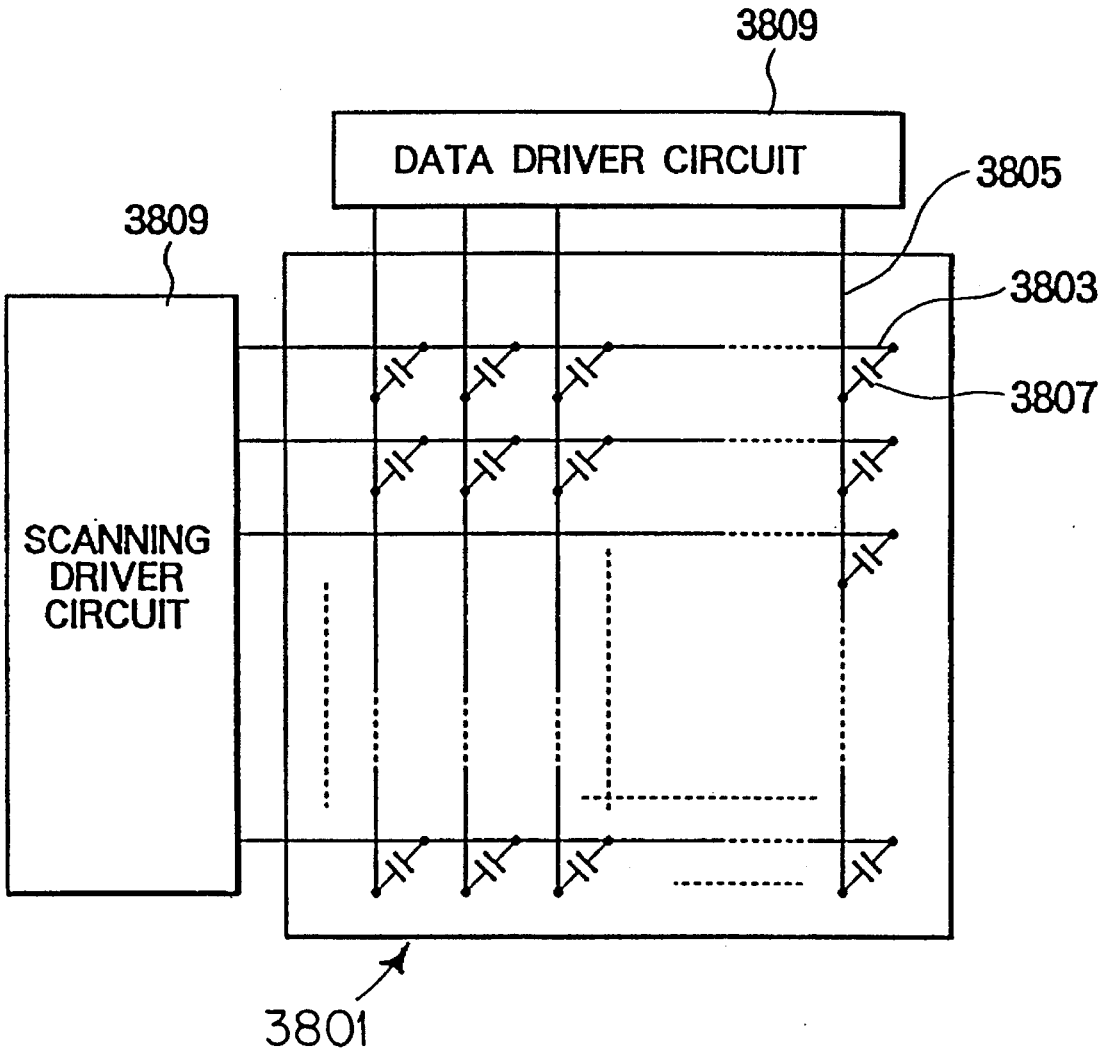
FIG. 38 (PRIOR ART)
FIG. 38 is a view of the conventional liquid crystal display device.
Figure 40:
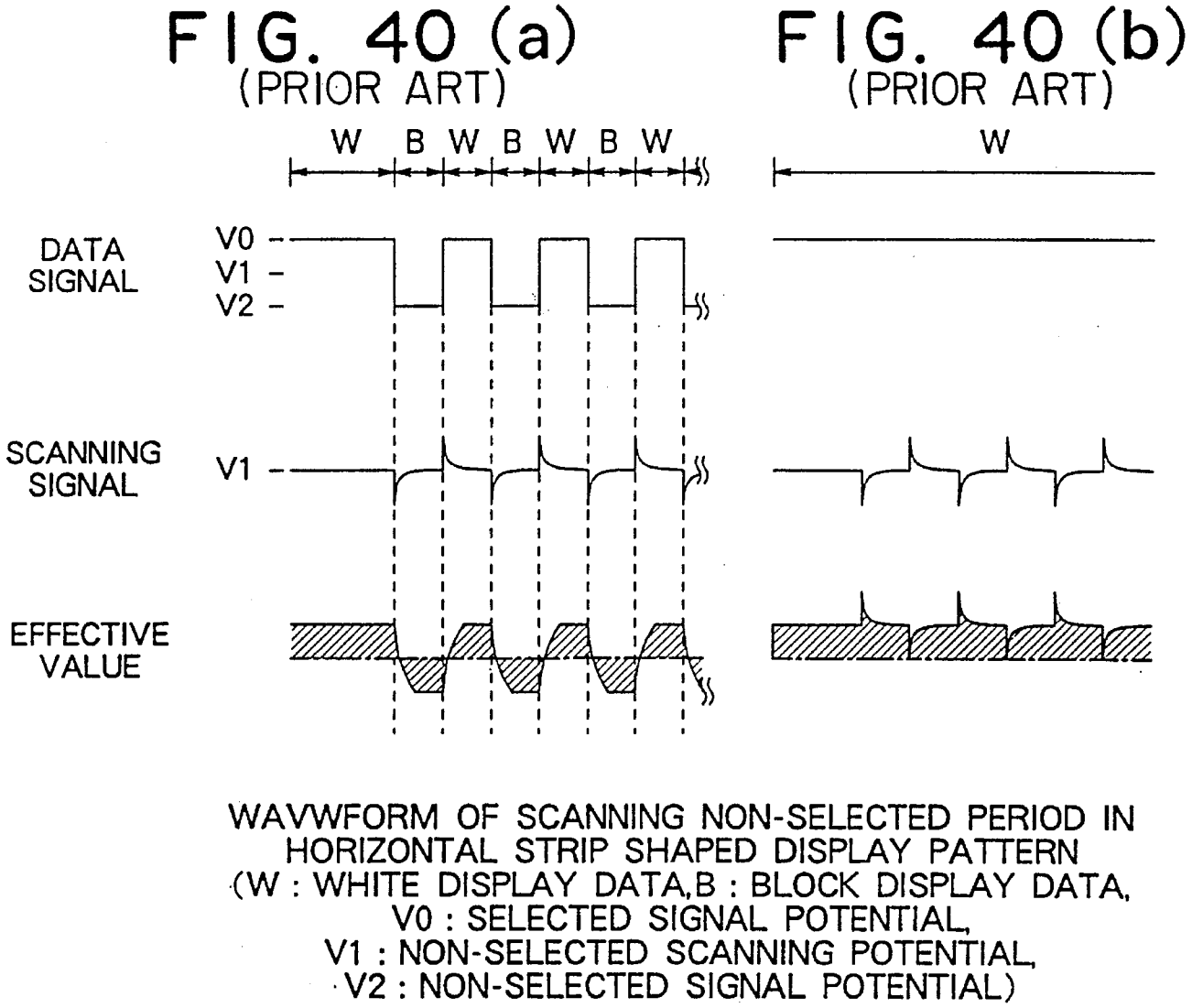
FIG. 40 (a) (PRIOR ART)
FIG. 40 (b) (PRIOR ART)
FIGS. 40(*a*) and 40(*b*) show voltage variation such as voltage distortion produced in a liquid crystal applying voltage of the conventional liquid crystal display device.
Figure 41:
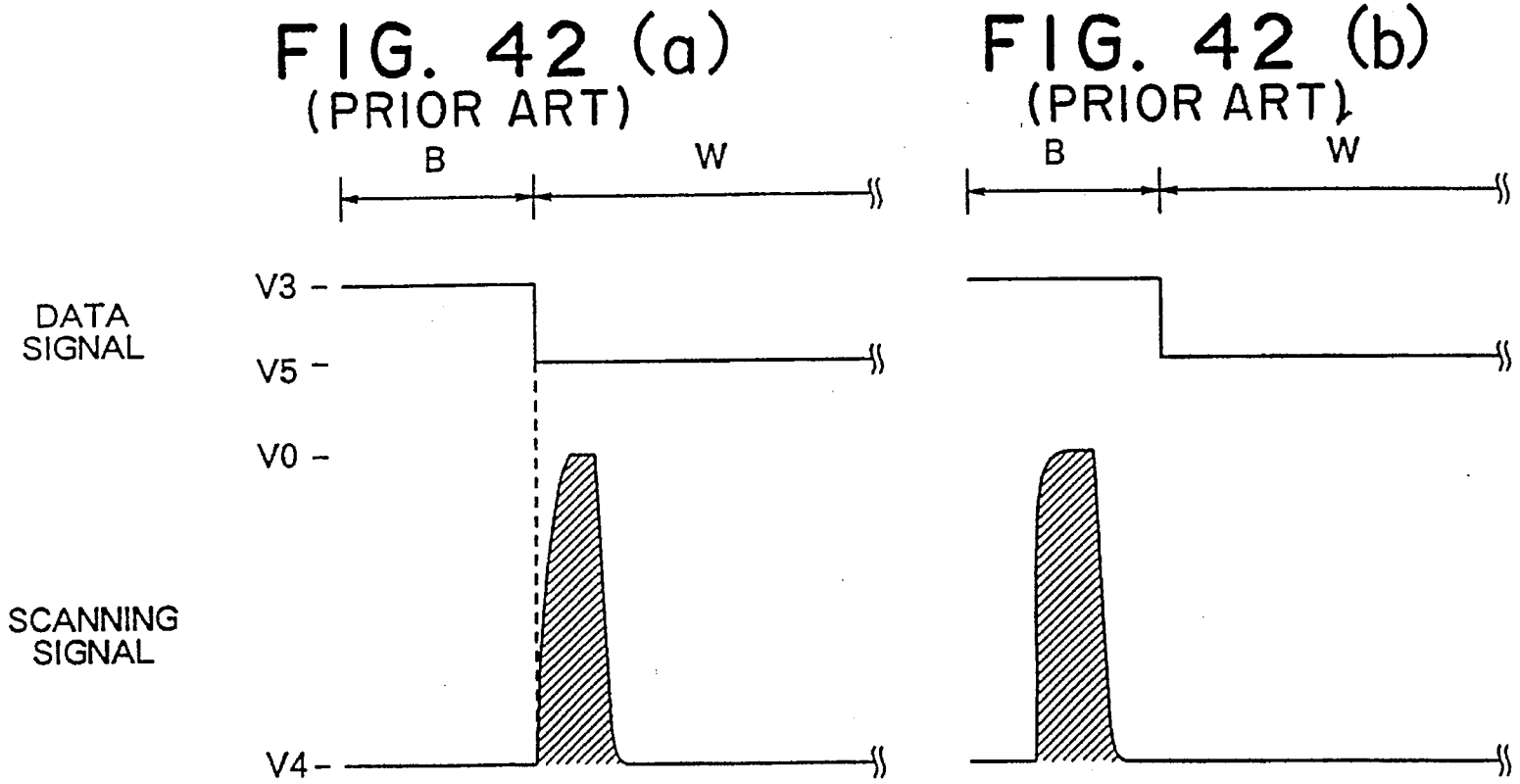
FIGS. 41(*a*) and 41(*b*) show voltage variation such as voltage distortion produced in a liquid crystal applying voltage of the conventional liquid crystal display device.
Figure 42:
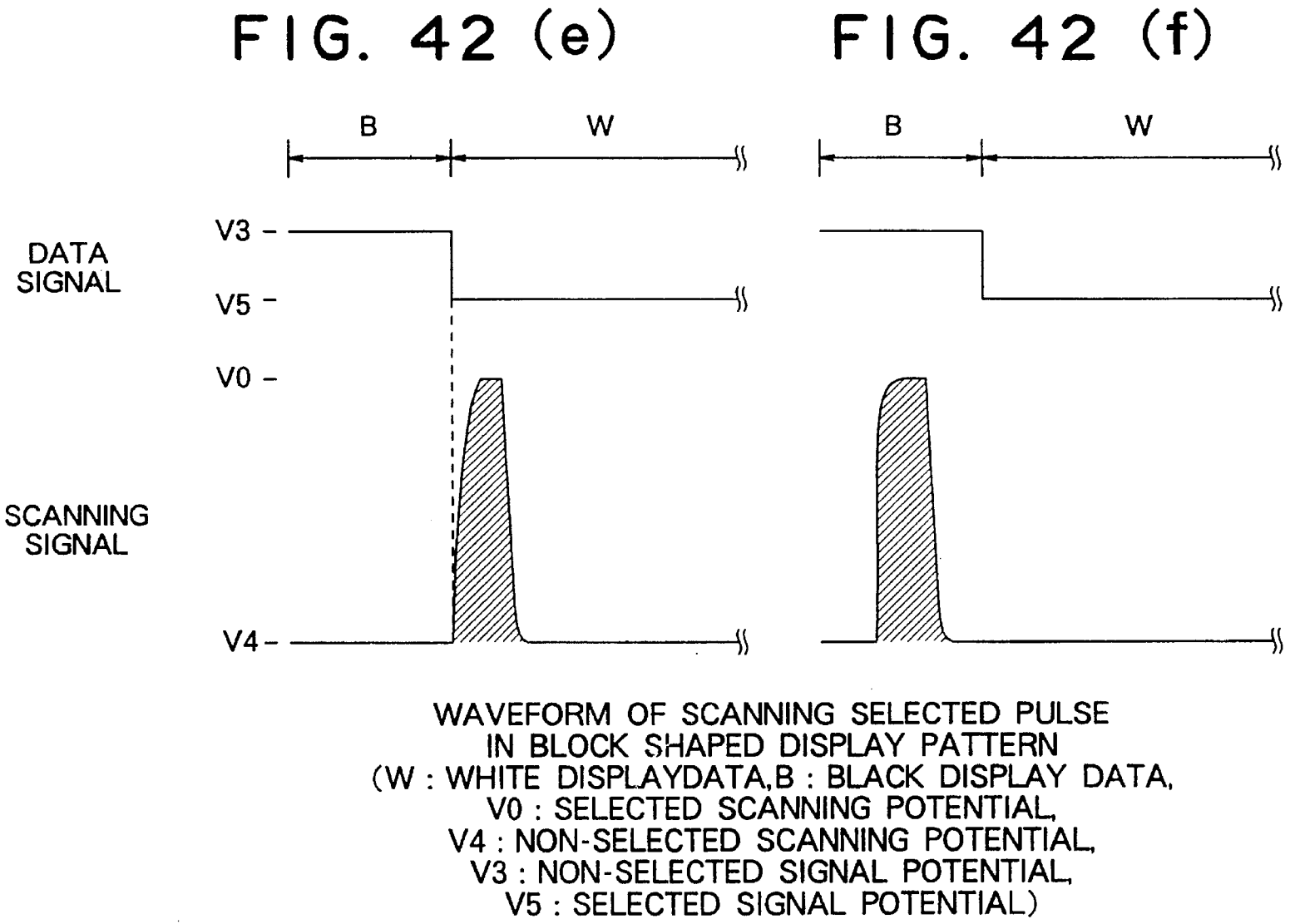
FIGS. 42(*a*) and 42(*b*) show voltage variation such as voltage distortion and dull waveform produced in a liquid crystal applying voltage of the conventional liquid crystal display device.

The driving voltage supply circuit 3219 in FIG. 34 essentially includes a voltage dividing circuit 3401 for generating 2 level voltages $V_1$, $V_2$ supplied to the scanning driver circuit 3203 and an operational amplifier 3403. The power supply voltage ($V_{EE}$) from the external, a negative feedback voltage detected from the scanning electrode 1 by the voltage detecting electrode 70, and the reference voltage ($V_{ref}$) are input and divides the power supply voltage $V_{EE}$ to produce direct-current voltages $V_1$ and $V_2$, and concurrently the distortion voltage component taken out from a difference between the fed back voltage and the reference voltage ($V_{ref}$) by an operational amplifier 3405 is negative fed back to $V_1$ and $V_2$.

A reference voltage produce section 3407, which is a part for obtaining the total sum of scanning signals, is formed using an adder circuit with a data latch. The voltage waveform data supplied to each of 200 scanning electrodes 1 from the scanning signal waveform memory 3209 is input into a data latch circuit 3409 to obtain a voltage proportional to a sum of 200 data at an adder circuit 3411 on the following stage, and thus obtained voltage is supplied to the operational amplifier 3405 through a buffer 3413 as a reference voltage ($V_{ref}$).

In this embodiment 20, since the Walsh function with binary is used as a voltage waveform applied to the scanning electrode 1, then the voltage value supplied to the respective scanning electrodes 1 is not uniform at every electrode and also uneven at timing, where the other functions may be used so long as it is an orthonormal system. Therefore, an uneven voltage at timing proportional to the mean voltage value supplied to all the scanning electrodes 1 is detected in addition to the distortion voltage component as a negative feedback voltage taken out from the scanning electrode 1 by the voltage detecting electrode 701.

When a voltage proportional to a sum of the scanning signal waveform data described is used as a reference voltage ($V_{ref}$) and a distortion voltage component is taken out using a difference between such voltage proportional to the sum and a voltage detected from the voltage detecting electrode 701, then only the distortion voltage component of the scanning electrode 1 is extracted irrespective of voltage waveform to be input. The extracted voltage is negative fed back to the scanning electrode 1 itself through the driving voltage supply circuit, then a voltage variation such as a voltage waveform distortion of the scanning electrode is canceled.

The liquid crystal display device of the embodiment 20 is driven to display at a frame frequency of 80 Hz, and its display quality is visually inspected.

After the display is made white, a white and black strip shape pattern is displayed on a region of vertical 150 dots×horizontal 10 dots adjacent to a center of the display, continuously, the dot number of horizontal of the region is gradually increased up to 500 dots. Then, in any cases a satisfactory uniform display without crosstalk has been maintained. When Chinese characters or alphabet are continuously displayed, a satisfactory uniform display without crosstalk due to the voltage distortion has been maintained.

The Active Addressing Driving Method has hereinbefore been described. In case where the liquid crystal display device is driven by the Multiple Line Method having the same principle as the Active Addressing Driving Method, then it is also a matter of course that the technique of the invention is suitable for reducing the crosstalk. A typical example is newly considered in that the scanning electrodes 1 are divided into 50 groups each having 4 scanning electrodes 1 in the liquid crystal display device of the construction described.

One period (frame) is equally divided into 50 groups as above, each group is given of an orthonormal system data formed of +1 and −1 only during the 1/50 of one period, and the remaining period is rewritten of the memory of the scanning signal waveform memory 3209 for being given 0 data. Following this, the voltage dividing circuit 3401 and the operational amplifier 3403 of the driving voltage supply circuit 3219 are each increased of one more stage for obtaining ternary of $V_1$, $V_2$, $V_3$ matching to data +1, 0, −1. On driving, where the condition other than used above is allowed to meet those in the liquid crystal display device described, then a voltage waveform applied to the liquid crystal comes to have 4 clear selected pulses during one period (frame).

The liquid crystal display device of this construction is driven to display at a frame frequency of 80 Hz, and its display quality has been visually inspected.

After the display is made white, a white and black strip shape pattern is displayed on a region of vertical 150 dots×horizontal 10 dots adjacent to a center of the display, continuously, the dot number of horizontal of the region is gradually increased up to 500 dots. Then, in any cases a satisfactory uniform display without crosstalk has been maintained. When Chinese characters or alphabet are continuously displayed, generation of distortion voltage is suppressed and a uniform display without crosstalk has been maintained in the scanning electrode.

The voltage detecting electrode 701 in the liquid crystal display element 7 in the embodiments described is not limited to an arrangement on a terminus portion of the scanning electrode 1. For example, it may provide a power supply portion for obtaining a mean value from voltages detected from such both portions.

As hereinbefore fully described, the invention provides a liquid crystal display device capable of solving a disadvantage of generation of the display irregularity (crosstalk) on the display surface by a simple inexpensive means and realizing a high grade of image display.

What is claimed is:

1. In a liquid crystal display device, comprising a scanning electrode substrate formed of a plurality of scanning electrodes, a data electrode substrate formed thereon with a plurality of signal electrodes arranged opposing to and intersecting with a plurality of the scanning electrodes having gaps therebetween, a liquid crystal display panel maintaining a liquid crystal layer sealed and held between the scanning electrode and the signal electrode, a driving voltage supply circuit for outputting a plurality of voltage levels of producing a scanning voltage and a scanning non-selected voltage, a scanning driver circuit which has a switching circuit for applying to the scanning electrode one voltage selected from among a plurality of levels of voltages output from the driving voltage supply circuit and which applies to each of a plurality of scanning electrodes a scanning signal formed by a combination of the scanning selected voltage and the scanning non-selected voltage, and a data driver circuit for applying to each of a plurality of signal electrodes a data signal, a liquid crystal display device characterized in that;

a voltage detecting electrode opposing to a plurality of the scanning electrodes through the liquid crystal layer is formed on the data electrode substrate substantially in parallel with the signal electrode and a plurality of the electric capacitances are formed of the voltage detecting electrode and the liquid crystal layer and the scanning electrode;

by connecting the voltage detecting electrode as an other terminal of the electric capacitance to the operational amplifier, the voltage detecting electrode takes out a voltage distortion component from the voltage on the scanning electrode by a capacitive coupling of the electric capacitance and put the voltage distortion components in the operational amplifier to synthesize with a voltage for producing a non-selected voltage from among a plurality of levels of voltages being output from the driving voltage supply circuit, and a negative feedback loop for executing a negative feedback control of a scanning non-selected voltage of a plurality of the scanning electrodes is formed to suppress generation of distortion of the scanning non-selected voltage of the scanning electrode;

a dull waveform generating circuit for making dull (delay) of at least either of a waveform at rise or a waveform at fall of the scanning selected voltage being output from the driving voltage supply circuit is provided on the driving voltage supply circuit to reduce an influence of fluctuation of an effective voltage due to distortion of the scanning selected voltage.

2. A liquid crystal display device as claimed in claim 1, wherein a liquid crystal display device further comprising;

a reference voltage circuit for producing a reference voltage, and an operational amplifier in which a difference between the reference voltage and a voltage detected from the scanning electrode by the voltage detecting electrode.

3. A liquid crystal display device as claimed in claim 1, wherein a liquid crystal display device further comprising;

a sample holding circuit for sample holding a voltage detected from the scanning electrode and feeding to the operational amplifier in synchronization with a switching operation of the switching circuit, and an operational amplifier for computing a difference between a voltage fed from the sample holding circuit and a voltage detected from the scanning electrode and inputting the difference of said voltages to the operational amplifier.

4. A liquid crystal display device as claimed in claim 1, wherein reference voltage produce section computing and producing mean value of scanning signal in accordance with scanning voltage waveform data which used in the switching circuit for selecting one voltage level from among the plurality of voltages, and an operational amplifier computing difference between the mean value of scanning signal and the voltage detected from the scanning electrode by the voltage detecting electrode.

* * * * *